US006964465B2

(12) United States Patent
Endo

(10) Patent No.: US 6,964,465 B2
(45) Date of Patent: Nov. 15, 2005

(54) PRINTING APPARATUS, STORAGE MEDIUM HAVING A PROGRAM RECORDED THEREON, PATTERN, COMPUTER SYSTEM, AND PRINTING METHOD

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/370,070

(22) Filed: Feb. 21, 2003

(65) Prior Publication Data

US 2003/0179256 A1 Sep. 25, 2003

(30) Foreign Application Priority Data

Feb. 21, 2002 (JP) ..... 2002-045204
Feb. 22, 2002 (JP) ..... 2002-046444
Feb. 22, 2002 (JP) ..... 2002-046445

(51) Int. Cl.[7] ..... B41J 29/393
(52) U.S. Cl. ..... 347/19
(58) Field of Search ..... 347/19; 400/74

(56) References Cited

U.S. PATENT DOCUMENTS 5,448,269 A 9/1995 Beauchamp et al.
6,082,911 A * 7/2000 Murakami ..... 400/74
6,126,345 A 10/2000 Ito et al.
6,137,592 A 10/2000 Arquilevich et al.
6,196,736 B1 3/2001 Otsuki et al. ..... 347/19
6,439,684 B1 8/2002 Yoshimura et al.
6,454,390 B1 * 9/2002 Takahashi et al. ..... 347/41
6,464,321 B1 10/2002 Nunokawa ..... 347/19
6,523,926 B1 2/2003 Mitsuzawa et al. ..... 347/19
6,692,096 B1 2/2004 Otsuki et al. ..... 347/19
6,700,593 B2 * 3/2004 Otsuki ..... 346/19
6,769,759 B2 8/2004 Yamasaki et al.
6,832,825 B1 12/2004 Nishikori et al. ..... 347/19
2001/0030671 A1 10/2001 Fujimori

FOREIGN PATENT DOCUMENTS

JP 10-329381 12/1998
JP 11-49399 2/1999
JP 2001-10088 1/2001

* cited by examiner

*Primary Examiner*—Thinh Nguyen
*Assistant Examiner*—Julian D. Huffman
(74) *Attorney, Agent, or Firm*—Sughrue Mion, PLLC

(57) ABSTRACT

A printing apparatus of the invention has an ejection head for ejecting ink droplets to form dots on a printing medium. The printing apparatus is capable of printing a correction pattern on the printing medium with the ejection head, the correction pattern having a plurality of sub-patterns for correcting a misalignment between a position at which dots are formed during a forward pass through which the head is moved and a position at which dots are formed during a return pass through which the head is moved, and correcting the misalignment based on two or more sub-patterns that stand out in density among the plurality of sub-patterns.

20 Claims, 36 Drawing Sheets

PRINTING APPARATUS, STORAGE MEDIUM HAVING A PROGRAM RECORDED THEREON, PATTERN, COMPUTER SYSTEM, AND PRINTING METHOD

BACKGROUND OF THE INVENTION

The present application claims priority on Japanese Patent Application No. 2002-45204 filed on Feb. 21, 2002, Japanese Patent Application No. 2002-46444 filed on Feb. 22, 2002, and Japanese Patent Application No. 2002-46445 filed on Feb. 22, 2002, which are herein incorporated by reference.

1. Field of the Invention

The present invention relates to a printing apparatus, a storage medium having a program recorded thereon, a correction pattern, a computer system, and a printing method.

2. Description of the Related Art (1) In recent years, inkjet printers in which a print head, for ejecting ink, is provided on a cartridge that performs scanning in the main-scanning direction and in which printing is performed by ejecting ink while scanning with the cartridge have become popular as an output apparatus of a computer. Among such inkjet printers are those that include a function for "bidirectional printing," in which printing is carried out by ejecting ink during the forward pass as well as during the return pass, in order to increase the printing speed.

When performing bidirectional printing, it is necessary to correct the positions where the ink droplets land during the forward pass and the return pass because the image will be deteriorated if the ink droplets land in different positions in the main-scanning direction during the forward and return passes. For this reason, the printers are configured so that a plurality of correction amounts can be set, and a user or the like selects an appropriate correction amount and sets it for the printer.

One method for selecting the correction amount is, for example: to print, during the forward pass printing, vertical lines that extend in the sub-scanning direction and that are printed with a constant spacing therebetween in the main-scanning direction using nozzles at the front of the print head; and then, taking vertical lines, which connect straight to the above-mentioned vertical lines when printed in ideal positions, as a reference, to print, during the return pass printing, a plurality of vertical lines that are shifted in the direction in which the above-mentioned correction amount increases and in the direction in which it decreases using the nozzles at the rear end of the print head. The user visually confirms that the vertical lines printed during the forward pass and the vertical lines printed during the return pass of the thus-obtained print pattern have been printed in a straight line, and then selects that correction amount.

However, because the correction amounts are extremely small, it is difficult to visually ascertain whether two vertical lines arranged next to each other front to back are lined up in a straight line or are misaligned, and there is a possibility that the user, for example, may make an incorrect selection.

(2) In recent years, a type of color printer that ejects several colors of ink from its head has gained wide popularity as an output apparatus for computers. Some such inkjet color printers have a function for performing so-called "bidirectional printing" in order to increase the printing speed.

Also, inkjet printers were only capable of reproducing each pixel according to binary values of on and off; however, in recent years, multivalue printers that are capable of reproducing a single pixel with multiple values, such as three or more values, have also been proposed. Multivalue pixels can be formed by ejecting ink droplets of the same color for a single pixel in a plurality of sizes, for example.

When performing bidirectional printing using a multivalue printer, with which a plurality of ink droplets are ejected for a single pixel, the image quality may be deteriorated due to differences in the printing characteristics in the forward pass and in the return pass. For example, when the positions where ink droplets of various sizes land in the main-scanning direction are different during the forward pass and the return pass, the image quality is deteriorated as a result.

(3) Printing apparatuses such as inkjet printers comprise: a print head that ejects ink and that is provided on a carriage which performs scanning in the main-scanning direction, and a carrying device that carries a print sheet by a constant carry amount. Such printing apparatuses print by sequentially carrying the print sheet in correspondence with the printing operation of the print head. Thus, in order to achieve good printing, it is necessary to accurately carry the print sheet, and one method for this is disclosed in Japanese Patent Application Laid-open Publication No. 11-49399 (U.S. Pat. No. 6,101,426), which discloses a printing apparatus provided with a carrying device. A carry error, which appears at a specified period as the carry roller for carrying the print sheet rotates, is measured for the carrying device, this period is divided into a plurality of sections, and correction values of the carry errors for each section are set to the carry device during the manufacturing stage; the carry device carries the print sheet after the carry amount is corrected using the correction values.

However, for example, differences in the environment in which the printing apparatus is used, differences in the amount of change in the shape of the carry roller due to the thickness of the print sheet, and differences in the coefficient of friction among different types of print sheets, may change the carrying of the print sheets. This results in the problem that even if correction values for carry errors are set during manufacturing, the correction values that are set in the manufacturing stage may not always be the most appropriate depending on the usage environment of the user or the print sheets that are used, leading to instances where the print sheet is not carried appropriately.

Thus, a configuration that allows the user to correct the carry amount is preferable; however, if, as in the above, it is desired that the print sheet is carried with enough accuracy that the slightest change in the condition of the carry roller has to be corrected, then, to perform a more accurate correction, it is necessary to increase the number of sections into which the period is divided and to allow a large number of correction values to be set to each section. However, if the number of sections or the number of correction values is increased, although it may be possible for the user to correct the carry amount, it is difficult for users to determine an appropriate value for the correction amount, and no proposal has been made for determining means that allow this to be determined easily.

SUMMARY OF THE INVENTION

A first aspect of the invention has been made to solve the foregoing first problem, and it is an object thereof to precisely correct the positions where ink droplets land in the main-scanning direction during the forward pass and the return pass in bidirectional printing.

A first main invention for achieving the foregoing object is a printing apparatus comprising: an ejection head for ejecting ink droplets to form dots on a printing medium; wherein the printing apparatus is capable of printing a correction pattern on the printing medium with the ejection head, the correction pattern having a plurality of sub-patterns for correcting a misalignment between a position at which dots are formed during a forward pass through which the head is moved and a position at which dots are formed during a return pass through which the head is moved, and correcting the misalignment based on two or more sub-patterns that stand out in density among the plurality of sub-patterns.

A second aspect of the invention has been made to solve the foregoing second problem, and it is an object thereof to prevent deterioration of image quality caused by differences in the printing characteristics during the forward pass and the return pass when bidirectional printing is carried out using a multivalue printer.

A second main invention for achieving the foregoing object is a printing apparatus comprising: an ejection head for selectively ejecting ink droplets of a plurality of sizes to form dots on a printing medium; wherein the printing apparatus is capable of printing a correction pattern on the printing medium, the correction pattern enabling correction of a misalignment between a position at which dots are formed during a forward pass through which the head is moved and a position at which dots are formed during a return pass through which the head is moved, and a spacing in a sub-scanning direction between dots that make up the correction pattern printed by ejecting ink droplets of a certain size from the ejection head is different from a spacing in the sub-scanning direction between dots that make up the correction pattern printed by ejecting ink droplets of a different size from the ejection head.

A third aspect of the invention has been made in light of the aforementioned third problem, and it is an object thereof to print a carry amount correction pattern for determining the correction amount of the carry amount of the print sheet for each predetermined section obtained by segmenting.

A third main invention for achieving the foregoing object is a printing apparatus comprising: a carry roller for carrying a print sheet; wherein the carry roller has virtual circumference segments that are obtained by virtually dividing a circumference of the carry roller into a plurality of segments in a direction in which the carry roller is rotated, and the printing apparatus is capable of printing a plurality of patterns for each of the virtual circumference segments, each of the patterns corresponding to a different correction amount, and setting a correction amount corresponding to one of the patterns to each virtual circumference segment.

Features and objects of the present invention other than the above will become clear by reading the description of the present specification with reference to the appended drawings.

BRIEF DESCRIPTION OF THE DRAWINGS

FIGS. 22A and 22B are diagrams for illustrating a correction pattern formed by large dots.

Figure 1:
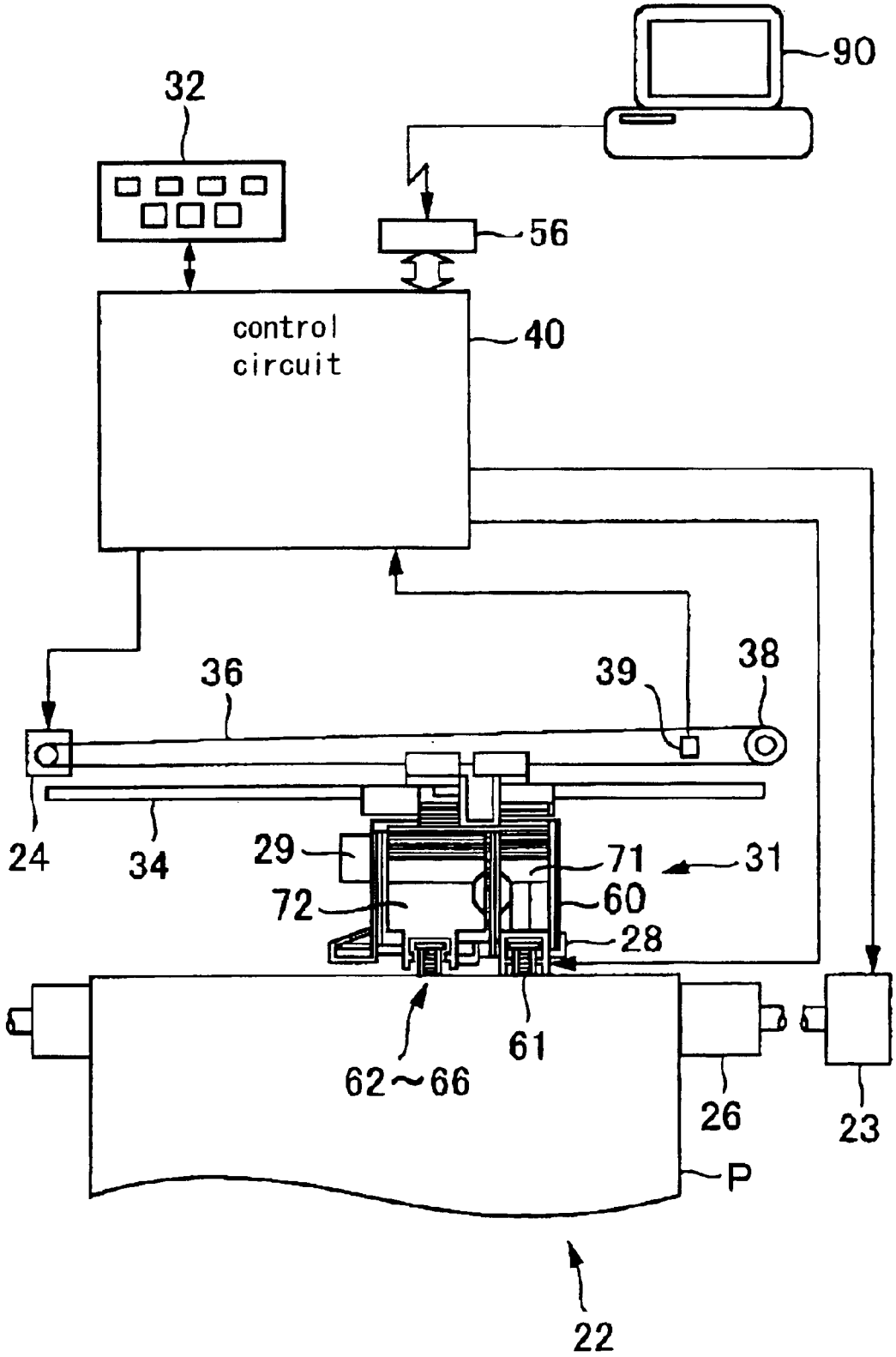
FIG. 1 is a diagram that schematically shows the configuration of a printing system provided with an inkjet printer 22.

For a more complete understanding of the present invention and the advantages thereof, reference is now made to the following description taken in conjunction with the accompanying drawings.

DESCRIPTION OF PREFERRED EMBODIMENTS

<Outline of the Disclosure>

At least the following matters will be made clear by the explanation in the present specification and the description of the accompanying drawings.

A printing apparatus comprises:

an ejection head for ejecting ink droplets to form dots on a printing medium;

wherein the printing apparatus is capable of printing a correction pattern on the printing medium with the ejection head, the correction pattern having a plurality of sub-patterns for correcting a misalignment between a position at which dots are formed during a forward pass through which the head is moved and a position at which dots are formed during a return pass through which the head is moved, and correcting the misalignment based on two or more sub-patterns that stand out in density among the plurality of sub-patterns.

For example, when printing the sub-patterns, if the ideal position at which the dots are formed during the forward pass, through which the head is moved, and the ideal position at which the dots are formed during the return pass, through which the head is moved, are in the same position, then when there is no misalignment between the dot formation position in the forward pass and the dot formation position in the return pass, the dots formed during the forward pass and the dots formed during the return pass will overlap one another, whereas when there is a misalignment, those dots will be printed in different positions. Thus, when there is no misalignment, the amount of ink that occupies the surface of the printing medium is small and thus the density will be low, whereas when there is a misalignment, the amount of ink that occupies the surface of the printing medium is large, increasing the density. Also, if the ideal position at which the dots are formed during the forward pass and the return pass are shifted from each other by half of the distance between the dots, then when there is no misalignment between the dot formation position in the forward pass and the dot formation position in the return pass, the dots of the return pass will be printed in the middle between the dots of the forward pass and thus the density will be increased, whereas when there is misalignment, there will be a variation in the distance between the dots, thereby lowering the density. Consequently, the amount of misalignment between the dot formation position in the forward pass and the dot formation position in the return pass will appear as a difference in density between the sub-patterns. That is, the density of the sub-patterns in case there is no misalignment will either have the highest peak or the lowest peak. Accordingly, the misalignment can be corrected based on sub-patterns that stand out in density. Furthermore, because two or more sub-patterns are used when correcting the misalignments, correction can be performed with higher precision than with the case where correction is performed based on only one sub-pattern.

In this printing apparatus, it is preferable that each sub-pattern is made of dots arranged in a main-scanning direction and a sub-scanning direction. Because each sub-pattern is made of dots arranged in the main-scanning direction and in the sub-scanning direction, it is possible to form a correction pattern with which visual confirmation is easy or with which the density can be detected easily.

In this printing apparatus, it is preferable that each of the sub-patterns has forward-pass dots that are formed with a predetermined spacing therebetween during the forward pass through which the head is moved and return-pass dots that are formed with a predetermined spacing therebetween during the return pass through which the head is moved, and an amount of misalignment between a position at which the forward-pass dots are formed and a position at which the return-pass dots are formed is different for each sub-pattern. According to such a printing apparatus, the amount of misalignment between the dot formation position in the forward pass and the dot formation position in the return pass is set to a correction amount that differs for each sub-pattern. Thus, an appropriate correction amount can be recognized using the correction pattern, with which the darkness can be easily confirmed visually or with which the density can be easily detected.

In this printing apparatus, it is preferable that a correction amount with respect to the misalignment is set to be an integer multiple of a distance that is obtained by evenly dividing an ideal dot pitch in a main-scanning direction, and a number of the sub-patterns included in the correction pattern is larger than a number by which the ideal dot pitch has been divided. According to such a printing apparatus, the product of the correction amount and the number by which the ideal dot pitch is divided becomes the ideal dot pitch, and because the number of sub-patterns is greater than the number for division, the correction pattern includes at least all of the sub-patterns in which every one of the settable correction amounts are taken as the misalignment amount between the dot formation positions in the forward pass and the dot formation positions in the return pass. Therefore, it becomes possible to include two or more sub-patterns having a peak among these sub-patterns. Thus, correction can be performed with high precision based on the two or more sub-patterns having peaks.

In this printing apparatus, it is preferable that the sub-patterns are arranged in order of correction amounts corresponding to each sub-pattern, and the printing apparatus is capable of selecting two of the sub-patterns based on a density distribution in the main-scanning direction of the correction pattern, and regarding a median between the correction values of the two selected sub-patterns as a correction value for correcting the misalignment. According to such a printing apparatus, in the correction pattern, the changes in darkness appear in a periodic manner in the main-scanning direction. In the case of selecting a correction amount based on the densities of the sub-patterns, even if an adjacent sub-pattern is selected by mistake, by selecting two sub-patterns based on the density distribution in the main-scanning direction of the correction pattern, in which the correction amounts are lined up such that they change sequentially in the main-scanning direction, and setting the median between the correction amounts of the selected sub-patterns as the correction amount for correcting the misalignment, it becomes possible to reduce by half the error caused by selecting a wrong sub-pattern.

In this printing apparatus, it is preferable that the two sub-patterns are a sub-pattern that stands out the most in the density distribution in the main-scanning direction of the correction pattern and a sub-pattern that is located away from this sub-pattern by the number by which the ideal dot pitch has been divided. The sub-pattern located away from the most conspicuous sub-pattern, which stands out most in the density distribution in the main-scanning direction, by the number by which the ideal dot pitch has been divided is a sub-pattern shifted by one period in the density distribution, because the amount of misalignment between the forward-pass dots and the return-pass dots is shifted, with respect to the most conspicuous sub-pattern, by the ideal dot pitch in the main-scanning direction. Thus, the two sub-patterns form peaks in the density, and by taking the median between the correction values of these sub-patterns as the correction value for correcting the misalignment, it becomes possible to perform a highly precise correction.

In this printing apparatus, in the correction pattern, a predetermined sub-pattern and a sub-pattern located away therefrom by the number by which the ideal dot pitch has been divided are regarded as a sub-pattern pair, and among the sub-pattern pairs, the sub-pattern pair that stands out the most in average density is regarded as the two sub-patterns. In the sub-pattern pair, the amount of misalignment between the dots formed during the forward pass and the dots formed during the return pass of one sub-pattern with respect to the other sub-pattern is shifted by the ideal dot pitch in the main-scanning direction; thus, the sub-patterns in the pair are shifted from one another by one period in the density distribution. Therefore, the sub-pattern pair that stands out the most in the average density among all sub-pattern pairs would stand out in density, and by taking the median between the correction amounts of these sub-patterns as the correction amount for correcting the misalignment, it becomes possible to carry out correction with high precision.

In this printing apparatus, it is preferable that, if there are a plurality of sub-pattern pairs that stand out the most in the average density, then each of the sub-patterns located in the middle of each of these sub-pattern pairs are regarded as the two sub-patterns.

In this printing apparatus, it is preferable that, if there are a plurality of sub-pattern pairs that stand out the most in the average density, then the sub-pattern pair that includes a sub-pattern having a density that stands out the most among the sub-patterns making up each of the sub-pattern pairs is regarded as the two sub-patterns. By setting the median between each correction amount of the sub-pattern pair including the sub-pattern having the most conspicuous density, among the sub-patterns making up the sub-pattern pairs that stand out most, as the correction value for correcting misalignment, it becomes possible to carry out correction with high precision.

In this printing apparatus, it is preferable that the density distribution of the correction pattern is a curved line interpolated based on the density of each sub-pattern. According to such a printing apparatus, it becomes possible to carry out correction using a more accurate correction amount because the density distribution is expressed as continuous data.

In this printing apparatus, it is preferable that, if two sub-patterns that stand out in the density distribution in the main-scanning direction of the correction pattern do not exist, then a correction amount of a sub-pattern that is located at an end in the main-scanning direction is changed and a new correction pattern in which the correction amounts have sequentially been changed in the main-scanning direction is printed. According to such a printing apparatus, it is possible to print at least two sub-patterns that stand out in the density distribution among the sub-patterns of the correction pattern.

In this printing apparatus, it is preferable that the correction amounts for printing the new correction pattern are changed according to a position of a sub-pattern that stands out in density with respect to a sub-pattern serving as a reference of the correction amount. The correction amounts for printing the new correction pattern are changed according to the position of the sub-pattern, which stands out in density, with respect to the sub-pattern serving as the reference correction amount. Thus, the new correction pattern can be made to include at least two sub-patterns that stand out in density distribution.

In this printing apparatus, it is preferable to further include a sensor for scanning the printed correction pattern in the main-scanning direction and reading a density of each sub-pattern; wherein the density of the printed correction pattern is read by the sensor, and the misalignment is corrected based on density information that has been read out. According to such a printing apparatus, misalignment in the position of dots in the main-scanning direction can be corrected without inconveniencing the user.

In this printing apparatus, it is preferable to further include selection means for selecting a sub-pattern that stands out in density based on the density information; wherein if two or more sub-patterns that stand out in density cannot be selected by the selection means, then a correction amount of a sub-pattern that is located at an end in the main-scanning direction is changed and a new correction pattern is printed. According to such a printing apparatus, misalignment in the position of dots in the main-scanning direction can be corrected without inconveniencing the user, even if the correction pattern does not have two or more sub-patterns that stand out in density.

It should be noted that in addition to such a printing apparatus, a storage medium having a program recorded thereon, a correction pattern, and a computer system are also described.

A printing apparatus comprises:

an ejection head for selectively ejecting ink droplets of a plurality of sizes to form dots on a printing medium;

wherein the printing, apparatus is capable of printing a correction pattern on the printing medium, the correction pattern enabling correction of a misalignment between a position at which dots are formed during a forward pass through which the head is moved and a position at which dots are formed during a return pass through which the head is moved, and a spacing in a sub-scanning direction between dots that make up the correction pattern printed by ejecting ink droplets of a certain size from the ejection head is different from a spacing in the sub-scanning direction between dots that make up the correction pattern printed by ejecting ink droplets of a different size from the ejection head.

If the size of the ink droplets that are ejected from the ejection head are different, the size of the dots that are formed on the printing medium are accordingly different, altering the darkness of the correction pattern. Consequently, there are occasions in which, even though a density of the correction pattern formed in accordance with ink droplets of a certain size is appropriate, a density of a correction pattern formed in accordance with ink droplets of another size is not preferable. According to the present invention, the spacing, in the sub-scanning direction, between dots forming the correction pattern printed by ejecting ink droplets of a certain size is different from the spacing, in the sub-scanning direction, between dots forming the correction pattern printed by ejecting ink droplets of another size. Thus, correction patterns of a darkness suiting the size of the ink droplets can be formed.

In this printing apparatus, it is preferable that the correction pattern has a plurality of sub-patterns, and each sub-pattern is made of dots arranged in a main-scanning direction and the sub-scanning direction. According to such a printing apparatus, the correction pattern has a plurality of sub-patterns and each sub-pattern is made of dots arranged in the main-scanning direction and in the sub-scanning direction. Therefore, it is possible to form a correction pattern that allows easy visual confirmation or with which the density can be detected easily.

In this printing apparatus, it is preferable that each sub-pattern has forward-pass dots that are formed with a predetermined spacing therebetween during the forward pass through which the head is moved and return-pass dots that are formed with a predetermined spacing therebetween during the return pass through which the head is moved, and an amount of misalignment between a position at which the forward-pass dots are formed and a position at which the return-pass dots are formed is different for each sub-pattern. According to such a printing apparatus, since each sub-pattern has forward-pass dots that are formed with a predetermined spacing therebetween during the forward pass through which the head is moved and return-pass dots that are formed with a predetermined spacing therebetween during the return pass through which the head is moved, and since an amount of misalignment between a position at which the forward-pass dots are formed and a position at which the return-pass dots are formed is different for each sub-pattern, a correction pattern with which the darkness can be easily confirmed visually or with which the density is easily detected can be formed.

In this printing apparatus, it is preferable that a spacing in a main-scanning direction between the dots forming the correction pattern is the same regardless of the size. When the spacing in the main-scanning direction between the dots forming the correction pattern is reduced in order to raise the density of the correction pattern formed by ejecting small-sized ink droplets, dots that are adjacent to one another in the main-scanning direction will fuse with one another, causing the problem of bleeding. With this printing apparatus, since the spacing in the main-scanning direction between the dots forming the correction pattern is the same regardless of the size of the dots, the occurrence of bleeding can be inhibited.

In this printing apparatus, it is preferable that the predetermined spacing is at least twice the spacing in the sub-scanning direction between the dots. When the dot spacing in the forward pass and the return pass of main scanning is reduced, dots that are adjacent to one another in the main-scanning direction will fuse with one another, causing the problem of bleeding. With this printing apparatus, since the predetermined spacing is at least twice the spacing in the sub-scanning direction between the dots, the occurrence of bleeding can be inhibited.

In this printing apparatus, it is preferable that the printing apparatus further includes a density detection member for detecting a density of the sub-patterns; wherein the misalignment between a position at which dots are formed during a forward pass through which the head is moved and a position at which dots are formed during a return pass through which the head is moved is corrected based on a result of the density detected by the density detection member. According to this printing apparatus, misalignments in the dot positions can be accurately corrected based on the correction pattern in which the density has been optimized to suit the dot size.

A printing apparatus comprises:

an ejection head for selectively ejecting ink droplets of a plurality of sizes to form dots on a printing medium;

wherein the printing apparatus is capable of printing a correction pattern on the printing medium, the correction pattern enabling correction of a misalignment between a position at which dots are formed during a forward pass through which the head is moved and a position at which dots are formed during a return pass through which the head is moved, a spacing in a sub-scanning direction between dots that make up the correction pattern printed by ejecting ink droplets of a certain size from the ejection head is different from a spacing in the sub-scanning direction between dots that make up the correction pattern printed by ejecting ink droplets of a different size from the ejection head, and the printing apparatus is capable of receiving command information from a user based on the correction pattern, and, based on the command information, correcting a misalignment between a position at which dots are formed during a forward pass through which the head is moved and a position at which dots are formed during a return pass through which the head is moved.

According to this printing apparatus, misalignments in dot positions can be accurately corrected using user command information based on the correction pattern, which can be visually confirmed easily.

It should be noted that in addition to such a printing apparatus, a correction pattern and computer systems are also described.

A printing apparatus comprises:

a carry roller for carrying a print sheet;

wherein the carry roller has virtual circumference segments that are obtained by virtually dividing a circumference of the carry roller into a plurality of segments in a direction in which the carry roller is rotated, and the printing apparatus is capable of printing a plurality of patterns for each of the virtual circumference segments, each of the patterns corresponding to a different correction amount, and setting a correction amount corresponding to one of the patterns to each virtual circumference segment.

According to this printing apparatus, patterns used for setting correction amounts for correcting the carry amount of each virtual circumference segment, which are obtained by virtually segmenting the circumference, can be printed for each virtual circumference segment, while associating the patterns with each of the correction amounts.

In this printing apparatus, it is preferable that the printing apparatus is capable of forming the pattern for determining a correction amount for a predetermined virtual circumference segment by printing a predetermined structural pattern before and after the print sheet is carried by that virtual circumference segment of the carry roller. According to such a printing apparatus, it is possible to ascertain the correction amount of a particular virtual circumference segment using predetermined structural patterns printed before and after the print sheet is carried.

In this printing apparatus, it is preferable that the patterns, which correspond to the correction amounts for each of the virtual circumference segments, are arranged in a row in a carry direction of the print sheet for each of the virtual circumference segments, and the pattern rows, which are arranged in rows, are printed on a single print sheet next to each other in a direction that is perpendicular to the carry direction. According to this printing apparatus, it becomes possible to print patterns corresponding to each correction amount for each virtual circumference segment on a single print sheet.

In this printing apparatus, it is preferable that the plurality of patterns for each of the virtual circumference segments corresponding to one correction amount are formed starting from a front end side of the print sheet in order of formation of the patterns. According to this printing apparatus, the patterns are formed in order from the front end of the print sheet, and thus, since it is not necessary to retract the print sheet, that has once been fed, for printing, printing can be carried out in a short period of time.

In this printing apparatus, it is preferable that the printing apparatus is capable of forming a pattern group by forming patterns for each of the virtual circumference segments corresponding to one correction amount, and changing the correction amount each time the carry roller makes a full turn and forming the pattern group made of patterns corresponding to the correction amount that has been changed. According to such a printing apparatus, since the correction amount is not changed as patterns are being formed in correspondence with the rotation of the carry roller, it becomes possible to perform printing efficiently.

In this printing apparatus, it is preferable that the printing apparatus further includes a print head for printing while performing scanning in a direction that is perpendicular to a carry direction of the print sheet; wherein as for two adjacent patterns that make up one of the pattern groups, a structural pattern printed before carrying in one pattern and a structural pattern printed after carrying in another pattern are printed during the same scan of the print head. According to this printing apparatus, two structural patterns are printed while the print head performs scanning once, and thus printing can be carried out efficiently.

In this printing apparatus, it is preferable that the print head has a plurality of nozzles that are arranged in the carry direction of the print sheet and that are capable of ejecting ink; the patterns are formed using some of the nozzles; and nozzles forming the structural pattern printed after the carrying by a particular virtual circumference segment are located more toward the front end of the print sheet than nozzles forming the structural pattern printed before the carrying. According to this printing apparatus, after the print sheet has been carried, printing can be carried out with respect to the position printed before carrying, without retracting the print sheet.

In this printing apparatus, it is preferable that a length of each pattern in the carry direction is shorter than a product of an amount the print sheet is carried and a number into which the carry roller is virtually divided. According to this printing apparatus, it becomes possible to prevent printing a new pattern over a pattern that has already been printed.

In this printing apparatus, it is preferable that the structural pattern is made of a plurality of lines spaced at an equal spacing in a carry direction of the print sheet, or dot rows arranged in a direction that is perpendicular to the carry direction, and a correction amount corresponding to the pattern in which the lines or the dot rows of the structural pattern that is printed after carrying are formed at a position that evenly divides a space between the lines or the dot rows of the structural pattern that is printed before carrying the print sheet is set. According to this printing apparatus, when the structural pattern printed after carrying is printed in the ideal print position, the density of the pattern that is formed appears dark; therefore, a suitable correction amount can be determined easily based on the darkness of the pattern that is formed.

In this printing apparatus, it is preferable that the structural pattern is made of a plurality of lines spaced at an equal spacing in a carry direction of the print sheet, or dot rows arranged in a direction that is perpendicular to the carry direction, and a correction amount corresponding to the pattern in which the lines or the dot rows of the structural pattern that is printed after carrying are formed at a position that overlaps the lines or the dot rows of the structural pattern that is printed before carrying the print sheet is set. According to this printing apparatus, when the structural pattern printed after carrying is printed in the ideal print position, the density of the pattern that is formed appears light; therefore, a suitable correction amount can be determined easily based on the darkness of the pattern that is formed.

It should be noted that in addition to a printing apparatus, a carry amount correction pattern, a program, a computer system, and a printing method are also described.

(1) First Embodiment

<(1) Overview of the Printing Apparatus>

Figure 2:
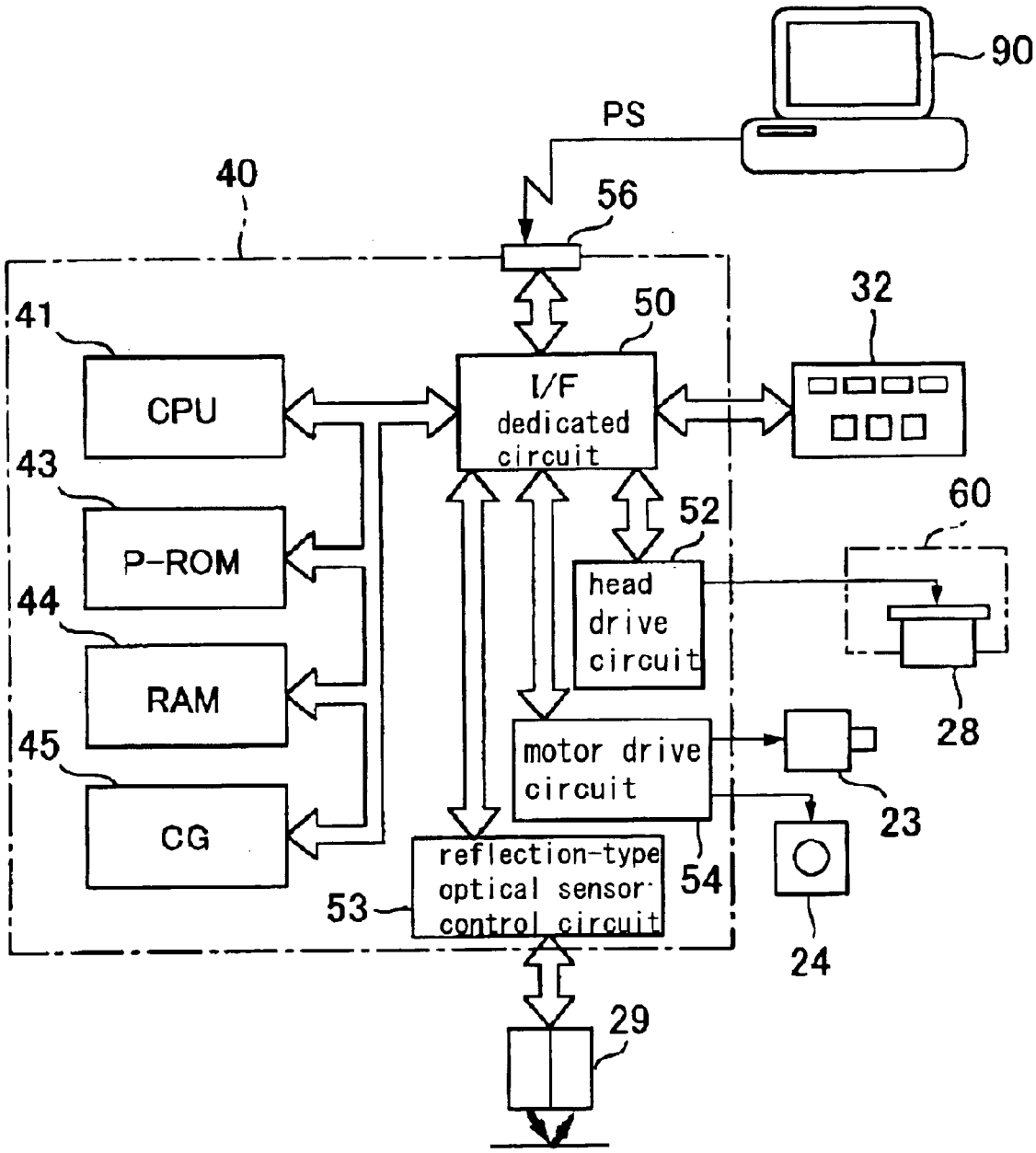
FIG. 2 is a block diagram showing the configuration of the printer 22, centering on a control circuit 40.

First, an overview of the printing apparatus is described with reference to FIGS. 1 and 2. FIG. 1 is a diagram schematically showing the configuration of a printing system provided with an inkjet printer 22. FIG. 2 is a block diagram showing the configuration of the printer 22, focusing on its control circuit 40.

The printer 22 has a sub-scanning mechanism for carrying a print paper P with a paper-feed motor 23, and a main-scanning mechanism for moving a cartridge 31 back and forth in the axial direction of a platen 26 using a carriage motor 24. Here, the direction in which the print paper P is carried by the sub-scanning mechanism is called the sub-scanning direction, and the direction in which the cartridge 31 is moved by the main-scanning mechanism is called the main-scanning direction. It should be noted that the carriage 31 is provided with a reflection-type optical sensor 29 that serves as means for reading the density of a correction pattern, which will be described later.

The printer 22 also comprises: a head drive mechanism for driving an ejection head unit 60 (also referred to as "ejection head assembly"), which is mounted on the cartridge 31, so as to control the ejection of ink and dot formation; and the control circuit 40 for managing the exchange of signals between the head drive mechanism and the paper-feed motor 23, the carriage motor 24, the ejection head unit 60, the reflection-type optical sensor 29, and an operation panel 32. The control circuit 40 is connected to a computer 90 via a connector 56. The computer 90 is provided with a driver for the printer 22, receives user commands through operation of, for example, a keyboard or a mouse serving as input means, and acts as a user interface that displays various types of information of the printer 22 to the user through a screen displayed on a display.

The sub-scanning mechanism for carrying the print paper P is provided with a gear train (illustration omitted) that transmits the rotation of the paper-feed motor 23 to the platen 26 and to a paper-carry roller (not shown). The main-scanning mechanism for moving the carriage 31 back and forth also comprises: a slide shaft 34 that is provided parallel to the axis of the platen 26 and that slidably supports the carriage 31; a pulley 38 that is provided with an endless drive belt 36 extended between itself and the carriage motor 24; and a position detection sensor 39 for detecting the position of origin of the carriage 31.

As shown in FIG. 2, the control circuit 40 is configured as an arithmetic and logic circuit provided with a CPU 41, a programmable ROM (PROM) 43, a RAM 44, and a character generator (CG) 45 storing the dot matrix of characters. The control circuit 40 further comprises: an I/F dedicated circuit 50 that acts as a dedicated interface with, for example, outside motors; a head drive circuit 52 that is connected to the I/F dedicated circuit 50 and that drives the ejection head unit 60 so that the unit ejects ink; a motor drive circuit 54 for driving the paper-feed motor 23 and the carriage motor 24; and a control circuit 53 for controlling the reflection-type optical sensor. The I/F dedicated circuit 50 comprises therein a parallel interface circuit and is capable of receiving print signals PS that are supplied from the computer 90 via the connector 56.

<(1) Example Configuration of the Reflection-Type Optical Sensor>

Figure 3:
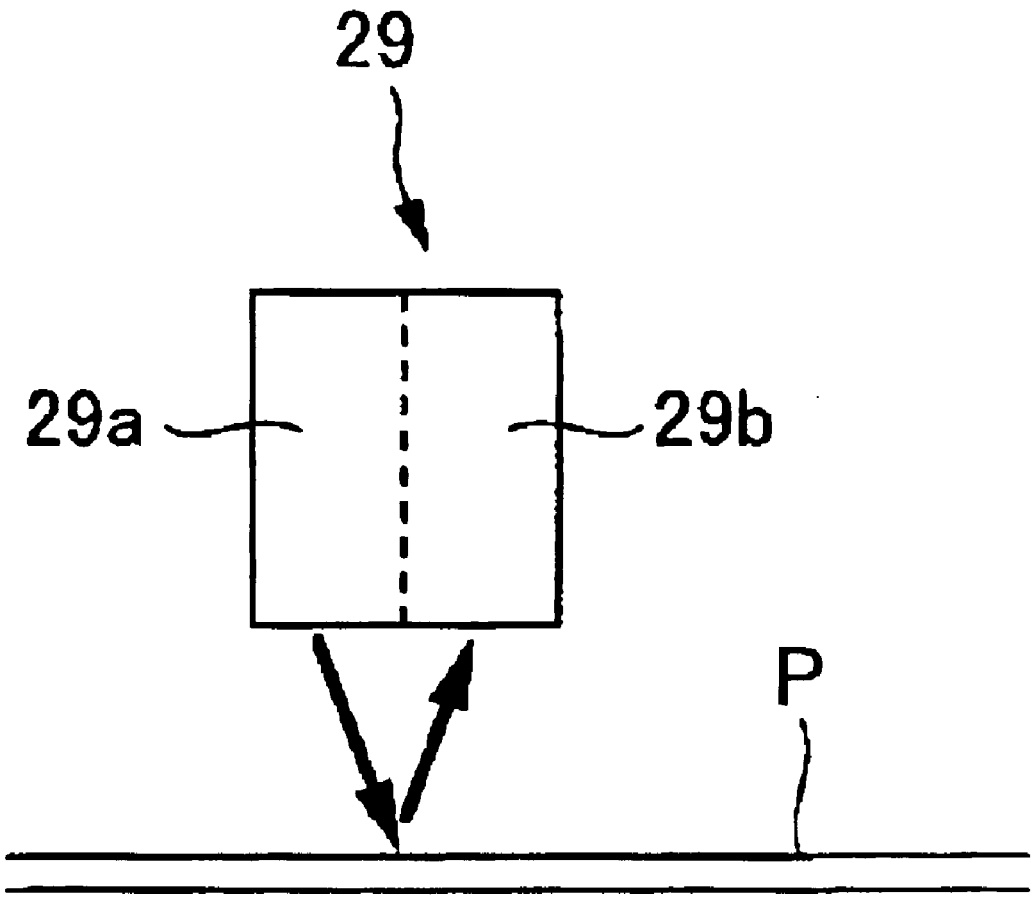
FIG. 3 is a schematic drawing for describing an example of a reflection-type optical sensor 29.

Next, an example of the configuration of the reflection-type optical sensor is described with reference to FIG. 3. FIG. 3 is a schematic drawing for describing an example of the reflection-type optical sensor 29.

The reflection-type optical sensor 29 is attached to the carriage 31, and has a light-emitting section 29*a* that is made of, for example, a light-emitting diode, and a light-receiving section 29*b* that is made of, for example, a phototransistor. The light that is emitted from the light-emitting section 29*a*, that is, the incident light, is reflected by the print paper P, and the reflected light is received by the light-receiving section 29*b* and converted into an electrical signal. The magnitude of the electrical signal is measured as the output value of the light-receiving sensor corresponding to the intensity of the reflected light received. Consequently, the reflection-type optical sensor 29 functions as a density detection member for detecting the density of the pattern that is printed on the print paper P.

It should be noted that in the above description, as shown in the drawing, the light-emitting section 29*a* and the light-receiving section 29*b* are configured in a single unit as a device that serves as the reflection-type optical sensor 29; however, they may each constitute a separate device, such as a light-emitting device and a light-receiving device.

Also, in the above description, in order to obtain the intensity of the reflected light that is received, the magnitude of the electric signals is measured after the reflected light is converted into electrical signals; however, this is not a limitation, and it is sufficient if it is possible to measure the output value of the light-receiving sensor corresponding to the intensity of the reflected light that is received.

<(1) Configuration of the Ejection Heads>

Figure 4:
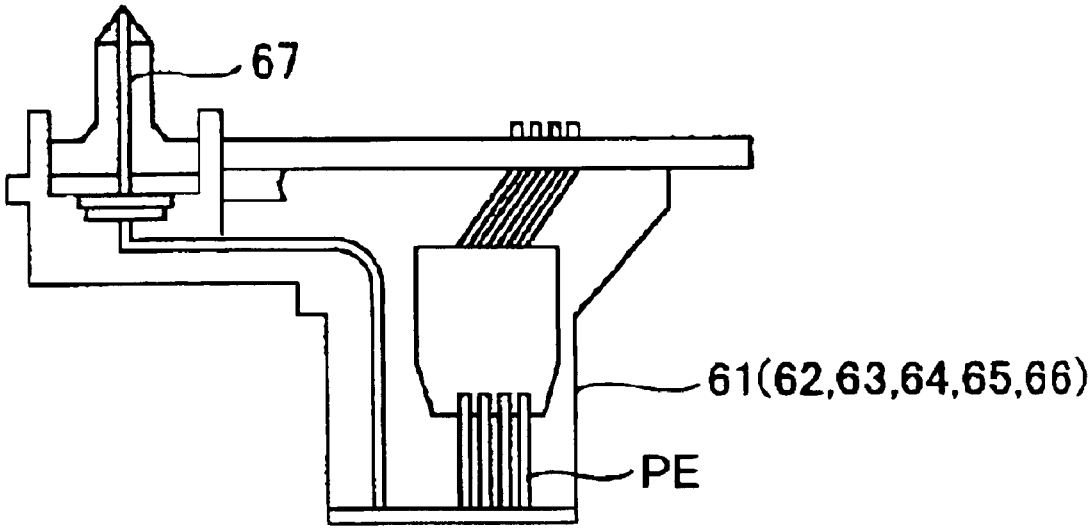
FIG. 4 is an explanatory diagram showing a schematic internal configuration of the ejection heads.
Figure 4:
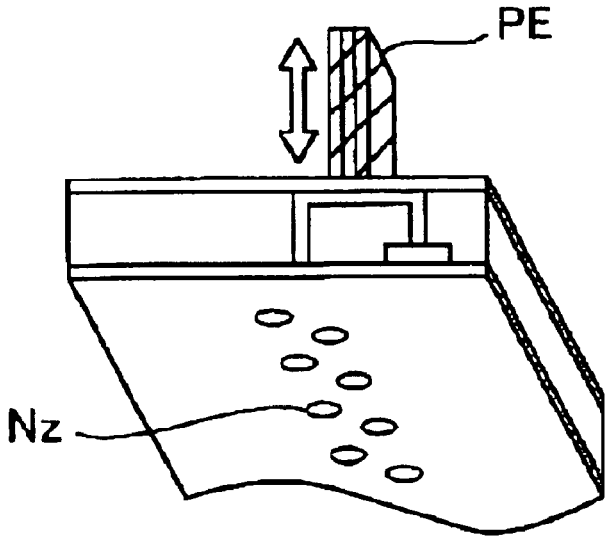
Figure 5:
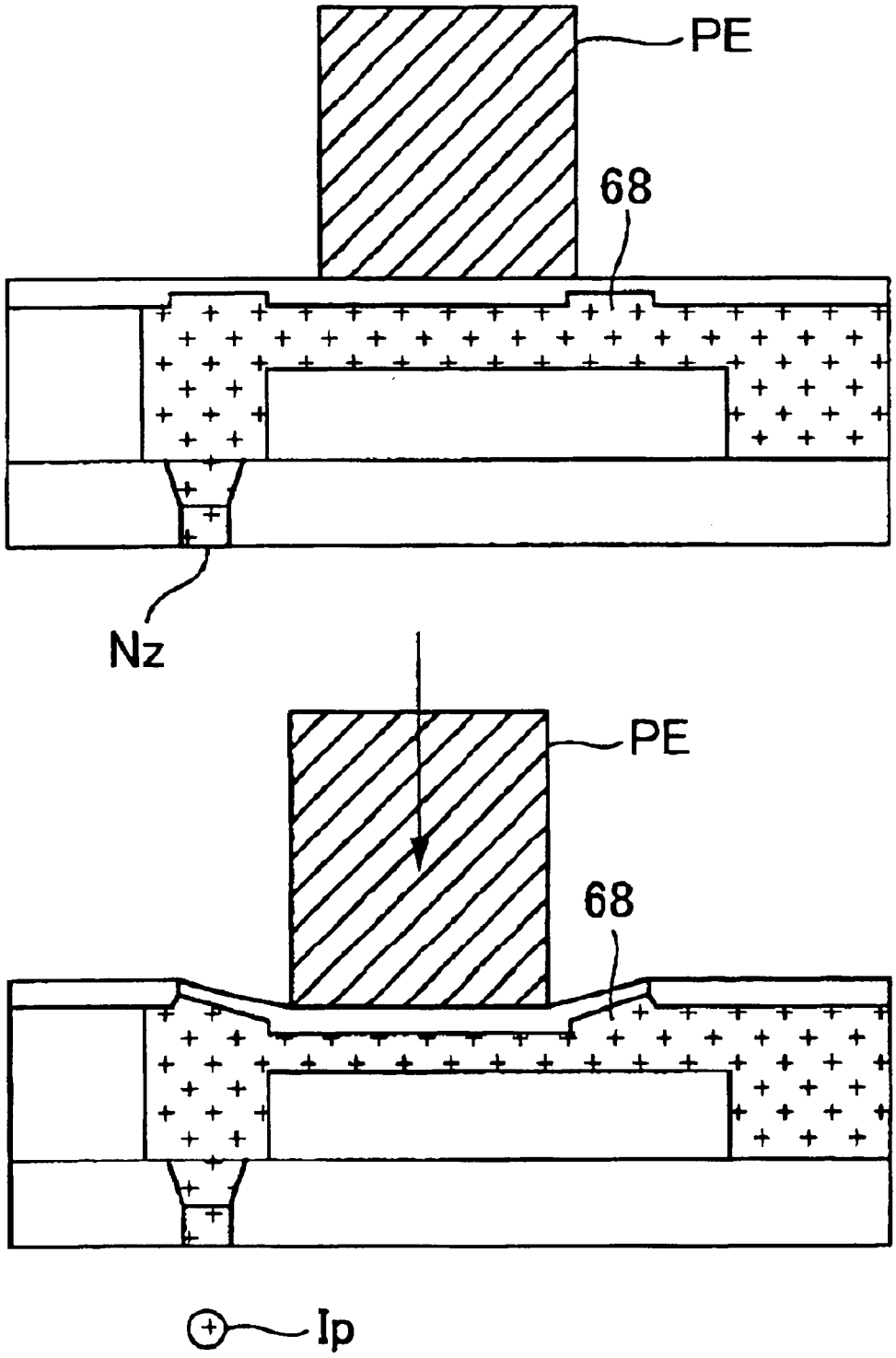
FIG. 5 is an explanatory diagram that shows in detail the structure of the piezo elements PE and the nozzles Nz.
Figure 6:
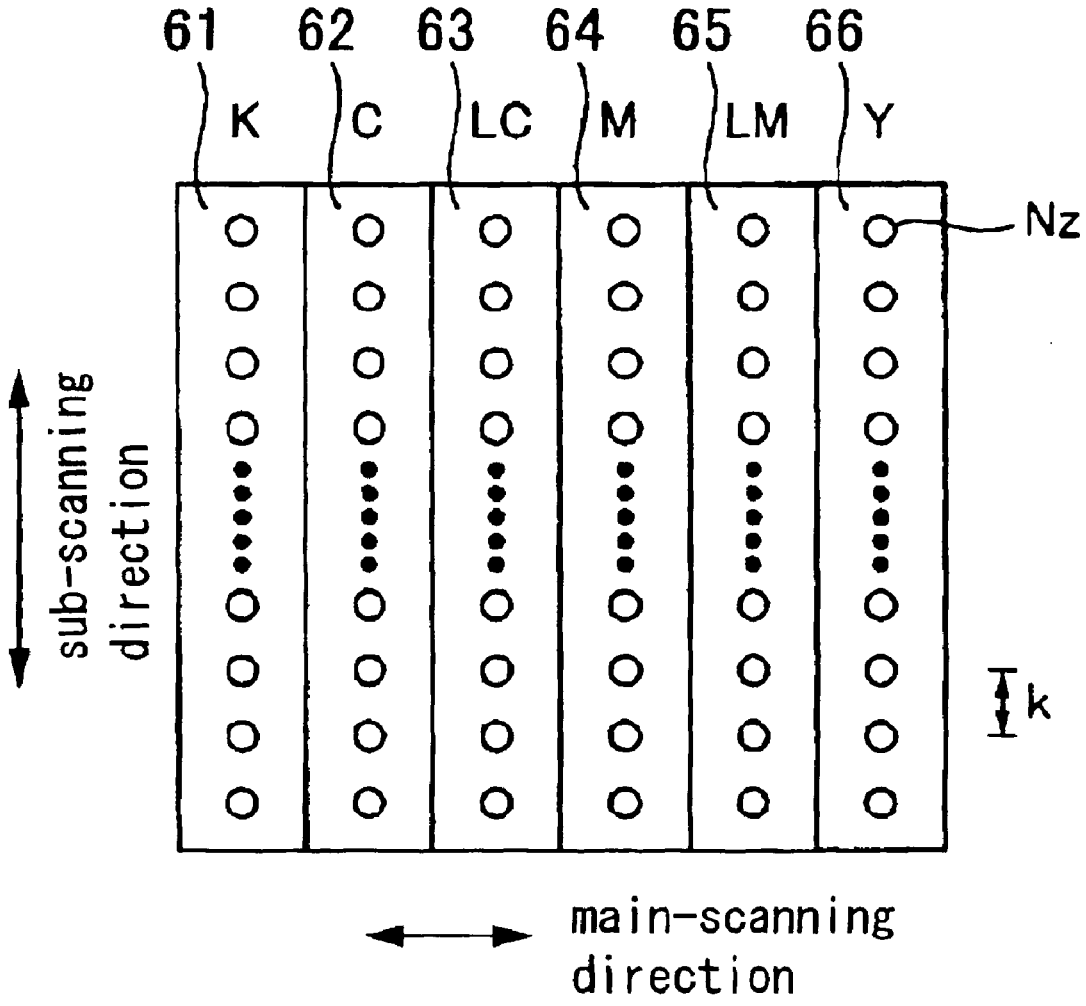
FIG. 6 is an explanatory diagram showing the arrangement of the inkjet nozzles Nz in ejection heads 61 to 66.

Next, the configuration of the ejection heads is described with reference to FIGS. 4, 5, and 6. FIG. 4 is an explanatory diagram that schematically shows the internal configuration of the ejection heads. FIG. 5 is an explanatory diagram that shows in detail the structure of the piezo elements PE and the nozzles Nz. FIG. 6 is an explanatory diagram that shows the arrangement of the inkjet nozzles Nz in the ejection heads 61 to 66.

A cartridge 71 for black ink (K) and a color ink cartridge 72 containing five colors of ink, which are cyan (C), light cyan (LC), magenta (M), light magenta (LM), and yellow (Y), can be fitted into the carriage 31 (FIG. 1).

A total of six ejection heads 61 to 66 are disposed in the lower portion the carriage 31, and in the bottom portion of the carriage 31 are provided introduction tubes 67 (see FIG. 4) for guiding ink from the ink tanks to the ejection heads for each color. When the cartridge 71 for black ink (K) and the color cartridge 72 are fitted into the carriage 31 from above, the introduction tubes 67 are inserted into connection apertures provided in each cartridge, allowing ink to be supplied from each ink cartridge to the ejection heads 61 to 66.

When the ink cartridges 71 and 72 are fitted into the carriage 31, then, as shown in FIG. 4, the ink inside the ink cartridges is sucked out via the introduction tubes 67 and guided to the ejection heads 61 to 66 provided in the lower portion of the carriage 31.

In the ejection heads 61 to 66 for each color, which are provided in the lower portion of the cartridge 31, are disposed piezo elements PE, which are a kind of electrostrictive element with excellent responsiveness, for each nozzle.

Also, as shown in the top half of FIG. 5, the piezo elements PE are disposed in positions that contact an ink passage 68 for guiding ink to the nozzles Nz. As is well known in the art, when voltage is applied to the piezo elements PE, their crystalline structure is deformed and they convert the electrical energy into mechanical energy very quickly. In this embodiment, by applying a voltage of a predetermined duration between the electrodes that are provided on both side of the piezo elements PE, the piezo elements PE expand only for the amount of time that voltage is applied as shown in the bottom half of FIG. 5, altering the shape of one side of the ink passage 68.

As a result, the volume of the ink passages 68 is reduced in correspondence with the expansion of the piezo elements PE, and an amount of ink that corresponds to this reduction is quickly ejected from the tip of the nozzles Nz as ink droplets Ip. Printing is carried out by the formation of dots as the ink droplets Ip soak into the paper P that is mounted on the platen 26.

As shown in FIG. 6, the inkjet nozzles Nz in the ejection heads 61 to 66 are arranged in six nozzle row groups that eject ink for each color: black (K), cyan (C), light cyan (LC), magenta (M), light magenta (LM), and yellow (Y). The 48 nozzles Nz in the nozzle rows are arranged in a row at a constant nozzle pitch k.

With the printer 22 having the physical configuration described above, the paper P is carried by the paper-feed motor 23 while the carriage 31 is moved back and forth by the carriage motor 24, and at the same time, the piezo elements PE of the ejection heads 61 to 66 are driven so as to eject the various colors of ink, forming dots and creating a multicolor image on the paper P.

It should be noted that here the printer 22 that is used is provided with heads for ejecting ink using the piezo elements PE in the manner mentioned above; however, it is also possible to use a variety of elements other than piezo elements as the ejection drive elements. For example, the present invention can also be applied to a printer provided with ejection drive elements with which ink is ejected due to foams (bubbles) generated within the ink passages by passing a current through heaters disposed on the ink passages. Also, the control circuit 40 may have any configuration, as long as it supplies drive signals to each ejection drive element and generates drive signals so that the temporal ejection order of the ink droplets is kept constant over the forward pass and the return pass in main scanning.

<(1) Driving the Ejection Heads>

Figure 7:
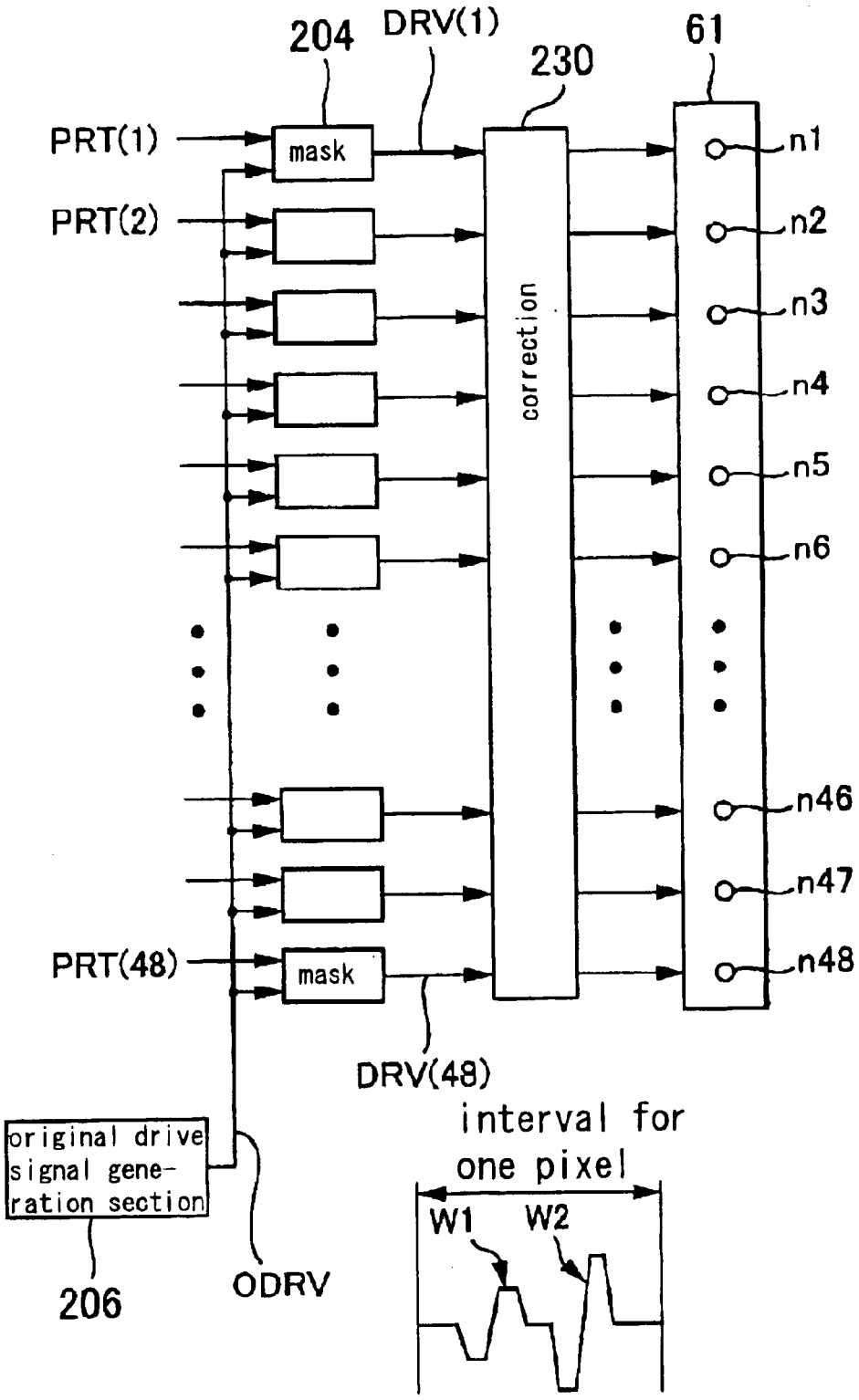
FIG. 7 is a block diagram showing the configuration of the drive signal generating section provided in a head drive circuit 52 (FIG. 2).

Next, the driving of the ejection heads 61 to 66 is described with reference to FIG. 7. FIG. 7 is a block diagram showing the configuration of a drive signal generation section provided inside the head drive circuit 52 (FIG. 2).

In FIG. 7, the drive signal generation section is provided with a plurality of mask circuits 204, an original drive signal generation section 206, and a drive signal correction section 230. The mask circuits 204 are provided corresponding to the plurality of piezo elements for respectively driving the nozzles n1 to n48 of the ejection head 61. It should be noted that in FIG. 7 the bracketed numbers following each signal name indicate the number of the nozzle to which that signal is supplied. The original drive signal generation section 206 generates an original drive signal ODRV common to the nozzles n1 to n48. The original drive signal ODRV is a signal that includes two pulses, a first pulse W1 and a second pulse W2, during the main-scanning period for one pixel. The drive signal correction section 230 carries out a correction by shifting, either forward or backward for the entire return pass, the timing of the drive signal waveforms shaped by the mask circuits 204. By correcting, the timing of the drive signal waveforms, misalignments in the positions where the ink droplets land during the forward pass and during the return pass are corrected. That is, the misalignment in the positions where dots are formed in the forward pass and the return pass is corrected.

<(1) Overview of Correction Pattern Used to Correct Dot Formation Position Misalignment>

Figure 8A:
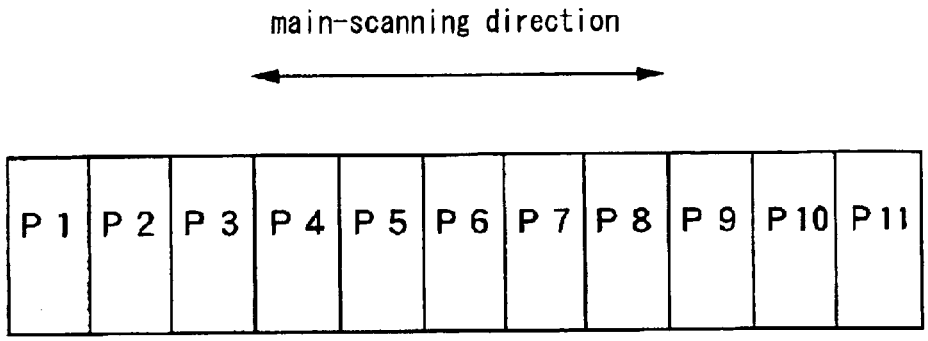
FIGS. 8A and 8B are diagrams schematically illustrating an example of a correction pattern and the method for determining the correction value for misalignment adjustment based on the correction pattern.
Figure 8B:
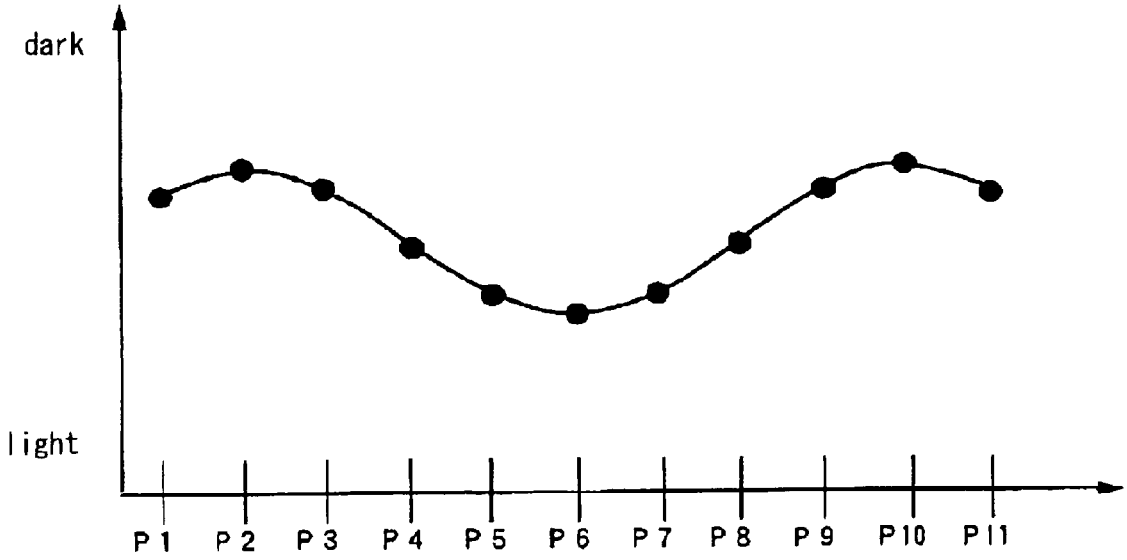

Next, an overview of the correction of misalignment in the dot formation position in the main-scanning direction is described with reference to FIGS. 8A and 8B. FIGS. 8A and 8B are diagrams for describing the gist of the method for determining the correction values for misalignment adjustment based on the correction pattern.

The method described hereinafter for correcting dot formation position misalignments is a method for intentionally shifting the timing at which ink droplets are ejected in the return pass, for the entire return pass, so that misalignments in the positions where dots are formed during the forward pass and the return pass do not stand out. It should be noted that it is also possible to intentionally shift the ejection timing of ink droplets in the forward pass for the entire forward pass, and it is also possible for the ejection timing for ink droplets in the forward pass and the return pass to be intentionally shifted over both the entire forward pass and return pass, respectively. Some causes of misalignments in the positions where dots are formed in the main-scanning direction in the forward pass and the return pass include variations in the speed at which the ink is ejected, backlash of the drive mechanism in the main-scanning direction, and warping of the platen supporting the print paper from below.

As shown in FIG. 8A, the correction pattern has eleven sub-patterns P1 to P11, for example. Each sub-pattern P1 to P11 is printed by moving the ejection head 28 back and forth in the main-scanning direction, and during which time, forming dots on the print paper P with a specified row of nozzles (for example, the nozzles of the ejection head 61).

In the forward pass, ink droplets are ejected onto the print paper P at a constant spacing (=1/180 inch). On the other hand, in the return pass, the ink droplets are similarly ejected at a constant spacing (=1/180 inch); however, for each sub-pattern P1 to P11, the ejection timing is changed, and the sub-patterns are printed side by side to each other in the main-scanning direction in order of the amount of change for each sub-pattern. At this time, the amount of change in the ejection timing is set so that the amount of misalignment between the dots formed during the forward pass and the dots formed during the return pass is changed by a unit correction amount that has tentatively been set for selecting the correction amount. Here, the sub-patterns P1 to P11 are formed by shifting the ejection timing of the return pass so that an amount obtained by dividing an ideal dot pitch in the main-scanning direction (=1/180 inch) by, for example, eight, that is, the amount (1/180 inch)÷8=1/1440 inch is taken as the unit correction amount, and the dots are shifted by this amount.

For example, as for the sub-pattern P1 and the sub-pattern P2, assuming that ΔP1 is the misalignment between the ejection timing of the forward pass and the ejection timing of the return pass in the sub-pattern P1, and ΔP2 is the misalignment between the ejection timing of the forward pass and the ejection timing of the return pass in the sub-pattern P2, then $|\Delta P1-\Delta P2|=1/1440$ inch. Also, because 1/180 inch is equal to 8/1440 inch, when ΔP9 is assumed to be the misalignment between the ejection timing of the forward pass and the ejection timing of the return pass in the sub-pattern P9, which is eight sub-patterns away from the sub-pattern P1, then $|\Delta P1|=|\Delta P9|$.

Here, the reason why the number of sub-patterns making up the correction pattern was set to eleven is so that the correction pattern includes at least two sub-patterns having peaks in density. For example, because the unit correction amount is set to 1/8 of the ideal dot pitch in the main-scanning direction, if the dots formed during the forward pass and the dots formed during the return pass that form the first sub-pattern overlap one another, then, when the unit correction amount is multiplied by integers and sequentially increased for every sub-pattern, a sub-pattern in which the dots formed during the forward pass and the dots formed during the return pass overlap is once again printed at the eighth sub-pattern counting from the first sub-pattern. That is, a correction pattern in which a difference in darkness periodically appears every eighth pattern is printed. Thus, it is necessary that the number of sub-patterns is set larger than the division number by which the ideal dot pitch in the main-scanning direction is equally divided.

In the sub-patterns P1 to P11 formed in this way, the closer the overlap between the dots formed on the print paper P in the forward pass and the dots formed on the print paper P in the return pass, the lighter the sub-pattern, and the smaller the overlap between the dots formed on the print paper P in the forward pass and the dots formed on the print paper P in the return pass, the darker the sub-pattern. In FIG. 8B, the density of each sub-pattern is shown by a • mark, and the figure shows a curved line interpolated from the data of the • marks. In the correction pattern shown in FIG. 8A, the sub-pattern P6, the sub-pattern P2, and the sub-pattern P10 have peaks in density, where the shade is lightest at sub-pattern P6 and darkest at sub-pattern P2 and at sub-pattern P10. In FIG. 8B, the peaks of the • marks and the peaks of the curved line match one another, and by interpolation based on the data of the • marks, discrete data can be interpreted as continuous data, and the precision can be increased even further.

<(1) Method of Selecting the Correction Amount Using the Correction Pattern>

In this embodiment, the density of each sub-pattern shown in FIG. 8A is read by the reflection-type optical sensor 29 and converted into an electrical signal, and based on the electrical signal serving as density information, two sub-patterns having peaks in density are selected by the control circuit 40, which serves as sub-pattern selection means. The actual printing of the return pass is carried out at the ejection timing in the return pass at which the sub-pattern located in the middle between the two sub-patterns that are selected is printed.

That is, taking the sub-pattern located at the end of the plurality of sub-patterns arranged side by side in the main-scanning direction as the standard, the positions of sub-patterns having peaks in density are determined with respect to the standard by counting from the standard. The sub-pattern located in the middle between the detected sub-patterns is specified, and the ejection timing in the return pass at which the specified sub-pattern was printed is stored as the correction value, and by intentionally shifting the ejection timing of the ink droplets for the entire return pass by the amount of the correction value, the position at which the dots are formed is corrected. At this time, if the middle between the two sub-patterns comes upon a boundary of sub-patterns, then the median between the ejection timings of the two sub-patterns that form the boundary is taken as the correction value. The median of the ejection timings of the two detected sub-patterns may also serve as the correction value.

It should be noted that there is also a method of selecting the lightest sub-pattern using a sensor or by visual confirmation by the user and then adopting the conditions under which that sub-pattern was formed as the optimal value; however, for the sake of precision, it is more preferable that, as mentioned above, two sub-patterns having peaks with a highest density are selected and the median between the ejection timings in the return pass at which these two sub-patterns were printed is taken as the optimal value. The reason for this is described below.

In the case of a method of selecting the lightest sub-pattern using a sensor or by visual confirmation by the user and then adopting, as the optimal value, the conditions under which that sub-pattern was formed, if an adjacent sub-pattern is selected by mistake, the ejection timing on the return pass is shifted 1/1440 inch from the optimal value.

By contrast, although there are instances in which a neighboring sub-pattern is selected by mistake also with the method in which the two sub-patterns having peaks with a high density are selected and the formation conditions of the sub-pattern located in the middle between these two sub-patterns is taken as the optimal value, the median of the ejection timings in the return pass of the two sub-patterns will be the optimal value even if the sub-pattern P1 adjacent to P2 and the sub-pattern P11 adjacent to P10 are selected by mistake, or even if the sub-pattern P3 adjacent to P2 and the sub-pattern P9 adjacent to P10 are selected by mistake. Here, an example was shown in which sub-patterns having peaks with the high density are selected; however, it is also possible to select two sub-patterns having peaks where the density is low, if the ideal positions at which the dots are to be formed in the return pass with respect to the forward pass are set shifted by half the ideal dot pitch.

Also, even if the sub-pattern P2 is correctly selected but the sub-pattern P11 is mistakenly selected for the other sub-pattern, or if the sub-pattern P10 is correctly selected but the sub-pattern P1 is mistakenly selected for the other sub-pattern, the median between the return-pass ejection timings of the two sub-patterns is shifted from the optimal value by only half of 1/1440 inch.

It should be noted that in this correction method, it is not necessary to carry out printing using all nozzles in the nozzle row. That is, in this correction method, it is only necessary to distinguish the shade of each sub-pattern, and thus, as long as those conditions are met, it is also possible to carry out printing of the sub-patterns with some of the nozzles of the nozzle row. For example, the sub-patterns can be formed by ejecting ink droplets only with the nozzles at the ends or in the center portion of the nozzle row. By doing this, the ink that is required for printing the correction pattern can be conserved.

As a method for selecting two or more sub-patterns having peaks in the density from the plurality of sub-patterns of the correction pattern, an example was shown in the above description in which two sub-patterns with peaks on the high density side in the density distribution were selected; however, there is no limitation to this, and the following methods may also be employed.

For example, it is also possible to select a sub-pattern that stands out the most in density distribution in the main-scanning direction of the correction pattern, that is, the sub-pattern having the highest or lowest density, and to select the sub-pattern that is selected and a sub-pattern that is located eight sub-patterns (number of the divisor by which the ideal dot pitch in the main-scanning direction is divided evenly) away from the selected sub-pattern.

Also, it is possible to: regard, in the correction pattern, a predetermined sub-pattern and a sub-pattern located eight sub-patterns away as a sub-pattern pair; make a plurality of sub-pattern pairs by sequentially change one of the sub-patterns in the order from the sub-pattern at the end of the correction pattern; and then select, among the sub-pattern pairs, the sub-pattern pair that stands out the most in average density. At this time, if there are a plurality of sub-pattern pairs that stand out the most in average density, it is possible to select each sub-pattern that is located in the middle of each of those sub-pattern pairs, and carry out the actual printing of the return pass at the ejection timing in the return pass at which the sub-pattern, which is located in the middle between the two sub-pattern pairs, is printed. It is also possible to carry out the actual printing of the return pass at the ejection timing in the return pass at which the sub-pattern, which is located in the middle of the sub-pattern pair including the sub-pattern that stands out the most in density among the sub-patterns making up the sub-pattern pairs, is printed.

Furthermore, if an attempt to select the two or more sub-patterns having peaks in density from the plurality of sub-patterns of the correction pattern was made but was unsuccessful because two sub-patterns forming peaks did not exist, then the correction amount of sub-pattern located at the end in the main-scanning direction and serving as the standard of the correction amount is changed, a new correction pattern is printed, and then two or more sub-patterns having peaks in density are selected from the new correction pattern. At this time, the correction amount of the sub-pattern that serves as the standard correction amount is altered in correspondence with the position of the sub-pattern, forming the peak, with respect to the sub-pattern serving as the correction amount standard, and a new correction pattern is printed. For example, by ascertaining the number indicating how many sub-patterns away from the standard the darkest sub-pattern is located, changing the correction amount of the sub-pattern that serves as the standard to the correction amount of that sub-pattern, and then performing printing, a correction pattern having two sub-patterns that constitute peaks in the density can be printed.

<(1) Process for Correcting the Dot Formation Positions>

Figure 9:
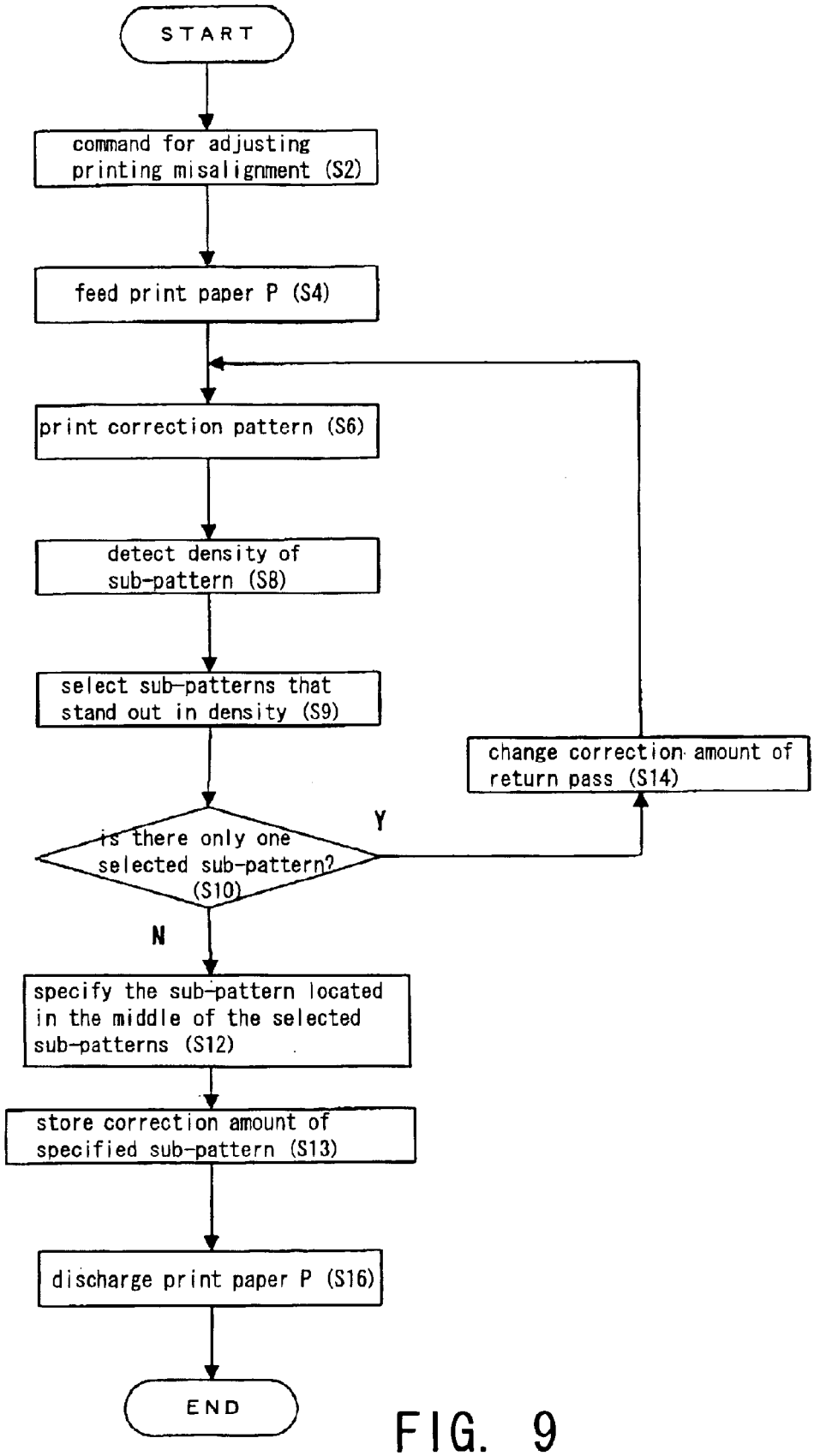
FIG. 9 is a flowchart for describing the process for correcting the dot formation positions using a reflection-type optical sensor 29.
Figure 10:
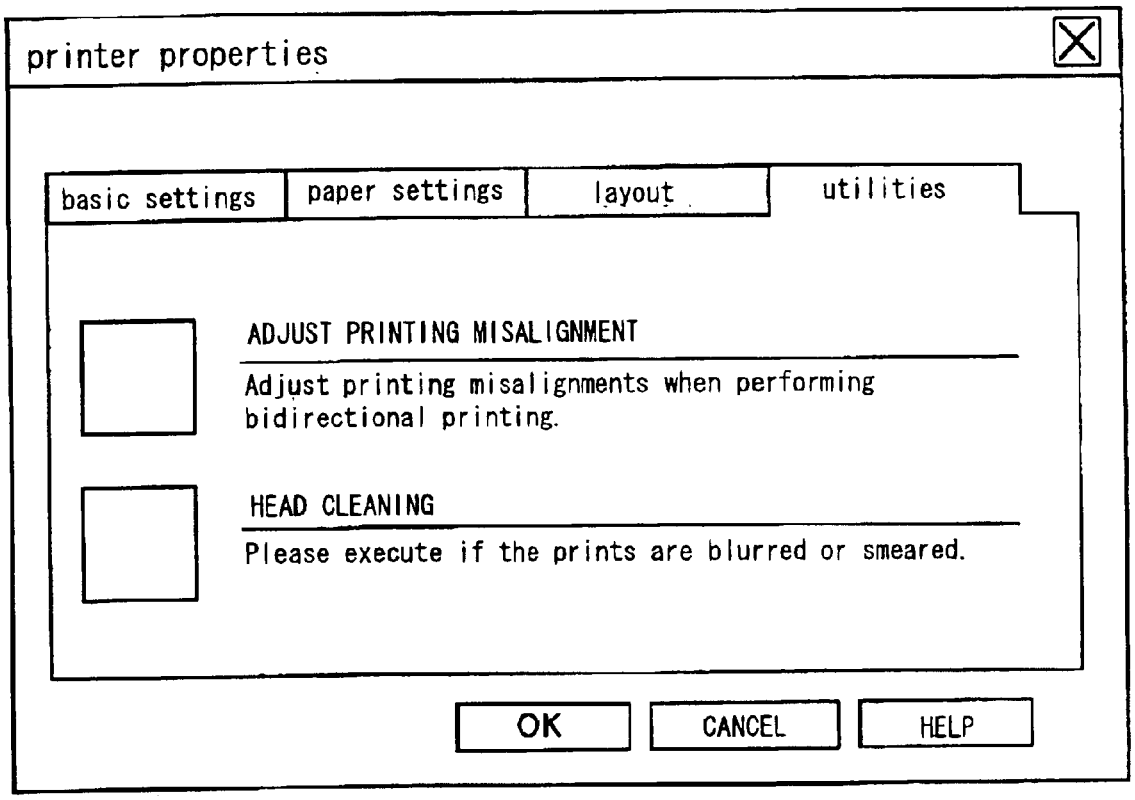
FIG. 10 is a diagram that schematically shows an example of the UI window through which a user designates printing misalignment adjustment.

Next, the process for correcting the positions at which the dots are formed is described with reference to FIGS. 9 and 10. FIG. 9 is a flowchart for describing the process for correcting dot formation positions. FIG. 10 is a diagram that schematically shows an example of a UI window through which a user makes a command to adjust printing misalignment.

First, when, for example, a deterioration in image quality in bidirectional printing is noticed by the user, the user first gives, through a UI window such as that shown in FIG. 10, a command to adjust printing misalignment in order to adjust misalignments in the position where dots are formed in the forward and return passes in the main-scanning direction (step S2). The screen for making this adjustment command is located under utilities, for example, in the properties of the printer, and the user clicks the button corresponding to adjust printing misalignment (square button displayed in upper left of diagram) with a mouse, for example, so as to start the printing misalignment adjustment.

The command from the user to adjust the printing misalignments is transmitted to the printer 22 as a command. Based on the command received, the printer 22 makes the paper-feed motor 23 drive using the motor drive circuit 54, for example, so as to supply the print paper P (step S4).

Next, the printer 22 makes the carriage motor 24 and the paper-feed motor 23 drive using the head drive circuit 52 and the motor drive circuit 54, for example, so as to print the correction pattern.

First, ink droplets are ejected from the ejection head 61 so as to print the correction pattern shown in FIG. 8, that is, the sub-patterns P1 to P11 (step S6).

Next, light is emitted from the light-emitting section 29*a* of the reflection-type optical sensor 29 to each sub-pattern P1 to P11, the reflected light that is reflected is received by the light-receiving section 29*b*, and the darkness of each sub-pattern P1 to P11 is detected based on the output value of the light-receiving section 29*b* corresponding to the intensity of the reflected light that is received (step S8). The data on the detected darkness are interpolated, and the two sub-patterns constituting peak values in darkness are selected from the density distribution shown in FIG. 8B (step S9).

Next, the control circuit 40 determines whether or not there are two sub-patterns having peak values in darkness among the sub-patterns P1 to P11 (step S10).

If there are two sub-patterns having peak values in darkness among the sub-patterns P1 to P11, then the sub-pattern that is located in the middle between these two sub-patterns is specified (step S12), and the return-pass ejection timing at which the specified sub-pattern was printed is stored as the correction value (step S13).

If there is only one sub-pattern having a peak value in darkness among the sub-patterns P1 to P11, then the ink ejection timing in the return pass is suitably altered as a whole so that there are two sub-patterns having a peak value in density (step S14), and a new correction pattern is printed (S6). In this case, by ascertaining the number indicating how many sub-patterns away from the end of the correction pattern the sub-pattern, which has the peak value detected by the reflection-type optical sensor 29, is located, and then changing the correction amount of the sub-pattern that is located at the end of the correction pattern so that the sub-pattern that is printed using the correction amount of the sub-pattern having the peak value and the sub-pattern that is located eight sub-patterns away from this sub-pattern are included in the correction pattern, printing of the correction pattern will not be repeated later on, allowing the unnecessary use of ink to be prevented.

Finally, the printer 22 drives the paper-feed motor 23 with the motor drive circuit 54, for example, and discharges the print paper P (step S16).

It should be noted that in the above-mentioned correction process, in step S8, light is emitted from the light-emitting section 29*a* of the reflection-type optical sensor 29 to each sub-pattern P1 to P11, the reflected light that is reflected is received by the light-receiving section 29*b*, and the darkness of each sub-pattern P1 to P11 is detected based on the output value of the light-receiving section 29*b* corresponding to the intensity of the reflected light that is received; however, it is also possible for the user to detect the density of each sub-pattern by visually confirming it himself.

Figure 11:
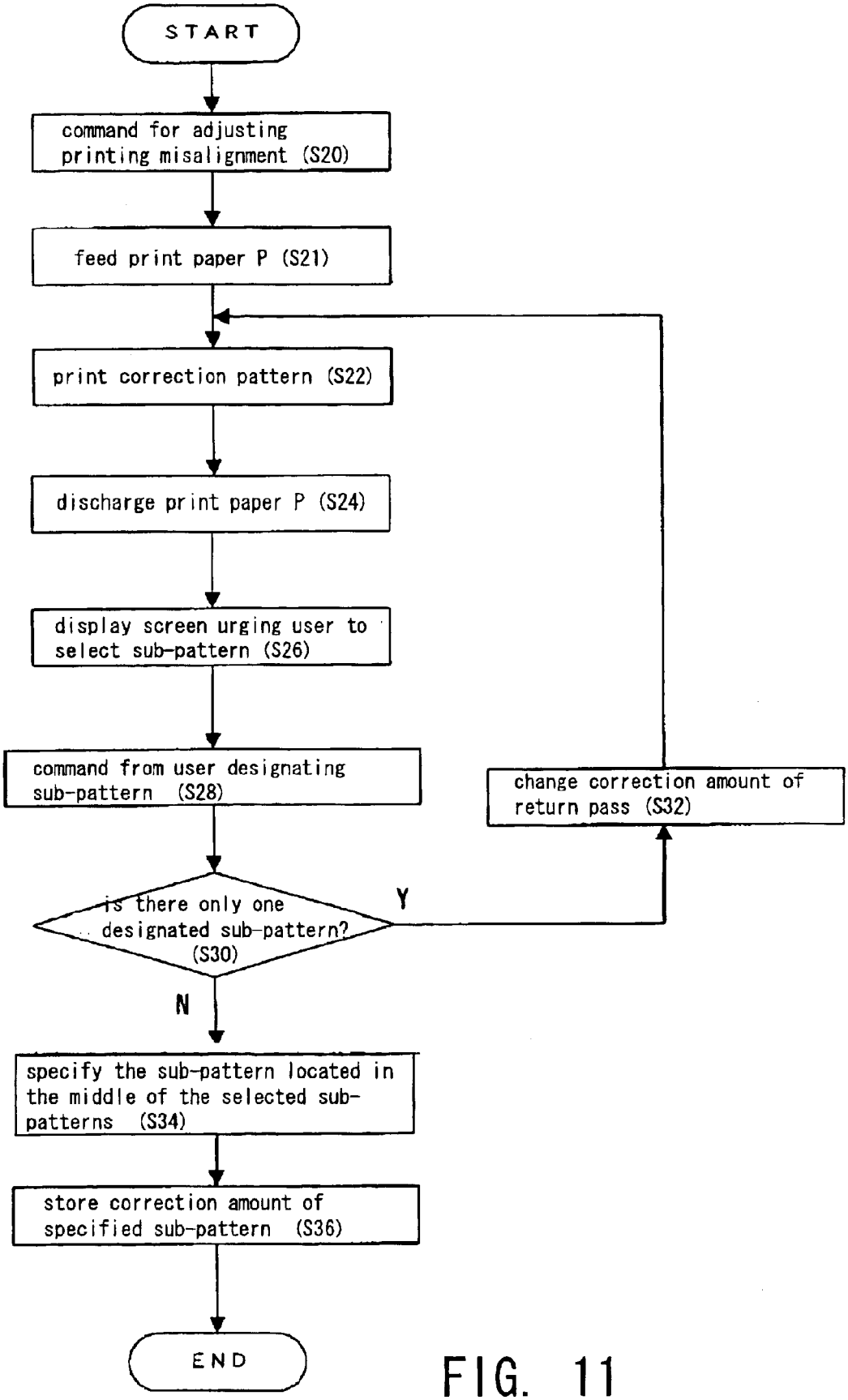
FIG. 11 is a flowchart for describing a process for correcting dot formation positions in which determining the density is responsibility of the user, who does so by visual confirmation.

FIG. 11 shows a flowchart of a correction process in which the user determines the density of the sub-patterns. In the following description, explanation of aspects that overlap with the above-mentioned correction process using the reflection-type optical sensor 29 has been omitted.

Figure 12:
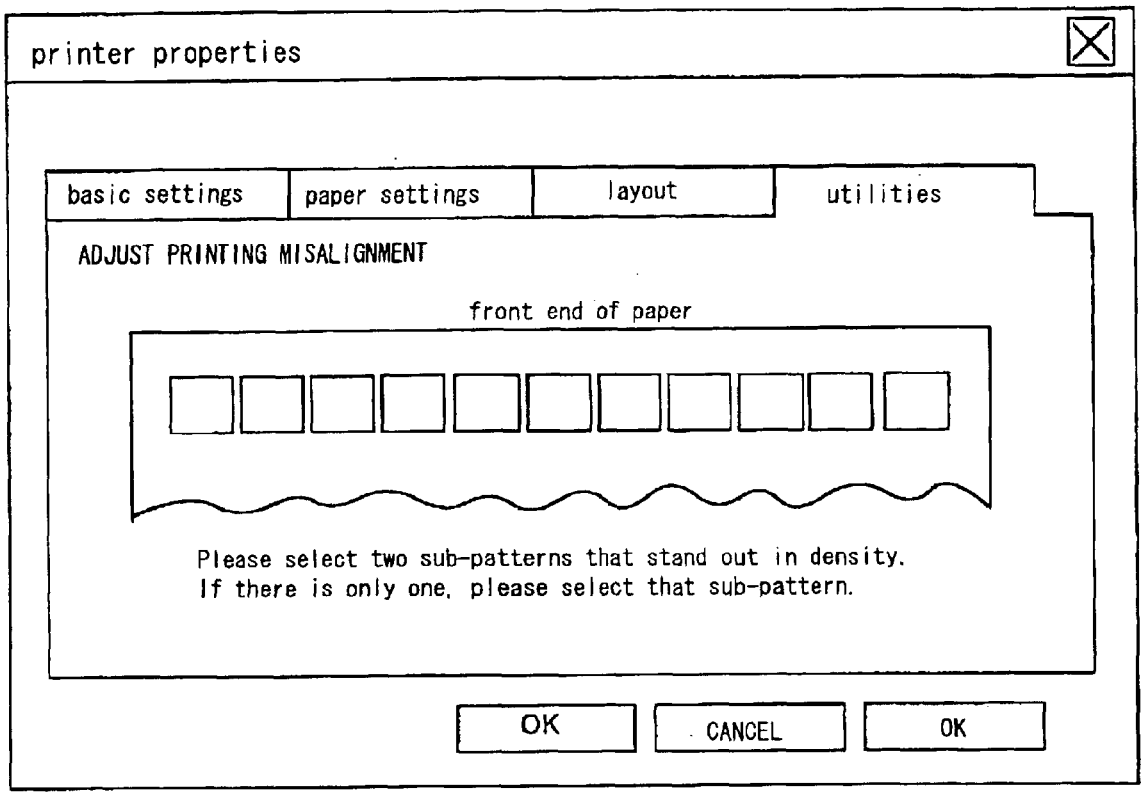
FIG. 12 is a diagram that schematically shows an example of the UI window for the user to designate the sub-pattern.

As shown in FIG. 11, the printer 22 prints the correction pattern and discharges the paper (steps S20 to S24). At this time, the UI window on the display of the computer 90 serving as the user interface displays a screen such as that shown in FIG. 12, which includes an image of the correction pattern and a message urging the user to select two sub-patterns having peaks in density from the correction pattern that has been printed (step S26). The user visually confirms the sub-patterns P1 to P11 of the correction pattern that has been printed, selects two sub-patterns having peaks in darkness, and clicks on the images of those sub-patterns on the UI window (step S28). The printer 22 receives the command designating the sub-patterns clicked by the user, and determines whether there is only one sub-pattern designed by that designation command (step S30). If two sub-patterns have been designated, then the sub-pattern located in the middle between these sub-patterns is specified (step S34). The ejection timing in the return pass at which the specified sub-pattern was printed is stored as the correction value (step S36).

The screen that is displayed to the user also includes a message urging him to select a sub-pattern if there is only one sub-pattern having a peak in density. If the user selects only one image of the sub-pattern, then, as in the above-mentioned case in which the reflection-type optical sensor 29 was used, the ink ejection timing in the return pass is appropriately changed for the entire pass (step S32) and a new correction pattern is printed (step S22).

<(1) Other Considerations>

In the foregoing, a printing apparatus, for example, of a first aspect of the invention was described according to an embodiment thereof; however, the foregoing embodiment is for the purpose of facilitating understanding of the present invention and is not for the purpose of limiting the present invention. The invention can of course be altered and improved without departing from the gist thereof and includes functional equivalents.

Print paper was described as an example of the printing medium; however, it is also possible to use film, cloth, or sheet metal, for example, as the printing medium.

It is also possible to achieve a computer system having: a computer main unit; the printer according to the first embodiment connected to the computer main unit; and if necessary, an input device such as a mouse or a keyboard, a display device such as a CRT, a flexible disk drive device, and a CD-ROM drive device. A computer system achieved in this manner is superior to conventional systems as an overall system.

The printer according to the foregoing first embodiment can also be given some of the functions or mechanisms of a computer main unit, a display device, an input device, a flexible disk drive device, and a CD-ROM drive device. For example, the printer can be configured so as to have an image processing section for carrying out image processing, a display section for carrying out various types of displays, and a storage medium inserting/detaching section to/from which a storage medium storing image data captured by a digital camera or the like can be inserted and taken out.

A color inkjet printer was described in the first embodiment; however, the invention can also be applied to monochrome inkjet printers. The invention can also be applied to printers other than inkjet-type printers. The invention is generally applicable to printing apparatuses for printing to a printing medium, and, for example, can be also applied to facsimile apparatuses and copy machines. However, in so-called inkjet-type printing apparatuses, in which printing is carried out by ejecting ink from a print head, a particularly high image quality is demanded in the printed product, and thus an even larger benefit is obtained from the above-mentioned means.

Also, in the foregoing, printing misalignments were adjusted as requested by the user; however, they may also be adjusted automatically without a command from the user. Further, the above-mentioned adjustment and testing may be performed before the printing apparatus enters into the hands of the user, such as upon shipping.

All nozzles for each color can be corrected in accordance with a single correction value for each dot size, or the correction value for each dot size can independently be set for each nozzle group for which the ink droplet ejection timing can be independently corrected. It is also possible to independently set the correction values for each group of nozzle rows ejecting the same ink. For example, if there are two groups of nozzle rows that eject a particular ink, then the same correction value can be adopted for the nozzles of those two groups.

In the foregoing embodiment, position misalignments were corrected by adjusting the ejection timing of the return pass; however, it is also possible to correct position misalignments by adjusting the ejection timing of the forward pass. Also, it is possible to correct position misalignments by adjusting the ejection timing of both the forward pass and the return pass. That is, position misalignments may be corrected by adjusting the ejection timing of at least either one of the forward pass or the return pass.

In the foregoing embodiment, some of the configuration that is achieved by hardware may be replaced with software, and alternatively, some of the configuration that is achieved by software may be replaced with hardware.

According to the first embodiment, it is possible to achieve a printing apparatus with which the position where ink droplets land in the main-scanning direction in the forward pass and in the return pass in bidirectional printing can be precisely corrected, a correction pattern for use in correction, a computer program for achieving a function for making the printing apparatus print the correction pattern, and a computer system having the printing apparatus.

(2) Second Embodiment

<(2) Overview of the Printing Apparatus>

Figure 13:
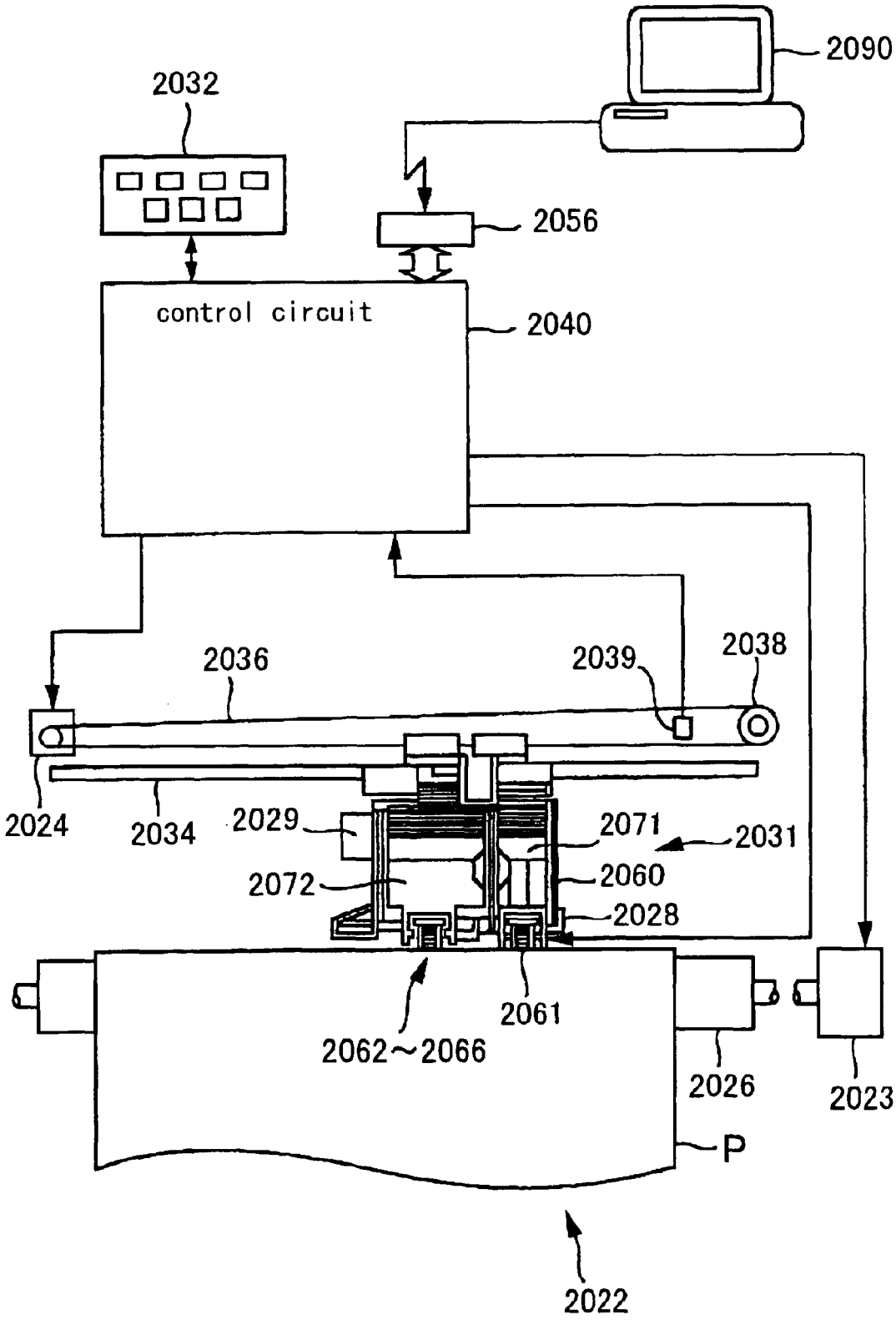
FIG. 13 is a diagram that schematically shows the configuration of a printing system provided with a inkjet printer 2022.
Figure 14:
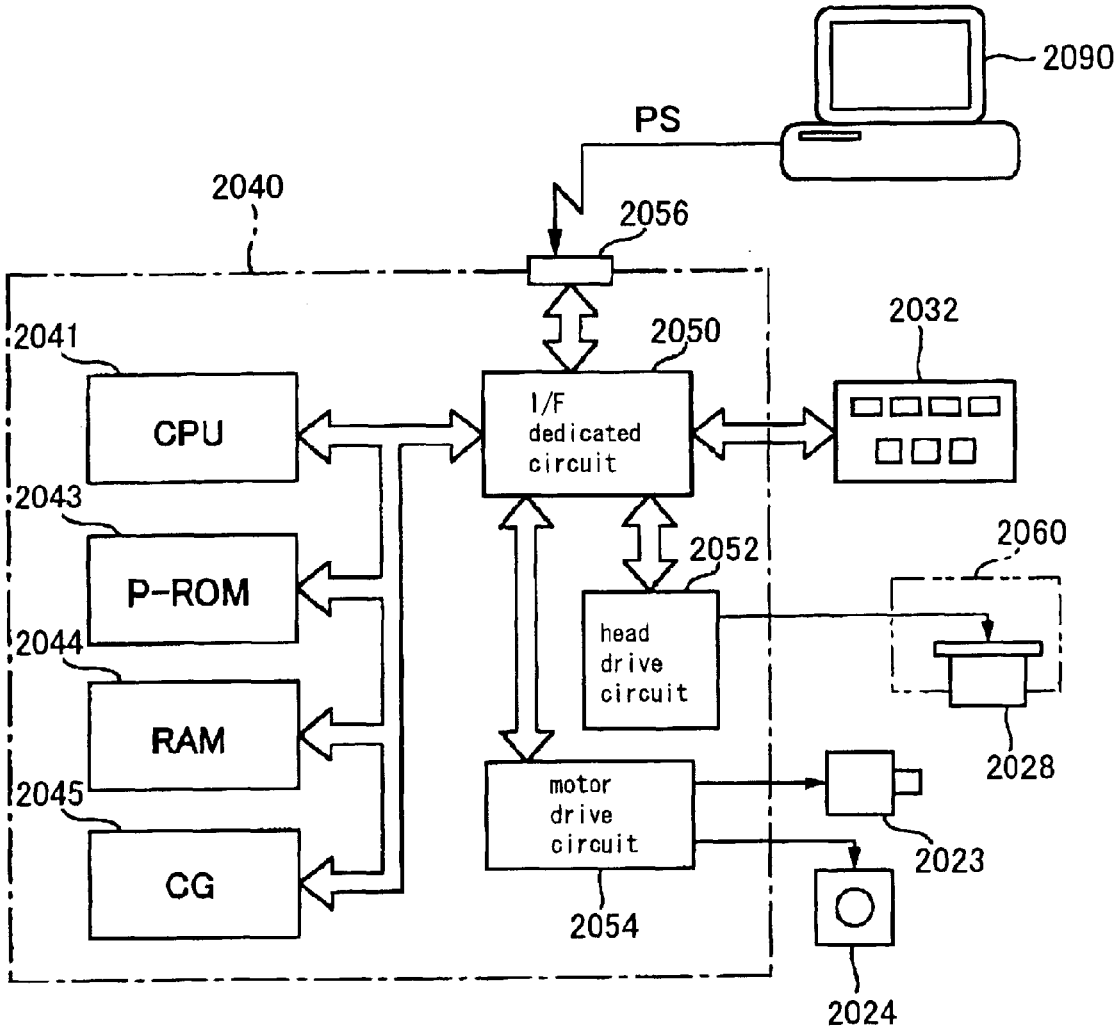
FIG. 14 is a block diagram showing the configuration of the printer 2022, centering on a control circuit 2040.

First, an overview of the printing apparatus is described with reference to FIGS. 13 and 14. FIG. 13 is a diagram schematically showing the configuration of a printing system provided with an inkjet printer 2022. FIG. 14 is a block diagram showing the configuration of the printer 2022, focusing on its control circuit 2040.

The printer 2022 has a sub-scanning mechanism for carrying a print paper P with a paper-feed motor 2023, and a main-scanning mechanism for moving a cartridge 2031 back and forth in the axial direction of a platen 2026 using a carriage motor 2024. Here, the direction in which the print paper P is carried by the sub-scanning mechanism is called the sub-scanning direction, and the direction in which the cartridge 2031 is moved by the main-scanning mechanism is called the main-scanning direction. It should be noted that the carriage 2031 is provided with a reflection-type optical sensor 2029, which will be described later.

The printer 2022 also comprises: a head drive mechanism for driving an ejection head unit 2060 (also referred to as "ejection head assembly"), which is mounted on the cartridge 2031, so as to control the ejection of ink and dot formation; and the control circuit 2040 for managing the exchange of signals between the head drive mechanism and the paper-feed motor 2023, the carriage motor 2024, the ejection head unit 2060, and an operation panel 2032. The control circuit 2040 is connected to a computer 2090 via a connector 2056.

The sub-scanning mechanism for carrying the print paper P is provided with a gear train (illustration omitted) that transmits the rotation of the paper-feed motor 2023 to the platen 2026 and to a paper-carry roller (not shown). The main-scanning mechanism for moving the carriage 2031 back and forth also comprises: a slide shaft 2034 that is provided parallel to the axis of the platen 2026 and that slidably supports the carriage 2031; a pulley 2038 that is provided with an endless drive belt 2036 extended between itself and the carriage motor 2024; and a position detection sensor 2039 for detecting the position of origin of the carriage 2031.

As shown in FIG. 14, the control circuit 2040 is configured as an arithmetic and logic circuit provided with a CPU 2041, a programmable ROM(PROM) 2043, a RAM 2044, and a character generator (CG) 2045 storing the dot matrix of characters. The control circuit 2040 further comprises: an I/F dedicated circuit 2050 that acts as a dedicated interface with, for example, outside motors; a head drive circuit 2052 that is connected to the I/F dedicated circuit 2050 and that drives the ejection head unit 2060 so that the unit ejects ink; and a motor drive circuit 2054 for driving the paper-feed motor 2023 and the carriage motor 2024. The I/F dedicated circuit 2050 comprises therein a parallel interface circuit and is capable of receiving print signals PS that are supplied from the computer 2090 via the connector 2056.

<(2) Example Configuration of the Reflection-Type Optical Sensor>

Figure 15:
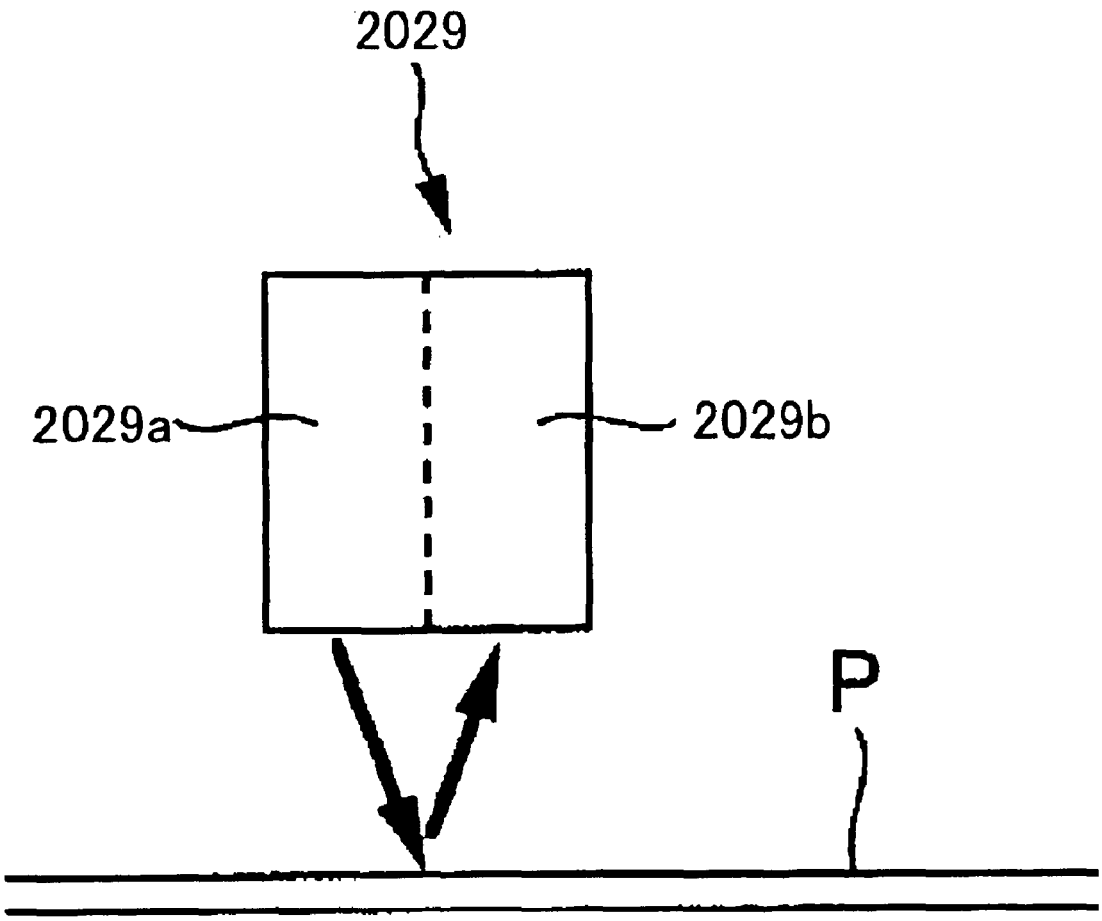
FIG. 15 is a schematic drawing for describing an example of a reflection-type optical sensor 2029.

Next, an example of the configuration of the reflection-type optical sensor is described with reference to FIG. 15. FIG. 15 is a schematic drawing for describing an example of the reflection-type optical sensor 2029.

The reflection-type optical sensor 2029 is attached to the carriage 2031, and has a light-emitting section 2029*a* that is made of, for example, a light-emitting diode, and a light-receiving section 2029*b* that is made of, for example, a phototransistor. The light that is emitted from the light-emitting section 2029*a*, that is, the incident light, is reflected by the print paper P, and the reflected light is received by the light-receiving section 2029*b* and converted into an electrical signal. The magnitude of the electrical signal is measured as the output value of the light-receiving sensor corresponding to the intensity of the reflected light that is received. Consequently, the reflection-type optical sensor 2029 functions as a density detection member for detecting the density of the pattern that is printed on the print paper P.

It should be noted that in the above description, as shown in the drawing, the light-emitting section 2029*a* and the light-receiving section 2029*b* are configured in a single unit as a device that serves as the reflection-type optical sensor 2029; however, they may each constitute a separate device, such as a light-emitting device and a light-receiving device.

Also, in the above description, in order to obtain the intensity of the reflected light that is received, the magnitude of the electric signals is measured after the reflected light is converted into electrical signals; however, this is not a limitation, and it is sufficient if it is possible to measure the output value of the light-receiving sensor corresponding to the intensity of the reflected light that is received.

<(2) Configuration of the Ejection Heads>

Figure 16:
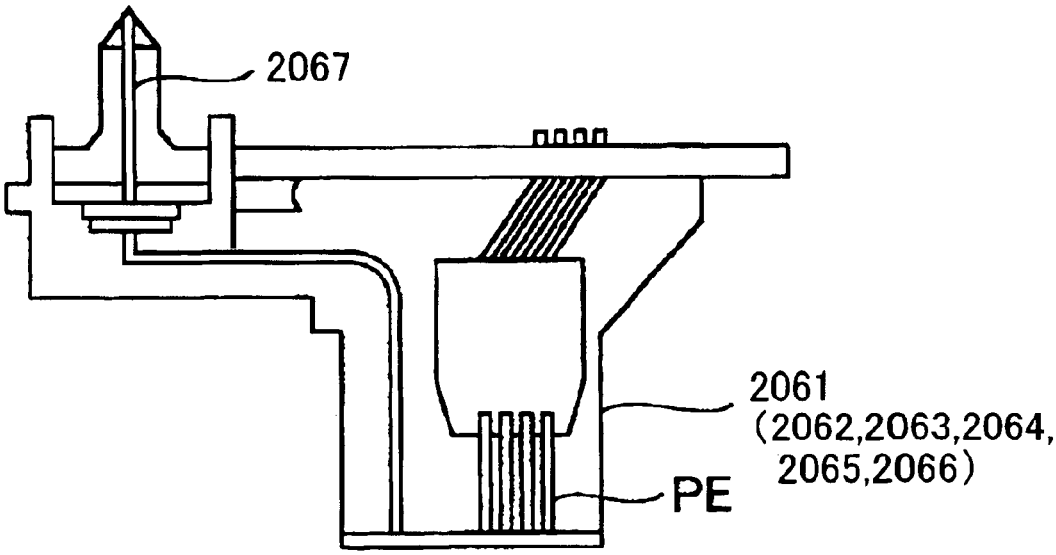
FIG. 16 is a diagram that schematically shows the internal configuration of the ejection heads.
Figure 16:
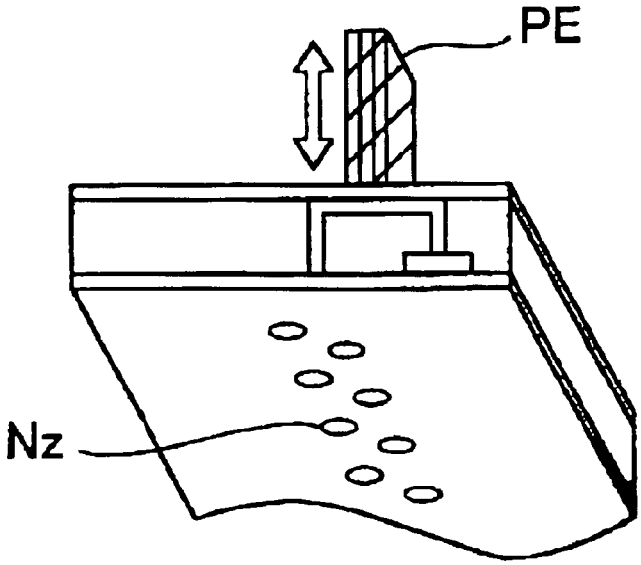
Figure 17:
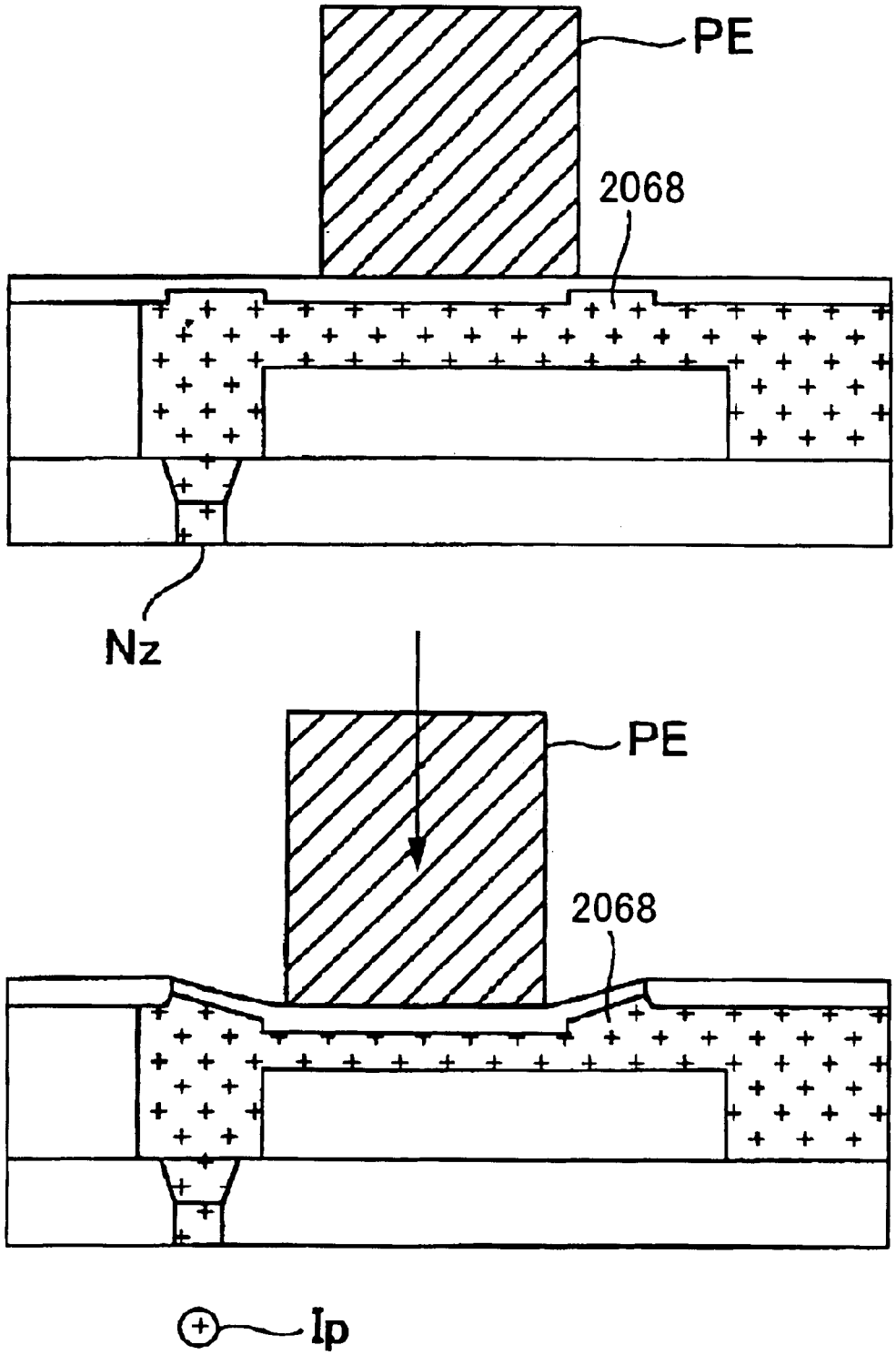
FIG. 17 is an explanatory diagram that shows in detail the structure of the piezo elements PE and the nozzles Nz.
Figure 18:
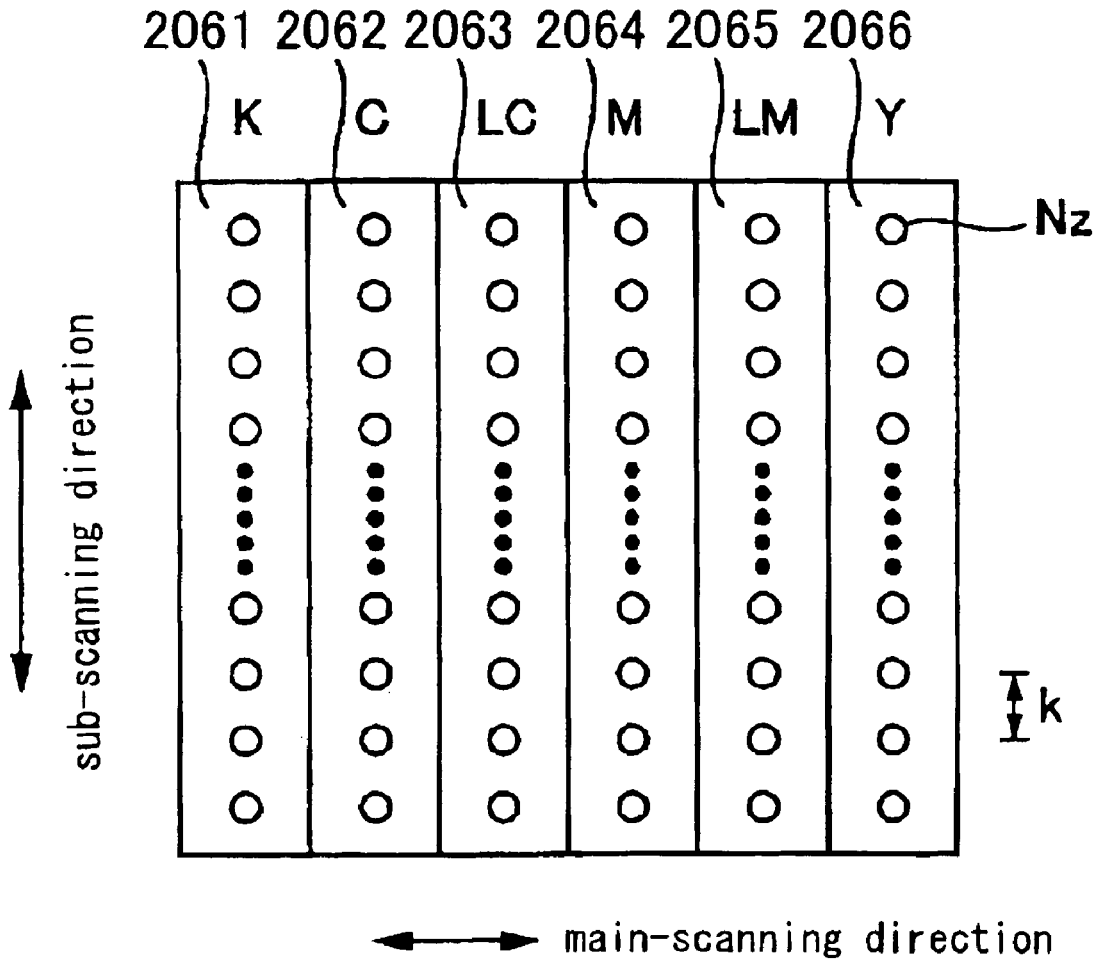
FIG. 18 is an explanatory diagram showing the arrangement of the inkjet nozzles Nz in ejection heads 2061 to 2066.

Next, the configuration of the ejection heads is described with reference to FIGS. 16, 17, and 18. FIG. 16 is an explanatory diagram that schematically shows the internal configuration of the ejection heads. FIG. 17 is an explanatory diagram that shows in detail the structure of the piezo elements PE and the nozzles Nz. FIG. 18 is an explanatory diagram that shows the arrangement of the inkjet nozzles Nz in the ejection heads 2061 to 2066.

A cartridge 2071 for black ink (K) and a color ink cartridge 2072 containing five colors of ink, which are cyan (C), light cyan (LC), magenta (M), light magenta (LM), and yellow (Y), can be fitted into the carriage 2031 (FIG. 13).

A total of six ejection heads 2061 to 2066 are disposed in the lower portion the carriage 2031, and in the bottom portion of the carriage 2031 are provided introduction tubes 2067 (see FIG. 16) for guiding ink from the ink tanks to the ejection heads for each color. When the cartridge 2071 for black ink (K) and the color cartridge 2072 are fitted into the carriage 2031 from above, the introduction tubes 2067 are inserted into connection apertures provided in each cartridge, allowing ink to be supplied from each ink cartridge to the ejection heads 2061 to 2066.

When the ink cartridges 2071 and 2072 are fitted into the carriage 2031, then, as shown in FIG. 4, the ink inside the ink cartridges is sucked out via the introduction tubes 2067 and guided to the ejection heads 2061 to 2066 provided in the lower portion of the carriage 2031.

In the ejection heads 2061 to 2066 for each color, which are provided in the lower portion of the cartridge 2031, are disposed piezo elements PE, which are a kind of electrostrictive element with excellent responsiveness, for each nozzle. Also, as shown in the top half of FIG. 17, the piezo elements PE are disposed in positions that contact an ink passage 2068 for guiding ink to the nozzles Nz. As is well known in the art, when voltage is applied to the piezo elements PE, their crystalline structure is deformed and they convert the electrical energy into mechanical energy very quickly. In this embodiment, by applying a voltage of a predetermined duration between the electrodes that are provided on both sides of the piezo elements PE, the piezo elements PE expand only for the amount of time that voltage is applied as shown in the bottom half of FIG. 17, altering the shape of one side of the ink passage 2068. As a result, the volume of the ink passages 2068 is reduced in correspondence with the expansion of the piezo elements PE, and an amount of ink that corresponds to this reduction is quickly ejected from the tip of the nozzles Nz as ink droplets Ip. Printing is carried out by the formation of dots as the ink droplets Ip soak into the paper P that is mounted on the platen 26.

As shown in FIG. 18, the inkjet nozzles Nz in the ejection heads 2061 to 2066 are arranged in six nozzle row groups that eject ink for each color: black (K), cyan (C), light cyan (LC), magenta (M), light magenta (LM), and yellow (Y). The 48 nozzles Nz in each nozzle row are arranged in a row at a constant nozzle pitch k.

Although the printer 2022 is provided with nozzles Nz of a constant diameter as shown in FIG. 18, the nozzles Nz can be used to form a plurality of types of ink droplets having different amounts of ink. This is carried out by changing the drive waveform for driving the piezo elements PE. More specifically, by changing the rate of change at which the drive voltage of the piezo elements PE is to be turned to a negative voltage or by changing the peak voltage of the drive waveform, ink droplets having differing ink amounts can be formed with a single nozzle.

With the printer 2022 having the physical configuration described above, the paper P is carried by the paper-feed motor 2023 while the carriage 2031 is moved back and forth by the carriage motor 2024, and at the same time, the piezo elements PE of the ejection heads 2061 to 2066 are driven so as to eject the various colors of ink, forming dots and creating a multicolor image on the paper P.

It should be noted that here the printer 2022 that is used is provided with heads for ejecting ink using the piezo elements PE in the manner mentioned above, however, it is also possible to use a variety of elements other than piezo elements as the ejection drive elements. For example, the present invention can also be applied to a printer provided with ejection drive elements with which ink is ejected due to foams (bubbles) generated within the ink passages by passing a current through heaters disposed on the ink passages. Also, the control circuit 2040 may have any configuration, as long as it selectively records one of a plurality of types of dots of different sizes at each pixel position by supplying drive signals to each ejection drive element so as to cause one or more ink droplets to be selectively ejected from each nozzle, and as long as it generates drive signals so that the temporal ejection order of the plurality of types of ink droplets is kept constant over the forward pass and the return pass in main scanning.

<(2) Driving the Ejection Heads>

Figure 19:
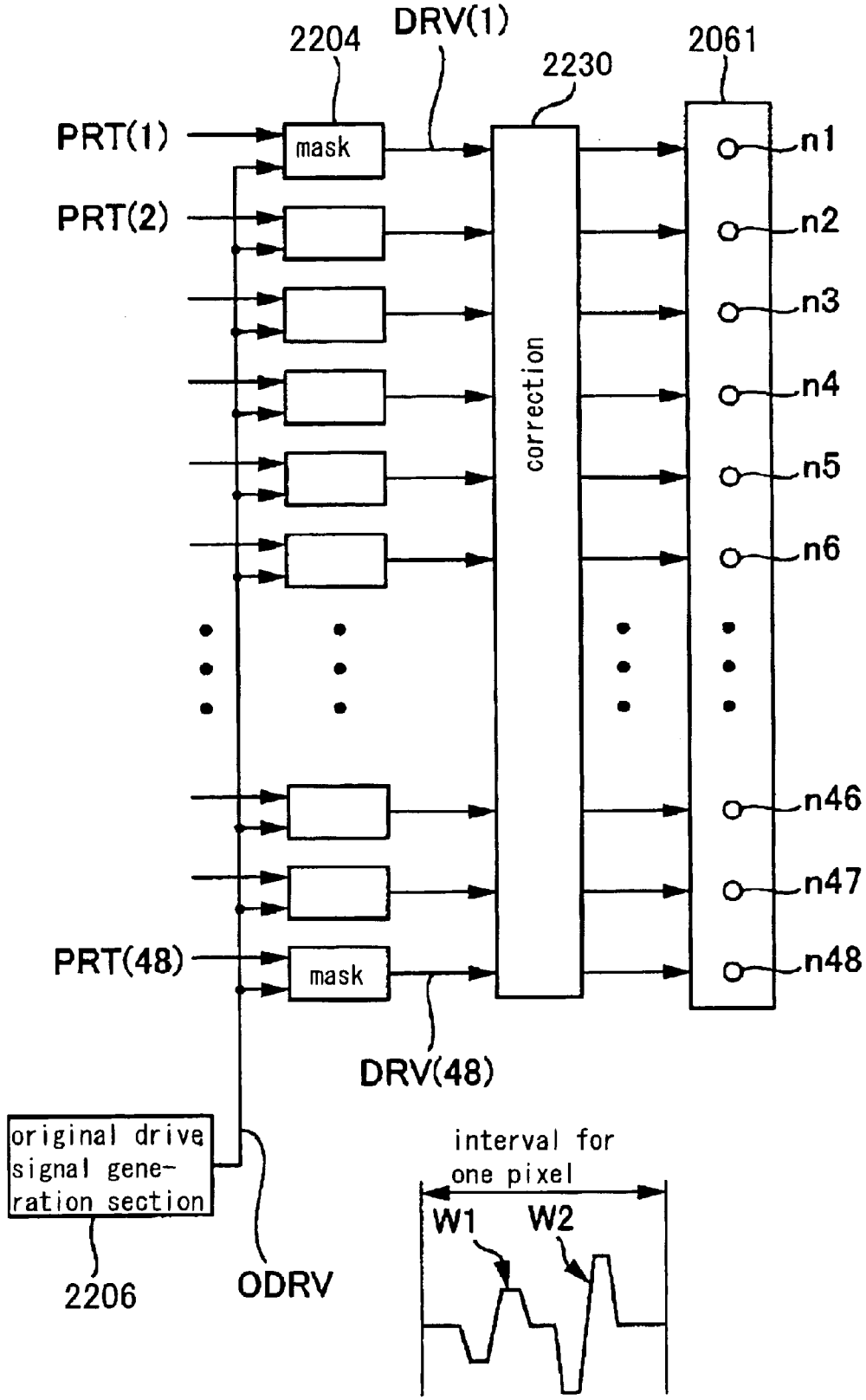
FIG. 19 is a block diagram showing the configuration of the drive signal generating section provided inside a head drive circuit 2052 (FIG. 14).
Figure 20:
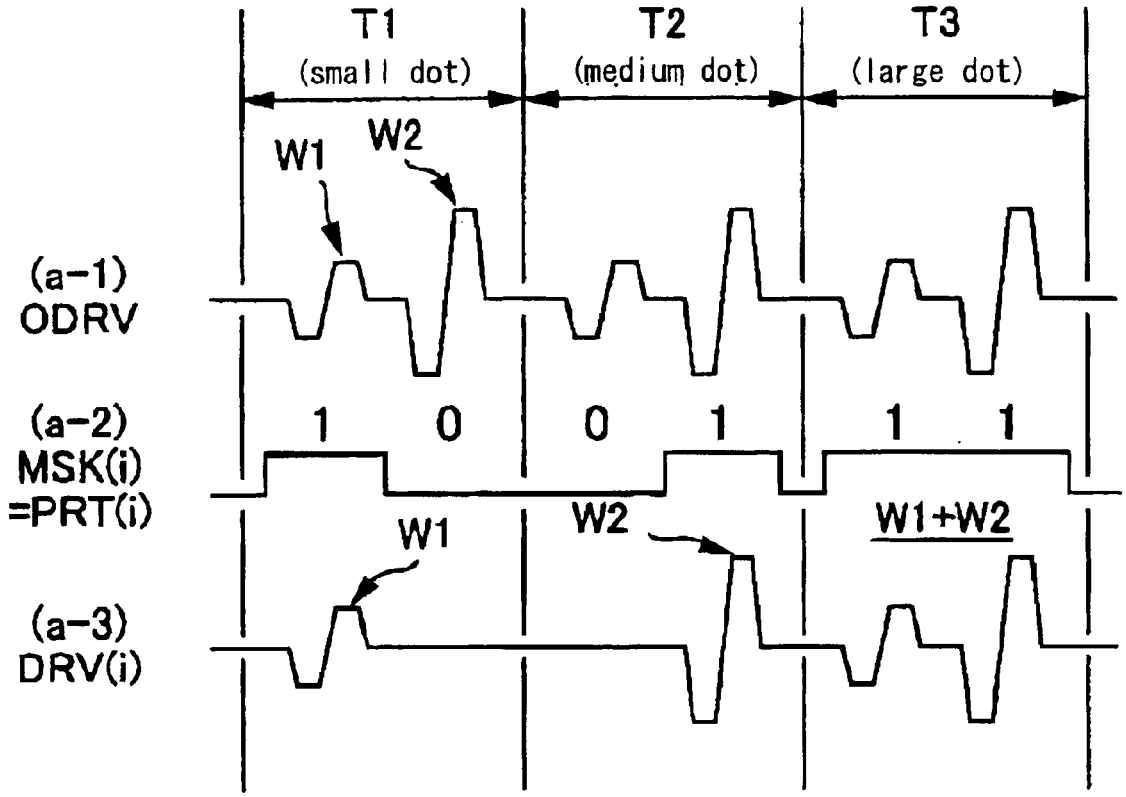
FIG. 20 is a timing chart showing the operation of the drive signal generating section.

Next, the driving of the ejection heads 2061 to 2066 is described with reference to FIGS. 19 and 20. FIG. 19 is a block diagram showing the configuration of a drive signal generation section provided inside the head drive circuit 2052 (FIG. 14). FIG. 20 is a timing chart showing the operation of the drive signal generation section shown in FIG. 19.

In FIG. 19, the drive signal generation section is provided with a plurality of mask circuits 2204, an original drive signal generation section 2206, and a drive signal correction section 2230. The mask circuits 2204 are provided corresponding to the plurality of piezo elements for respectively driving the nozzles n1 to n48 of the ejection head 2061. It should be noted that in FIG. 19 the bracketed numbers following each signal name indicate the number of the nozzle to which that signal is supplied. The original drive signal generation section 2206 generates an original drive signal ODRV common to the nozzles n1 to n48. The original drive signal ODRV is a signal that includes two pulses, a first pulse W1 and a second pulse W2, during the main-scanning period for one pixel. The drive signal correction section 2230 carries out a correction by shifting, either forward or backward for the entire return pass, the timing of the drive signal waveforms shaped by the mask circuits 2204. By correcting the timing of the drive signal waveforms, misalignments in the positions where the ink droplets land during the forward pass and during the return pass are corrected. That is, the misalignment in the positions where dots are formed between the forward pass and the return pass is corrected.

As shown in FIG. 19, the serial print signal PRT(i), which has been input, is input to the mask circuits 2204 together with the original drive signal ODRV that is output from the original drive signal generation section 2206. The serial print signal PRT(i) is a serial signal with two bits per pixel, and each of the bits correspond to the first pulse W1 and the second pulse W2, respectively.

Also, the mask circuits 2204 are gates for masking the original drive signal ODRV in correspondence with the level of the serial print signal PRT(i) (i=1 to 48). In other words, when the serial print signal PRT(i) is at level 1, the mask circuits 2204 pass the pulses corresponding to the original drive signal ODRV without any change and supply them to the piezo elements as a drive signal DRV, whereas when the serial print signal PRT(i) is at level 0, the mask circuits 2204 block the pulses corresponding to the original drive signal ODRV.

When printing, as shown in FIG. 20(*a*-1), the first pulse W1 and the second pulse T2 are generated in this order in each pixel period T1, T2, and T3 as the pulses of the original drive signal ODRV. It should be noted that "pixel period" is identical in meaning to the main-scanning period for one pixel. As described above, the mask circuits 2204 (FIG. 19) pass the pulses of the original drive signal ODRV without change when the serial print signal PRT(i) is at level 1, and block the pulses of the original drive signal ODRV when the serial print signal PRT(i) is at level 0.

Consequently, as shown in FIG. 20(*a*-2) and FIG. 20(*a*-3), when the two bits of the serial print signal PRT(i) in each pixel period are "1, 0", then only the first pulse W1 is output in the first half of the pixel period. Accordingly, a small dot that is small in size is formed on the printing medium. When the bits are "0, 1," only the second pulse W2 is output in the second half of the pixel period. Accordingly, a medium dot that is medium in size is formed on the printing medium. And when the bits are "1, 1," both the first pulse W1 and the second pulse W2 are output. Accordingly, a large dot that is large in size is formed on the printing medium.

It should be noted that, as can be understood by looking at the drive signal waveform of the forward pass shown in FIG. 20(*a*-3), the three types of drive signals DRV(i) for recording three types of dots are shaped so that the drive signal waveforms are different from one another during the pixel period, that is, so that at least either the size or the number of ink droplets ejected from the nozzles is different. In other words, the drive signal DRV(i) in a single pixel period is shaped so that it has three types of waveforms that differ from one another in accordance with the three different values of the print signals PRT(i).

The same drive signal waveforms corresponding to these dots can be used for both the forward pass and the return pass of the main scanning. That is, small ink droplets, medium ink droplets, and large ink droplets ejected from one nozzle during a single pixel period are ejected in the same order and at the same interval in the forward pass and the return pass. However, although the same drive signal waveforms are used in the forward pass and the return pass of the main scanning, the timing thereof is shifted forward or backward by the drive signal correction section 2230 (FIG. 19) and corrected for the entire return pass. By correcting the timing, the positions where ink droplets land are intentionally shifted for the entire return pass, and misalignments in the positions where ink droplets land during the forward pass and the return pass are corrected.

<(2) Overview of Correction of Dot Formation Position Misalignments in the Main-Scanning Direction>

Figure 21A:
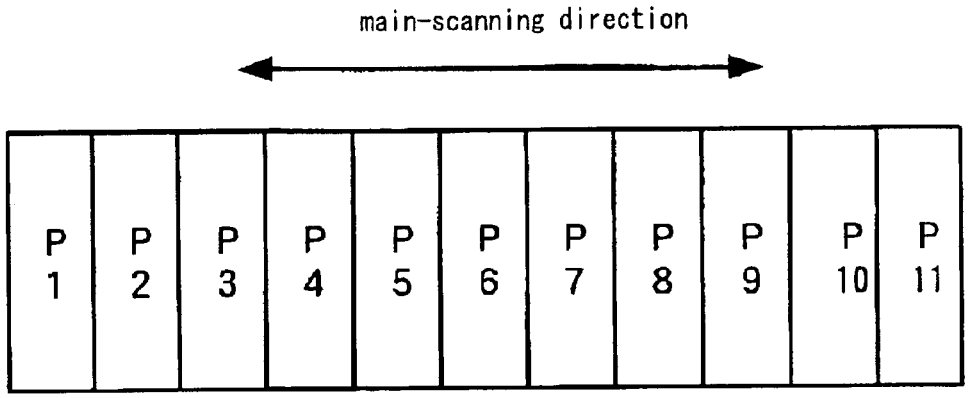
FIGS. 21A and 22B are diagrams for illustrating an overview of a method for determining the correction value for misalignment adjustment based on the correction pattern.
Figure 21B:
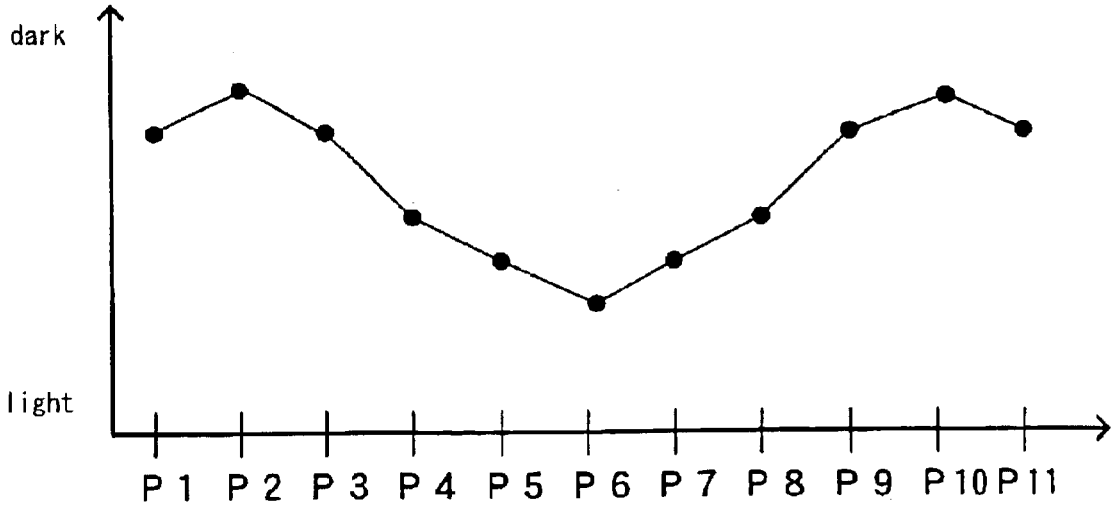

Next, an overview of the correction of misalignment in the dot formation position in the main-scanning direction is described with reference to FIGS. 21A and 21B. FIGS. 21A and 21B are diagrams for describing the gist of the method for determining the correction values for misalignment adjustment based on the correction pattern.

The method described hereinafter for correcting dot formation position misalignments is a method for intentionally shifting, for the entire return pass, the timing at which ink droplets are ejected in the return pass so that misalignments in the positions where dots are formed during the forward pass and the return pass do not stand out. It should be noted that it is also possible to intentionally shift the ejection timing of ink droplets in the forward pass for the entire forward pass, and it is also possible for the ejection timing of ink droplets in the forward pass and the return pass to be intentionally shifted over both the entire forward pass and return pass, respectively. Some causes of misalignments in the positions where dots are formed in the main-scanning direction during the forward pass and the return pass include variations in the speed at which the ink is ejected, backlash of the drive mechanism in the main-scanning direction, and warping of the platen supporting the print paper from below.

As shown in FIG. 21A, the correction pattern has eleven sub-patterns P1 to P11. Each sub-pattern P1 to P11 is printed by moving the ejection head 2028 back and forth in the main-scanning direction, and during which time, forming the dots on the print paper P with a specified row of nozzles (for example, the nozzles of the ejection head 2061).

In the forward pass, ink droplets are ejected onto the print paper P at a constant spacing (=1/180 inch). On the other hand, in the return pass, the ink droplets are similarly ejected at a constant spacing (=1/180 inch); however, for each sub-pattern P1 to P11, the ejection timing is shifted by 1/1440 inch in the sub-scanning direction.

For example, as for the sub-pattern P1 and the sub-pattern P2, assuming that ΔP1 is the misalignment between the ejection timing of the forward pass and the ejection timing of the return pass in the sub-pattern P1, and ΔP2 is the misalignment between the ejection timing of the forward pass and the ejection timing of the return pass in the sub-pattern P2, then $|\Delta P1-\Delta P2|=1/1440$ inch. Also, because 1/180 inch is equal to 8/1440 inch, when ΔP9 is assumed to be the misalignment between the ejection timing of the forward pass and the ejection timing of the return pass in the sub-pattern P9, which is eight sub-patterns away from the sub-pattern P1, then $|\Delta P1|=|\Delta P9|$.

In the sub-patterns P1 to P11 formed in this way, the closer the overlap between the dots formed on the print paper P in the forward pass and the dots formed on the print paper P in the return pass, the lighter the sub-pattern, and the smaller the overlap between the dots formed on the print paper P in the forward pass and the dots formed on the print paper P in the return pass, the darker the sub-pattern. FIG. 21B shows the darkness of each sub-pattern; in the correction pattern shown in FIG. 21A, it is lightest at the sub-pattern P6 and darkest at the sub-patterns P2 and P10.

In this embodiment, the two darkest sub-patterns are selected from the sub-patterns shown in FIG. 21A, and actual printing during the return pass is carried out according to an intermediate value between the ejection timings of the two sub-patterns at which they are printed in the return pass. That is, the intermediate value between the ejection timings at which the two sub-patterns are printed in the return pass is stored as the correction value, and by intentionally shifting the ejection timing of ink droplets for the entire return pass by the correction amount, the dot formation positions are corrected.

It should be noted that there is also a method of selecting the lightest sub-pattern using a sensor or by visual confirmation by the user and then adopting the conditions under which that sub-pattern was formed as the optimal value; however, for the sake of precision, it is more preferable that, as mentioned above, the two darkest sub-patterns are selected and the intermediate value between the ejection timings in the return pass at which these two sub-patterns are printed is taken as the optimal value. The reason for this is as follows.

In the case of a method of selecting the lightest sub-pattern using a sensor or by visual confirmation by the user and then adopting, as the optimal value, the conditions under which that sub-pattern was formed, if an adjacent sub-pattern is selected by mistake, the ejection timing on the return pass is shifted 1/1440 inch from the optimal value.

By contrast, although there are instances in which a neighboring sub-pattern is selected by mistake also with the method in which the two darkest sub-patterns are selected and the formation conditions of the sub-pattern located in the middle between these two sub-patterns is taken as the optimal value, the intermediate value between the return-pass ejection timings of the two sub-patterns will be the optimal value even if the sub-pattern P1 adjacent to P2 and the sub-pattern P11 adjacent to P10 are selected by mistake, or even if the sub-pattern P3 adjacent to P2 and the sub-pattern P9 adjacent to P10 are selected by mistake.

Also, even if the sub-pattern P2 is correctly selected but the sub-pattern P11 is mistakenly selected for the other sub-pattern, or if the sub-pattern P10 is correctly selected but the sub-pattern P1 is mistakenly selected for the other sub-pattern, the intermediate value between the return-pass ejection timings of the two sub-patterns is shifted from the optimal value by only half of 1/1440 inch.

It should be noted that in this correction method, it is not necessary to carry out printing using all nozzles in the nozzle row. That is, in this correction method, it is only necessary to distinguish the shade of each sub-pattern is known, and thus, as long as those conditions are met, it is also possible to carry out printing of the sub-patterns with some of the nozzles of the nozzle row. For example, the sub-patterns can be formed by ejecting ink droplets only with the nozzles at the ends or in the center portion of the nozzle row. By doing this, the ink that is required for printing the correction pattern can be conserved.

<(2) Method of Forming Correction Pattern Corresponding to Dot Size>

Figure 22A:
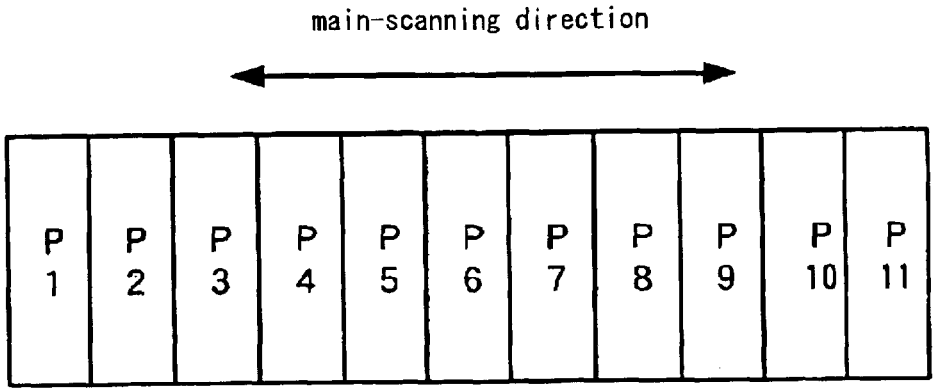
Figure 22B:
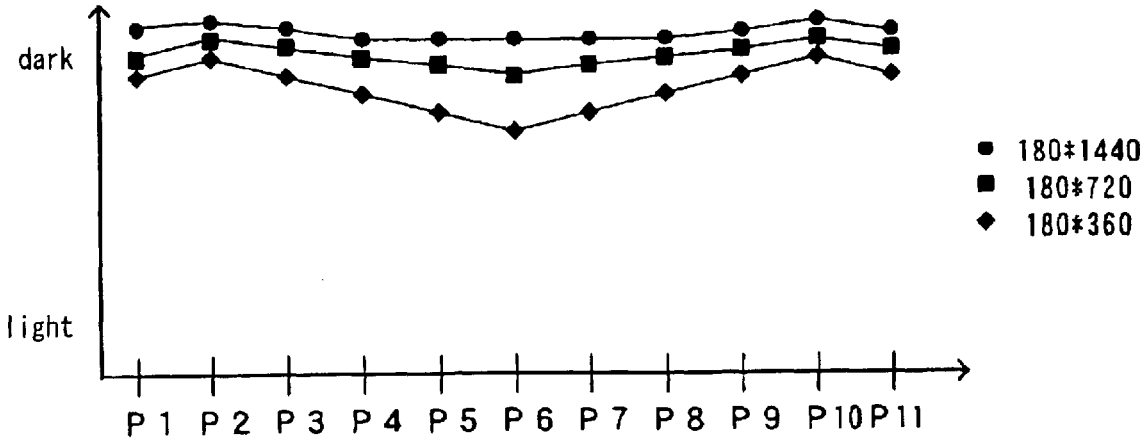
Figure 23A:
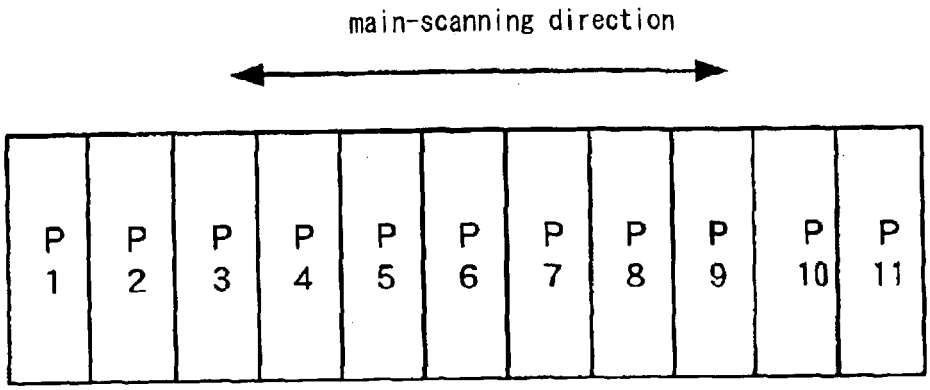
FIGS. 23A and 23B are diagrams for illustrating a correction pattern formed by medium-sized dots.
Figure 23B:
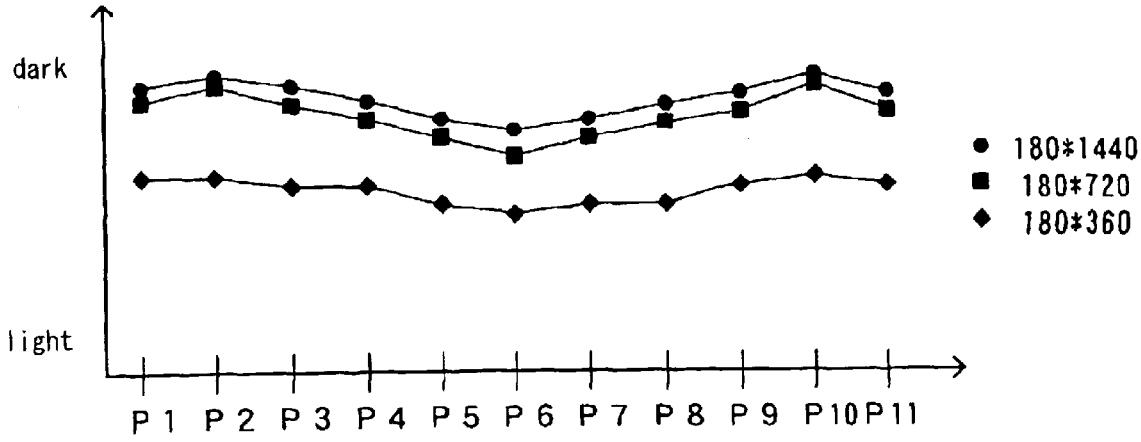
Figure 24A:
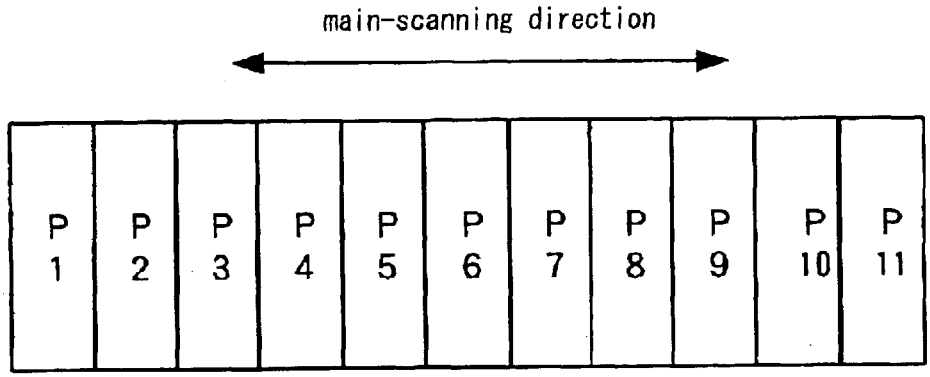
FIGS. 24A and 24B are diagrams for illustrating a correction pattern formed by small dots.
Figure 24B:
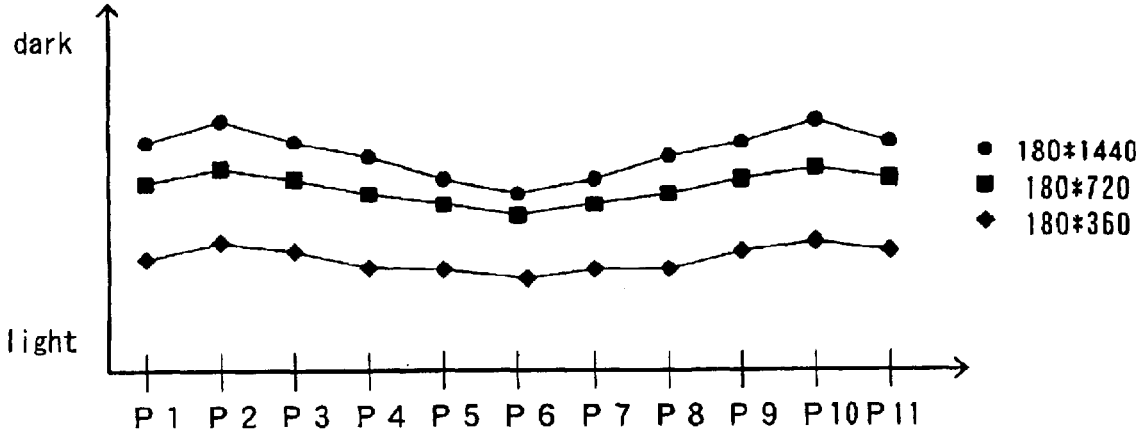

Next, a method for forming a correction pattern corresponding to the dot size is described with reference to FIGS. 22A, 22B, 23A, 23B, 24A, and 24B. FIGS. 22A and 22B are diagrams for describing the correction pattern formed by large dots. FIGS. 23A and 23B are diagrams for describing the correction pattern formed by medium dots. FIGS. 24A and 24B are diagrams for describing the correction pattern formed by small dots.

Misalignments in the positions where dots are formed are corrected based on the correction pattern as described above. Here, if the spacing between dots forming the correction pattern is the same in the main-scanning direction and the sub-scanning direction, then the correction pattern formed by large dots is darker than the correction pattern formed by medium dots, and the correction pattern formed by medium dots is darker than the correction pattern formed by small dots.

Consequently, even if the difference in shading among the sub-patterns is suitable in the correction pattern made of small dots formed with a certain spacing, in a correction pattern made of large dots formed with the same spacing, the difference in shading among the sub-patterns will not be suitable. That is, because each sub-pattern is very dark, the difference in shading among the sub-patterns becomes small.

Accordingly, in this embodiment, the spacing between dots, which form a correction pattern, in the sub-scanning direction is different according to the dot size. More specifically, the spacing between dots, forming a correction pattern, in the sub-scanning direction becomes larger in the order of small dots, medium dots, and large dots.

The sub-patterns P1 to P11 shown in FIGS. 22A, 23A, and 24A are printed at the same ejection timing during both the forward and return passes. That is, when the misalignment between the ejection timing of the forward pass and the ejection timing of the return pass is set to ΔPi when printing each sub-pattern Pi (i=1 to 11), then ΔPi is the same in FIGS. 22A, 23A, and 24A. Also, FIGS. 22B, 23B, and 24B show the darkness of each sub-pattern, and both the vertical and horizontal axes are the same scale in FIGS. 22B, 23B, and 24B. As is clear from comparing FIGS. 22B, 23B, and 24B, the sub-patterns formed by large dots are generally darker than the sub-patterns formed by medium dots, and the sub-patterns formed by medium dots are generally darker than the sub-patterns formed by small dots.

In FIG. 22B, the circles that are plotted indicate the darkness of each sub-pattern when each sub-pattern is formed at a resolution of 180 dpi in the main-scanning direction and at a resolution of 1440 dpi in the sub-scanning direction, that is, the spacing between dots in the main-scanning direction is (1/180) inch and the spacing between dots in the sub-scanning direction is (1/1446) inch.

Also, the squares that are plotted indicate the darkness of each sub-pattern when each sub-pattern is formed at a resolution of 180 dpi in the main-scanning direction and at a resolution of 720 dpi in the sub-scanning direction, that is, the spacing between dots in the main-scanning direction is (1/180) inch and the spacing between dots in the sub-scanning direction is (1/720) inch.

Further, the diamonds that are plotted indicate the darkness of each sub-pattern when each sub-pattern is formed at a resolution of 180 dpi in the main-scanning direction and at a resolution of 360 dpi in the sub-scanning direction, that is, the dot spacing in the main-scanning direction is (1/180) inch and the dot spacing in the sub-scanning direction is (1/360) inch. It should be noted that the relationship between the circles, squares, and diamonds, and the dot spacing in the main-scanning direction and in the sub-scanning direction is the same in FIGS. 23B and 24B.

As shown in FIG. 22, as for the sub-patterns P1 to P11 formed by large dots, if the resolution in the sub-scanning direction is set to 1440 dpi, all sub-patterns become dark, reducing the difference in shading among the sub-patterns. By contrast, the difference in darkness among the sub-patterns is increased as the resolution in the sub-scanning direction is lowered to 720 dpi and then to 360 dpi. Consequently, when forming a correction pattern using large dots, the resolution in the main-scanning direction is set to 180 dpi and the resolution in the sub-scanning direction is set to 360 dpi.

As shown in FIG. 23, as for the sub-patterns P1 to P11 formed by medium dots, when the resolution in the sub-scanning direction is set to 720 dpi, the difference in darkness among the sub-patterns becomes the largest.

Consequently, when forming a correction pattern using medium dots, the resolution in the main-scanning direction is set to 180 dpi and the resolution in the sub-scanning direction is set to 720 dpi.

As shown in FIG. 24, as for the sub-patterns P1 to P11 formed by small dots, if the resolution in the sub-scanning direction is set to 360 dpi, all sub-patterns become light, reducing the difference in darkness among the sub-patterns. By contrast, the difference in darkness between the sub-patterns is increased as the resolution in the sub-scanning direction is raised to 720 dpi and then to 1440 dpi. Consequently, when forming a correction pattern using small dots, the resolution in the main-scanning direction is set to 180 dpi and the resolution in the sub-scanning direction is set to 1440 dpi.

It should be noted that the spacing in the main-scanning direction between dots forming the correction pattern is constant (for example, 180 dpi) regardless of the dot size. When the spacing between dots in the main-scanning direction is reduced, the correction pattern becomes darker. However, when the spacing in the main-scanning direction between dots constituting the correction pattern is reduced in order to raise the density of the correction pattern, there arises a problem that dots adjacent in the main-scanning direction bond with one another and cause blotting. From this standpoint, in this embodiment, the spacing in the main-scanning direction between dots forming a correction pattern is kept the same regardless of the dot size, thereby inhibiting the occurrence of bleeding.

Also, from the standpoint of preventing occurrence of blotting, it is preferable that the dot spacing in the main-scanning direction is at least two times the dot spacing in the sub-scanning direction, regardless of the dot size.

<(2) Process for Correcting Dot Formation Positions>

Figure 25:
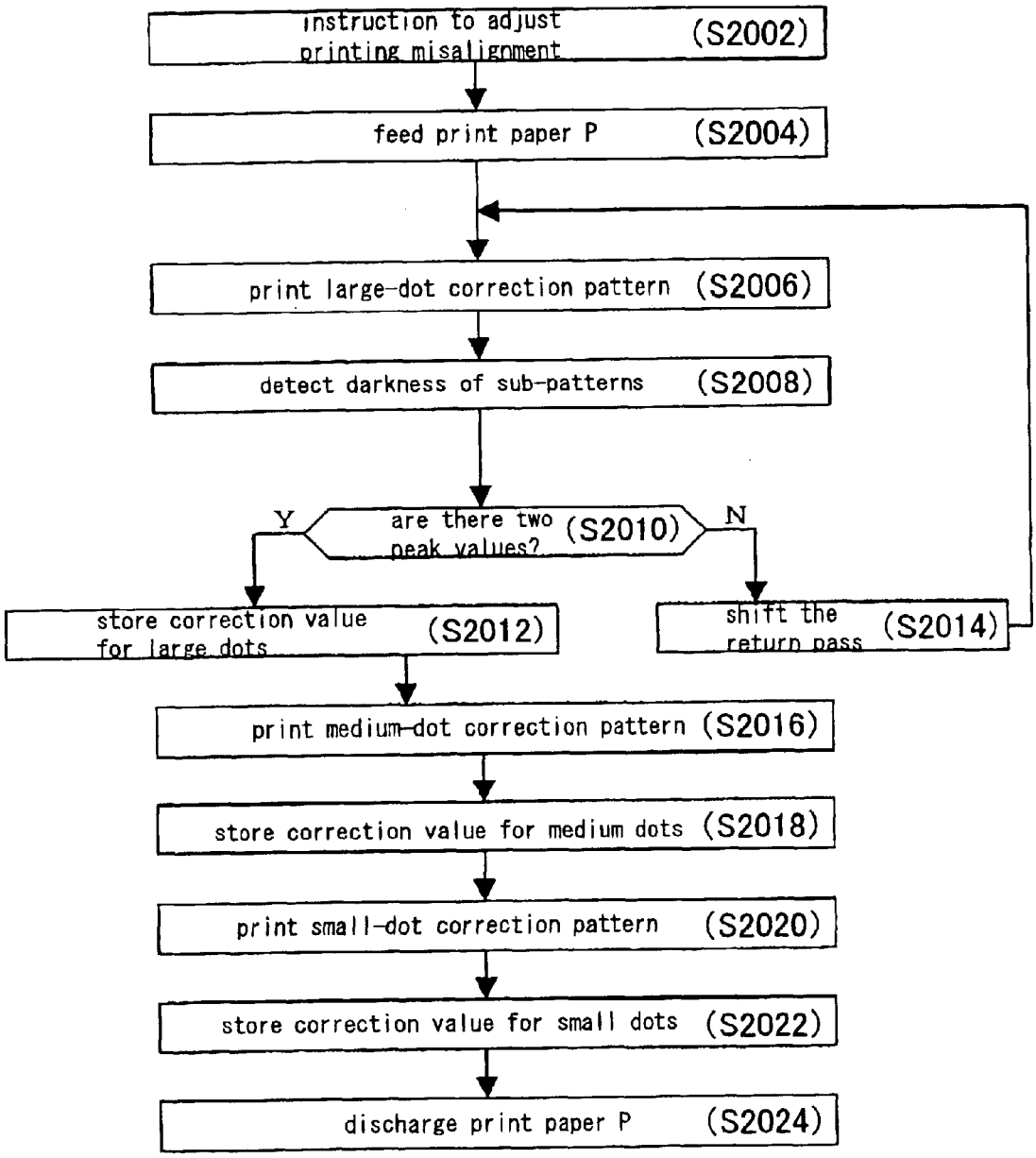
FIG. 25 is a flowchart for describing the process for correcting dot formation positions.
Figure 26:
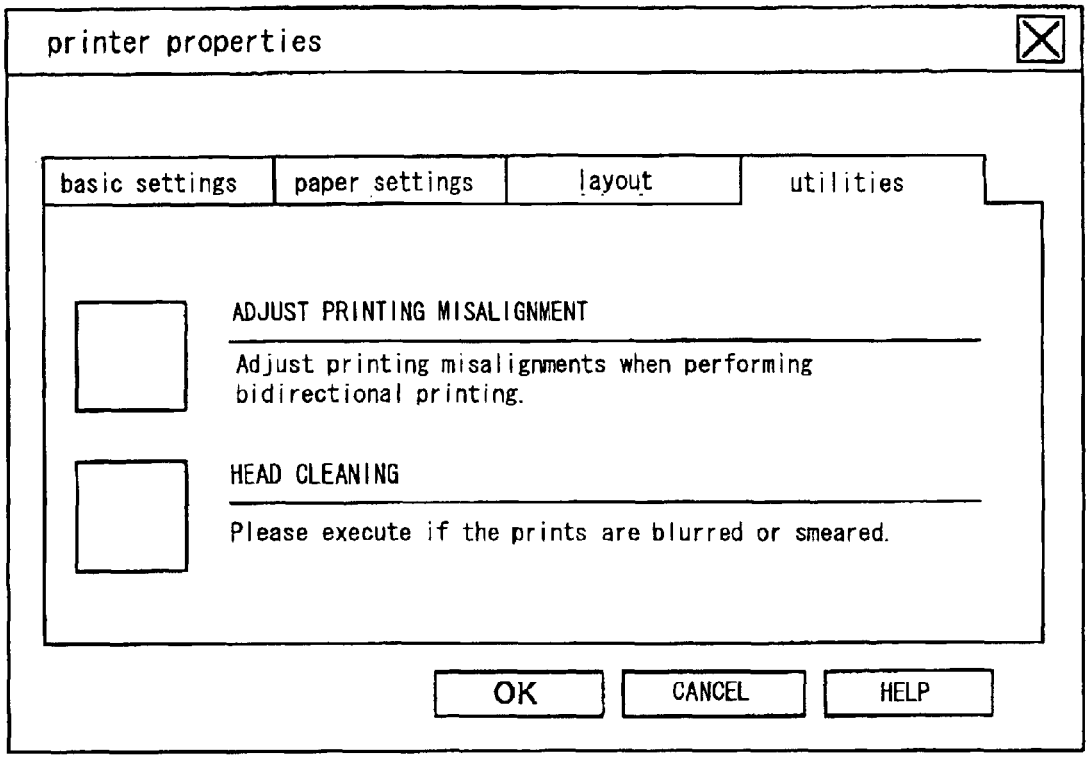
FIG. 26 is a diagram that schematically shows an example of the UI window through which a user designates print misalignment adjustment.
Figure 27:
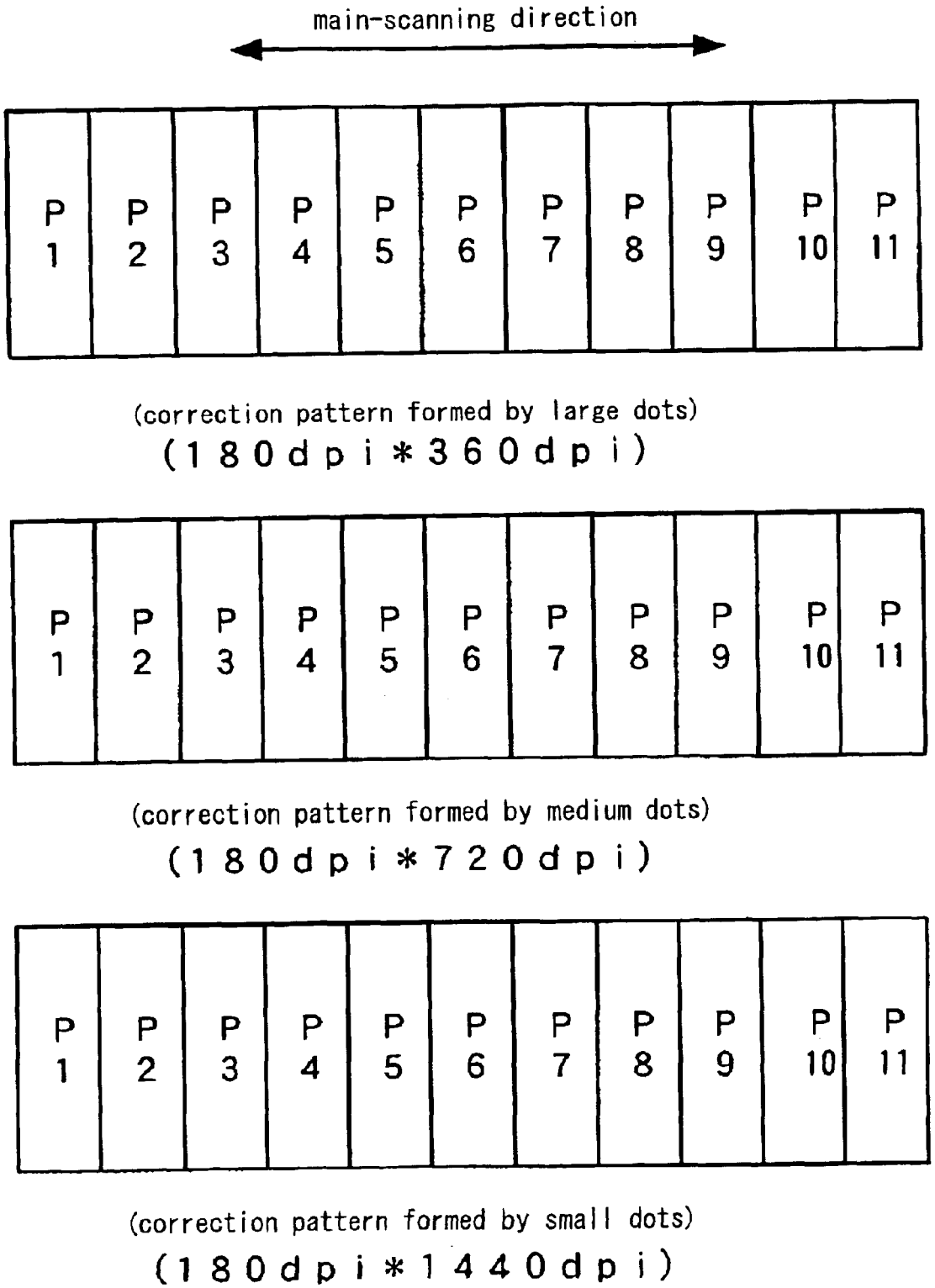
FIG. 27 is a diagram showing an example of the correction pattern.

Next, the process for correcting the positions at which the dots are formed is described with reference to FIGS. 25, 26, and 27. FIG. 25 is a flowchart for describing the process for correcting dot formation positions. FIG. 26 is a diagram that schematically shows an example of a UI window through which a user makes a command to adjust printing misalignment. FIG. 27 is a diagram showing an example of the correction pattern.

First, when, for example, a deterioration in image quality in bidirectional printing is noticed by the user, the user first gives, through a UI window such as that shown in FIG. 26, an instruction to adjust printing misalignment in order to adjust misalignments in the position where dots are formed in the forward and return passes in the main-scanning direction (step S2002). The screen for making this adjustment command is located under utilities, for example, in printer properties, and the user clicks the button corresponding to print misalignment adjustment (square button displayed in upper left of diagram) with a mouse, for example, so as to start the printing misalignment adjustment.

The instruction from the user to adjust the printing misalignments is transmitted to the printer 22 as a command. Based on the command received, the printer 2022 makes the paper-feed motor 2023 drive using the motor drive circuit 2054, for example, so as to supply the print paper P (step S2004).

Next, the printer 2022 makes the carriage motor 2024 and the paper-feed motor 2023 drive using the head drive circuit 2052 and the motor drive circuit 2054, for example, so as to print the correction pattern. An example of the correction pattern shown in FIG. 27 is used in the following description.

First, large size ink droplets are ejected from the ejection head 2061 so as to print a correction pattern, that is, the sub-patterns P1 to P11, using large dots (step S2006). The dot resolution at this time is a resolution of 180 dpi in the main-scanning direction and a resolution of 360 dpi in the sub-scanning direction; that is, the dot spacing in the main-scanning direction is ($1/180$) inch, and the dot spacing in the sub-scanning direction is ($1/360$) inch. As mentioned above, when forming a correction pattern with large dots, the shade of the sub-patterns P1 to P11 becomes most conspicuous by printing at this resolution.

Next, light is emitted from the light-emitting section 2029*a* of the reflection-type optical sensor 2029 to each sub-pattern P1 to P11, the reflected light that is reflected is received by the light-receiving section 2029*b*, and the darkness of each sub-pattern P1 to P11 is detected based on the output value of the light-receiving section 2029*b* to correspond to the intensity of the reflected light that is received (step S2008).

Next, it is determined whether or not there are two sub-patterns having peak values in darkness among the sub-patterns P1 to P11 (step S2010).

If there are two sub-patterns having peak values in darkness among the sub-patterns P1 to P11, then the value in between the ejection timings at which these two sub-patterns were printed during the return pass is stored as the correction value for the large dots (step S2012).

If there is are no two sub-pattern that each have a peak value in darkness among the sub-patterns P1 to P11, then the ink ejection timing in the return pass is suitably shifted overall so that there are two sub-patterns having a peak value in darkness (step S2014).

Next, medium size ink droplets are ejected from the ejection head 2061 so as to print a correction pattern, that is, the sub-patterns P1 to P11, using medium dots (step S2016). The dot resolution at this time is a resolution of 180 dpi in the main-scanning direction and a resolution of 720 dpi in the sub-scanning direction; that is, a dot spacing in the main-scanning direction is ($1/180$) inch, and a dot spacing in the sub-scanning direction is ($1/720$) inch. As mentioned above, the shade of the sub-patterns P1 to P11 becomes most conspicuous by printing at this resolution when forming a correction pattern with medium dots.

Next, using these sub-patterns P1 to P11, the correction value for the medium dots is stored in the same manner as in the case of large dots (step S2018).

Further, small size ink droplets are ejected from the ejection head 2061 so as to print a correction pattern, that is, the sub-patterns P1 to P11, using small dots (step S2020). The dot resolution at this time is a resolution of 180 dpi in the main-scanning direction and a resolution of 1440 dpi in the sub-scanning direction; that is, a dot spacing in the main-scanning direction is ($1/180$) inch, and a dot spacing in the sub-scanning direction is ($1/1440$) inch. As mentioned above, the shade of the sub-patterns P1 to P11 becomes most conspicuous by printing at this resolution when forming a correction pattern with small dots.

Next, using these sub-patterns P1 to P11, the correction value for the small dots is stored in the same manner as in the case of large dots (step S2022).

Finally, the printer 2022 drives the paper-feed motor 2023 with the motor drive circuit 2054, for example, and discharges the print paper P (step S2024).

It should be noted that in the above-mentioned correction process, in step S2008, light is emitted from the light-emitting section 2029*a* of the reflection-type optical sensor 2029 to each sub-pattern P1 to P11, the reflected light that is reflected is received by the light-receiving section 2029*b*, and the darkness of each sub-pattern P1 to P11 is detected based on the output value of the light-receiving section 2029*b* corresponding to the intensity of the reflected light that is received; however, it is also possible for the user to detect the density of each sub-pattern by visually confirming it himself. In this case, the user visually confirms the sub-patterns P1 to P11 and selects the two sub-patterns having peak values in darkness. The printer 2022 receives information specifying the sub-patterns selected by the user as command information, and, based on this command information, stores the median between the ejection timings at which these two sub-patterns are printed during the return pass as the correction value.

<(2) Other Considerations>

In the foregoing, a printing apparatus, for example, according to a second aspect of the invention was described based on the second embodiment; however, the foregoing embodiment is for the purpose of facilitating understanding of the present invention and is not for the purpose of limiting the present invention. The invention can of course be altered and improved without departing from the gist thereof and includes functional equivalents.

Print paper was described as an example of the printing medium; however, it is also possible to use film, cloth, or sheet metal, for example, as the printing medium.

It is also possible to achieve a computer system having: a computer main unit; the printer according to the above-described embodiment connected to the computer main unit; and if necessary, an input device such as a mouse or a keyboard, a display device such as a CRT, a flexible disk drive device, and a CD-ROM drive device. A computer system achieved in this manner is superior to conventional systems as an overall system.

The printer according to the foregoing second embodiment can also be given some of the functions or the mechanisms of a computer main unit, a display device, an input device, a flexible disk drive device, and a CD-ROM drive device. For example, the printer can be configured so as to have an image processing section for carrying out image processing, a display section for carrying out various types of displays, and a storage medium inserting/detaching section to/from which a storage medium storing image data captured by a digital camera or the like can be inserted and taken out.

A color inkjet printer was described in the second embodiment; however, the invention can also be applied to monochrome inkjet printers. The invention can also be applied to printers other than inkjet-type printers. The invention is generally applicable to printing apparatuses for printing to a printing medium, and, for example, can also be applied to facsimile apparatuses and copy machines. However, in so-called inkjet-type printing apparatuses, in which printing is carried out by ejecting ink from a print head, a particularly high image quality is demanded in the printed product, and thus an even larger benefit is obtained from the above-mentioned means.

Also, in the foregoing, printing misalignments were adjusted as requested by the user; however, they may also be adjusted automatically without a command from the user. Further, the above-mentioned adjustment and testing may be performed before the printing apparatus enters into the hands of the user, such as upon shipping.

All nozzles for each color can be corrected in accordance with a single correction value for each dot size, or the correction value for each dot size can be independently set for each nozzle group for which the ink droplet ejection timing can independently be corrected. It is also possible to independently set the correction values for each group of nozzle rows ejecting the same ink. For example, if there are two groups of nozzle rows that eject a particular ink, then the same correction value can be adopted for the nozzles of those two groups.

In the foregoing second embodiment, position misalignments were corrected by adjusting the ejection timing of the return pass; however, it is also possible to correct position misalignments by adjusting the ejection timing of the forward pass. Also, it is also possible to correct position misalignments by adjusting the ejection timing of both the forward pass and the return pass. That is, position misalignments may be corrected by adjusting the ejection timing of at least either one of the forward-pass or the return pass.

In the foregoing second embodiment, some of the configuration that is achieved by hardware may be replaced with software, and, alternatively, some of the configuration that is achieved by software may be replaced with hardware.

According to the second embodiment, it becomes possible to prevent deterioration of image quality caused by differences in the printing characteristics during the forward pass and the return pass when carrying out bidirectional printing.

(3) Third Embodiment

<(3) Example of Overall Configuration of Apparatus>

Figure 28:
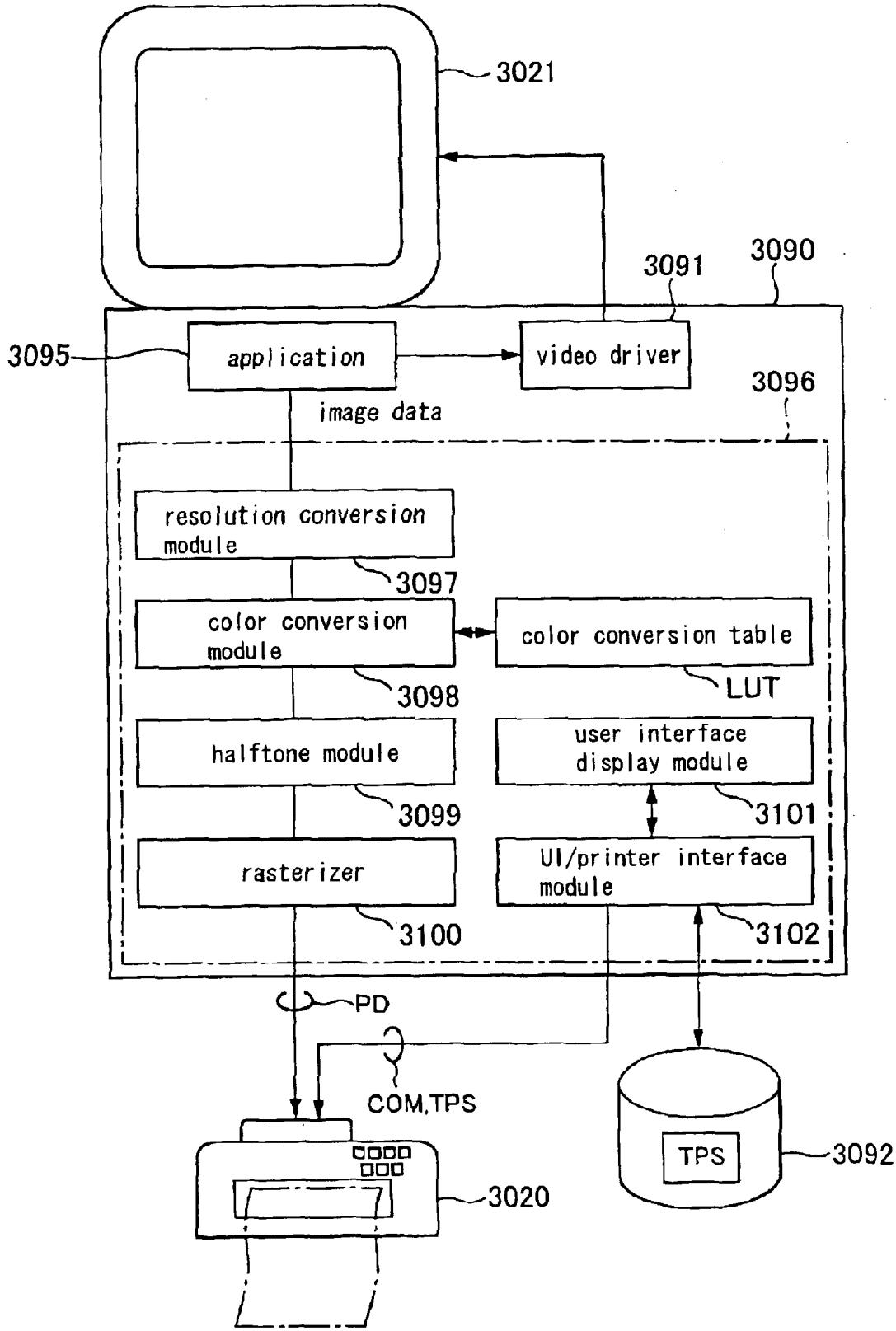
FIG. 28 is a block diagram showing the configuration of a printing system serving as an example of the present invention.

FIG. 28 is a block diagram showing the configuration of a printing system.

This printing system includes a computer 3090 and a color inkjet printer 3020 as an example of a printing apparatus. It should be noted that the printing system including the color inkjet printer 3020 and the computer 3090 can also be broadly defined as a "printing apparatus." Also, although not shown in the drawing, a computer system is made up of the computer 3090, the color inkjet printer 3020, a display device such as a CRT 3021 or a liquid crystal display device, an input device such as a keyboard or a mouse, and a drive device such as a flexible drive device or a CD-ROM drive device.

With the computer system 3090, an application program 3095 operates under a predetermined operating system. To the operating system are incorporated a video driver 3091 and a printer driver 3096; via these drivers, print data PD to be transferred to the color inkjet printer 3020 is output from the application program 3095. The application program 3095, which is, for example, for image retouch, carries out a requested process with respect to an image to be processed and displays images on the CRT 3021 via the video driver 3091.

When the application program 3095 sends a print order, the printer driver 3096 of the computer 3090 receives image data from the application program 3095 and converts it into print data PD to be supplied to the color inkjet printer 3020. The printer driver 3096 is internally provided with a resolution conversion module 3097, a color conversion module 3098, a halftone module 3099, a rasterizer 3100, a user interface display module 3101, a UI/printer interface module 3102, and a color conversion lookup table LUT.

The resolution conversion module 3097 has the function of converting the resolution of color image data formed by the application program 3095 into the print resolution. The image data that is thus converted in resolution is still image information composed of the three color components RGB. The color conversion module 3098 refers to the color conversion lookup table LUT as it converts the RGB image data for each pixel into multi-gradation data of a plurality of ink colors and that can be used by the color inkjet printer 3020.

The multi-gradation data having been converted in color has a gradation value of 256 scales, for example. This data is subjected to so-called "halftone processing" by the halftone module 3099, creating halftone image data. The halftone image data is rearranged by the rasterizer 3100 in the order of data transfer to the color inkjet printer 3020, and is output as the final print data PD. The print data PD includes raster data indicating how dots are to be formed during each main scanning and data indicating the feed amount in sub-scanning.

The user interface display module 3101 has a function for displaying various types of user interface windows related to printing and a function for receiving user input through those windows.

The UI/printer interface module 3102 has a function for acting as an interface between the user interface (UI) and the color inkjet printer. It interprets orders given by the user through the user interface and transmits various commands COM to the color inkjet printer, and alternatively, interprets the commands COM received from the color inkjet printer and performs various displays to the user interface. The UI/printer interface module 3102 also has a function for reading out test pattern print signals TPS about test patterns including carry amount correction patterns, which are described later, from a hard disk 3092, and supplying these to the color inkjet printer 3020.

It should be noted that the printer driver 3096, for example, achieves a function for sending and receiving various types of commands COM and a function for supplying print data PD and test pattern print signals TPS to the color inkjet printer 3020. A program for realizing the functions of the printer driver 3096 is supplied in a form in which it is stored on a computer-readable storage medium. Various types of computer-readable media can be used as such a storage medium, including flexible disks, CD-ROMs, magneto-optic disks, IC cards, ROM cartridges, punch cards, printed material on which a code such as a barcode is printed, memory devices (memories such as a RAM or ROM) inside a computer, and memory devices outside a computer. Also, such a computer program can be downloaded to the computer 3090 via the Internet.

Figure 29:
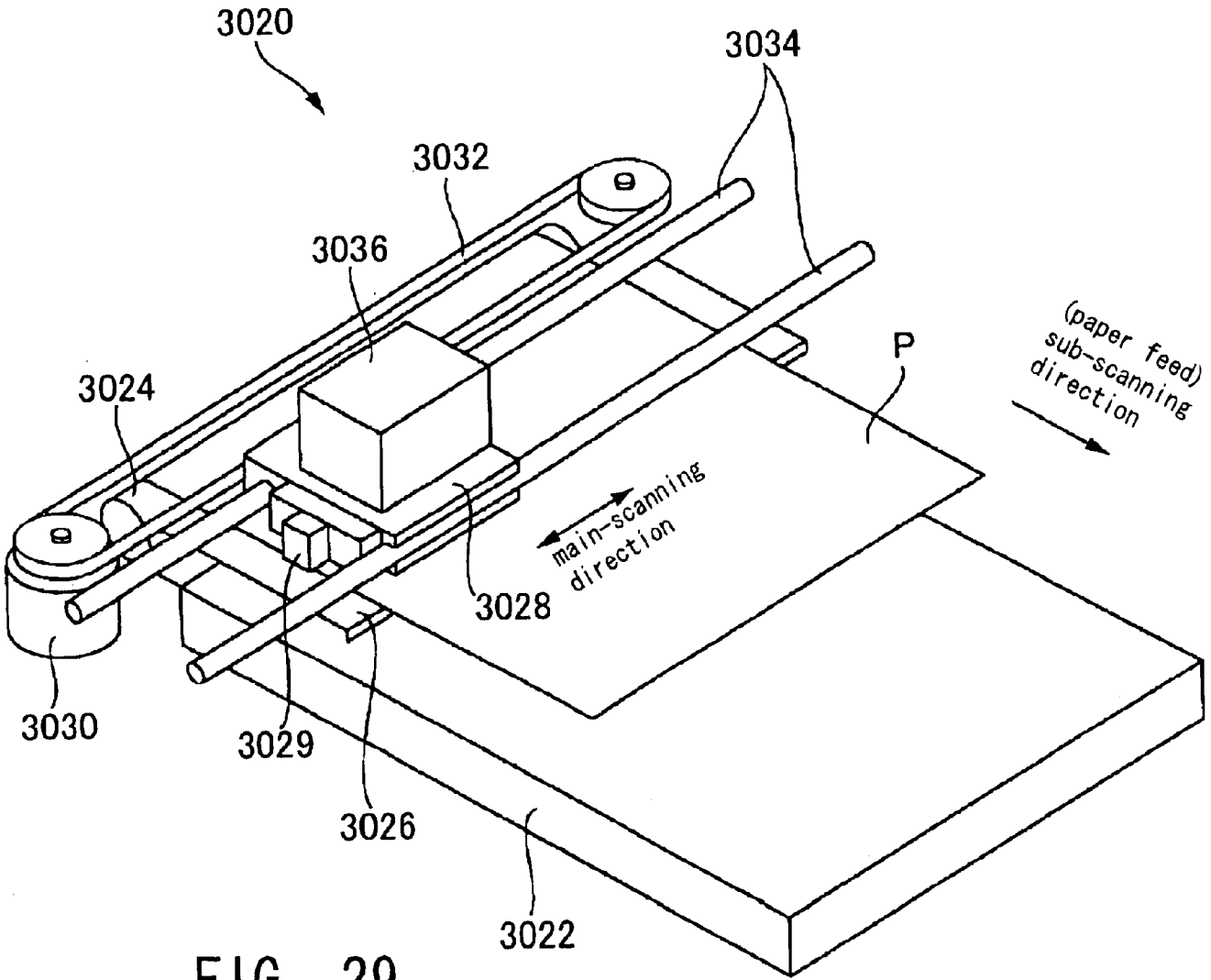
FIG. 29 is a perspective view that schematically shows an example of a primary configuration of a color inkjet printer 3020.

FIG. 29 is a perspective view that schematically shows an example of some main structures of the color inkjet printer 3020. The color inkjet printer 3020 comprises: a paper stacker 3022; a paper carry roller 3024, which is driven by a step motor that is not shown; a platen 3026; a carriage 3028; a carriage motor 3030; a pull belt 3032 driven by the carriage motor 3030; and a guide rail 3034 for the carriage 3028. Also, a print head 3036 provided with numerous nozzles and a reflection-type optical sensor 3029, which is described in detail later, are mounted on the carriage 3028.

The perimeter of the paper carry roller 3024 is set to one inch, for example, for the sake of convenience in correcting the carry amount, and on the shaft end of the paper carry roller 3024 are provided: a position detection sensor, which is not shown, for detecting a certain position that serves as the reference position of the paper carry roller 3024; and an encoder 3035 for detecting the rotation position (rotation angle) from the reference position. The encoder 3035 is configured so that it can detect a precise rotation position at a precision of an integral submultiple of the smallest paper carry amount that can be carried by the paper carry roller 3024, and based on a signal of the encoder 3035, the print sheet is aligned or the carry amount of the paper carry roller 3024 is corrected. Correction of the carry amount will be described in detail later.

The print sheet P is taken up from the paper stacker 3022 by the paper carry roller 3024 and is delivered in the sub-scanning direction over the surface of the platen 3026. The carriage 3028 is drawn by the pull belt 3032, which is driven by the carriage motor 3030, and moved in the main-scanning direction along the guide rail 3034.

It should be noted that the main-scanning direction indicates the direction in which the carriage 3028 is moved back and forth along the guide rail 3034, whereas the sub-scanning direction indicates the single direction in which the paper sheet P is delivered over the surface of the platen 3026. The main-scanning direction is perpendicular to the sub-scanning direction.

Also, the paper supply operation for supplying the print sheet P to the color inkjet printer 3020 and the paper discharge operation for discharging the print sheet P from the color inkjet printer 3020 are performed using the paper carry roller 3024.

<(3) Example Configuration of the Reflection-Type Optical Sensor>

Figure 30:
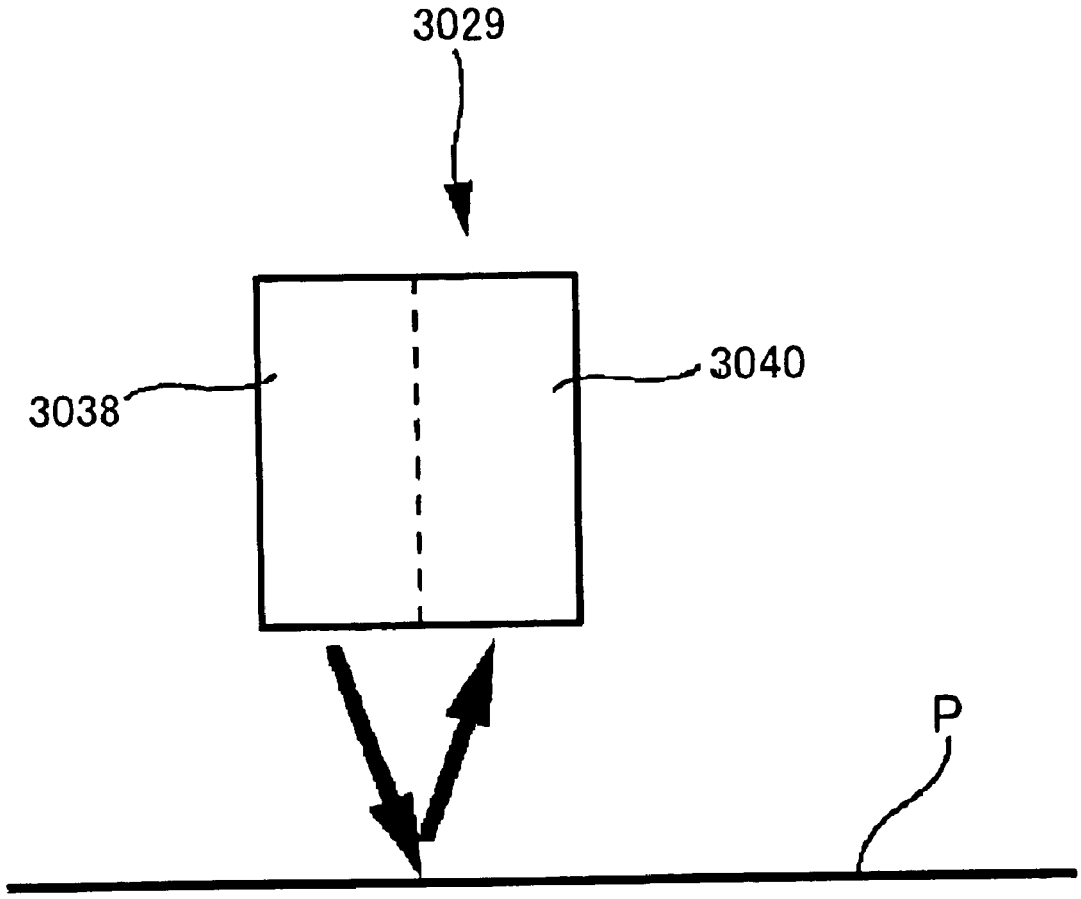
FIG. 30 is a schematic drawing for describing an example of a reflection-type optical sensor 3029.

FIG. 30 is a schematic drawing for describing an example of the reflection-type optical sensor 3029. The reflection-type optical sensor 3029 is attached to the carriage 3028, and has a light-emitting section 3038 that is made of, for example, a light-emitting diode, and a light-receiving section 3040 that is made of, for example, a phototransistor. The light that has been emitted from the light-emitting section 3038, that is, the incident light, is reflected by the print sheet P, and the reflected light is received by the light-receiving section 3040 and converted into an electrical signal. The magnitude of the electrical signal is measured as the output value of the light-receiving sensor corresponding to the intensity of the reflected light that has been received.

It should be noted that in the above description, as shown in the drawing, the light-emitting section 3038 and the light-receiving section 3040 are configured into a single unit as a device that serves as the reflection-type optical sensor 3029; however, they may each constitute separate devices, such as a light-emitting device and a light-receiving device.

Also, in the above description, in order to obtain the intensity of the reflected light that is received, the magnitude of the electric signals is measured after the reflected light is converted into electrical signals; however, this is not a limitation, and it is sufficient if the output value of the light-receiving sensor corresponding to the intensity of the received reflected light can be measured.

<(3) Example of the Electrical Configuration of the Color Inkjet Printer>

Figure 31:
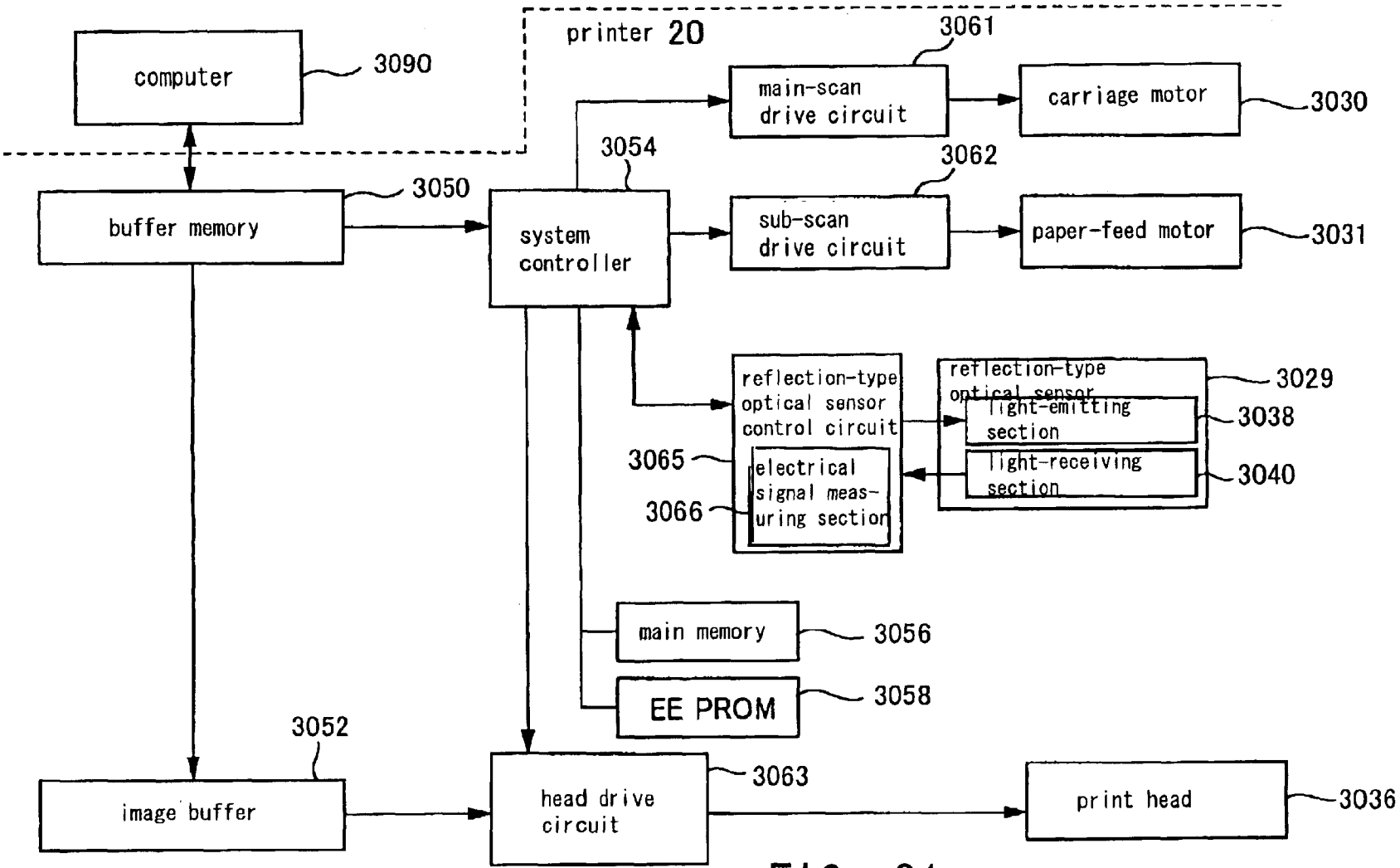
FIG. 31 is a block diagram showing an example of the electrical configuration of the color inkjet printer 3020.

FIG. 31 is a block diagram showing an example of the electrical configuration of the color inkjet printer 3020. The color inkjet printer 3020 comprises: a buffer memory 3050 for receiving signals supplied from the computer 3090; an image buffer 3052 for storing print data; a system controller 3054 for controlling the overall operation of the color inkjet printer 3020; a main memory 3056; and an EEPROM 3058. Also, to the system controller 3054 are connected: a main-scan drive circuit 3061 for driving the carriage motor 3030; a sub-scan drive circuit 3062 for driving the paper carry motor 3031; a head drive circuit 3063 for driving the print head 3036; and a reflection-type optical sensor control circuit 3065 for controlling the light-emitting section 3038 and the light-receiving section 3040 of the reflection-type optical sensor 3029. The reflection-type optical sensor control circuit 3065 is provided with an electrical signal measuring section 3066 for measuring the electrical signals that are converted from the reflected light received by the light-receiving section 3040.

The print data that are transferred from the computer 3090 is temporarily held in the buffer memory 3050. Inside the color inkjet printer 3020, the system controller 3054 reads necessary information from the print data in the buffer memory 3050, and based on the data, sends control signals to the main-scan drive circuit 3061, the sub-scan drive circuit 3062, and the head drive circuit 3063.

Print data for a plurality of color components are received by the buffer memory 3050 and stored in the image buffer 3052. The head drive circuit 3063 reads the print data for each color component from the image buffer 3052 in accordance with the control signal from the system controller 3054, and drives the nozzle rows for each color, which are provided in the print head 3036, according to the print data.

<(3) Example of the Nozzle Configuration of the Print Head>

Figure 32A:
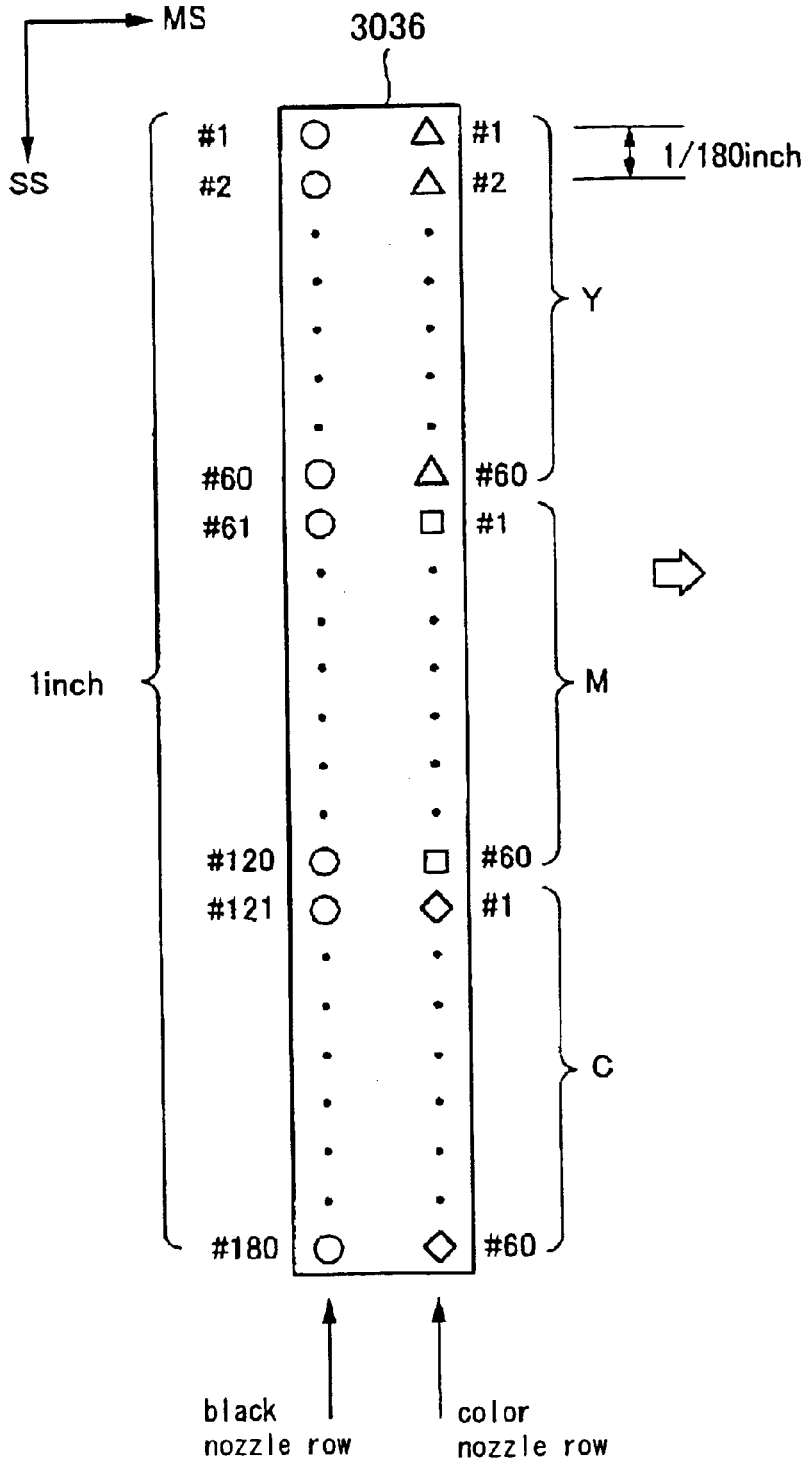
FIG. 32A is an explanatory diagram showing the nozzle arrangement in the lower surface of a print head 3036.
Figure 32B:
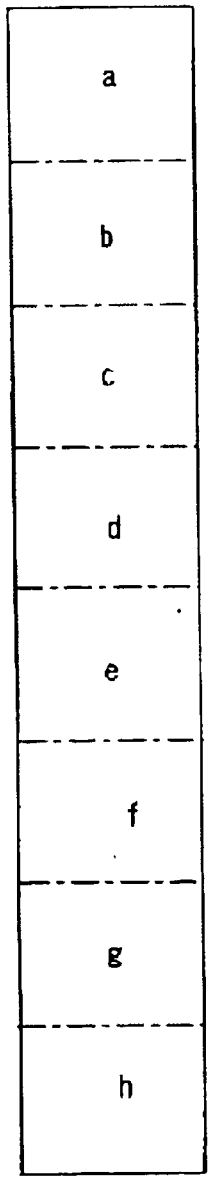
FIG. 32B is an explanatory diagram showing the arrangement of the nozzle groups.

FIG. 32A is an explanatory diagram showing the nozzle arrangement in the lower face of the print head 3036. FIG. 32B is an explanatory diagram showing the arrangement of the nozzle groups. First, from FIG. 32A, it is clear that the print head 3036 has a black nozzle row and a color nozzle row both arranged in straight lines in the sub-scanning direction SS.

The black nozzle row (shown by the empty circles) has 180 nozzles, #1 to #180. The nozzles #1 to #180 are arranged at a constant dot pitch in the sub-scanning direction. Here, for the sake of correcting the carry amount, the size of the print head 3036 is set to one inch, for example, to match the perimeter of the paper carry roller 3024.

That is, using the print head 3036, when printing with a paper carry amount of one inch and carrying the sheet as a band, an image of 180 dpi is printed.

The color nozzle row has 60 nozzles each of yellow nozzles Y (shown by empty triangles), magenta nozzle groups M (shown by empty squares), and cyan nozzle groups C (shown by empty diamonds), and is arranged at the same nozzle pitch in the sub-scanning direction as the black nozzle row.

During printing, the print head 3036 moves at a constant speed in the main-scanning direction together with the carriage 3028, and ink is ejected from each of the nozzles. However, depending on the printing mode, there may be cases where all nozzles are not always be used and only some of the nozzles are used.

<(3) Outline of the Carry Amount Correction Pattern>

Figure 33:
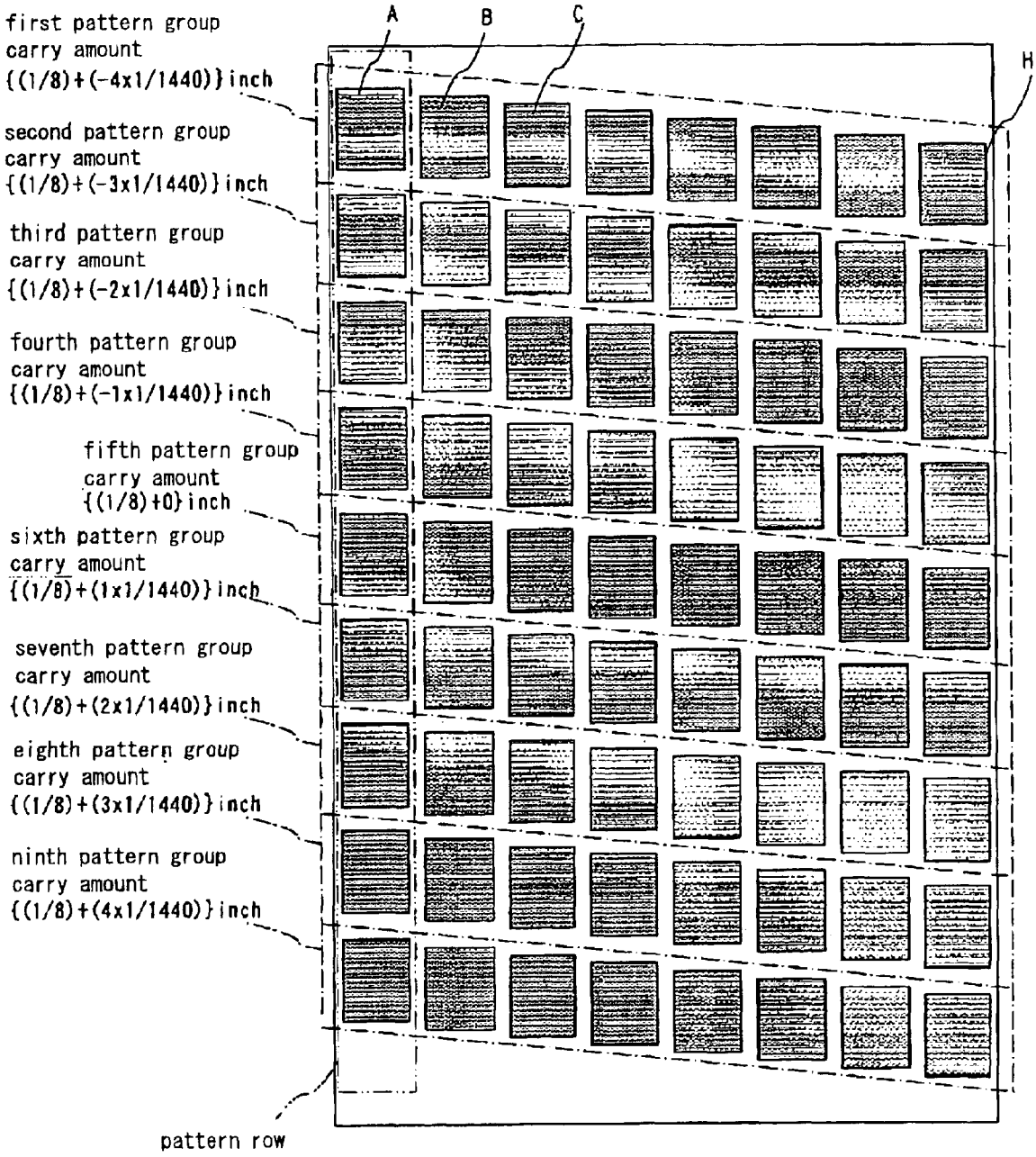
FIG. 33 is an explanatory diagram showing an example of the carry amount correction pattern.

FIG. 33 shows an example of the carry amount correction pattern.

Figure 34:
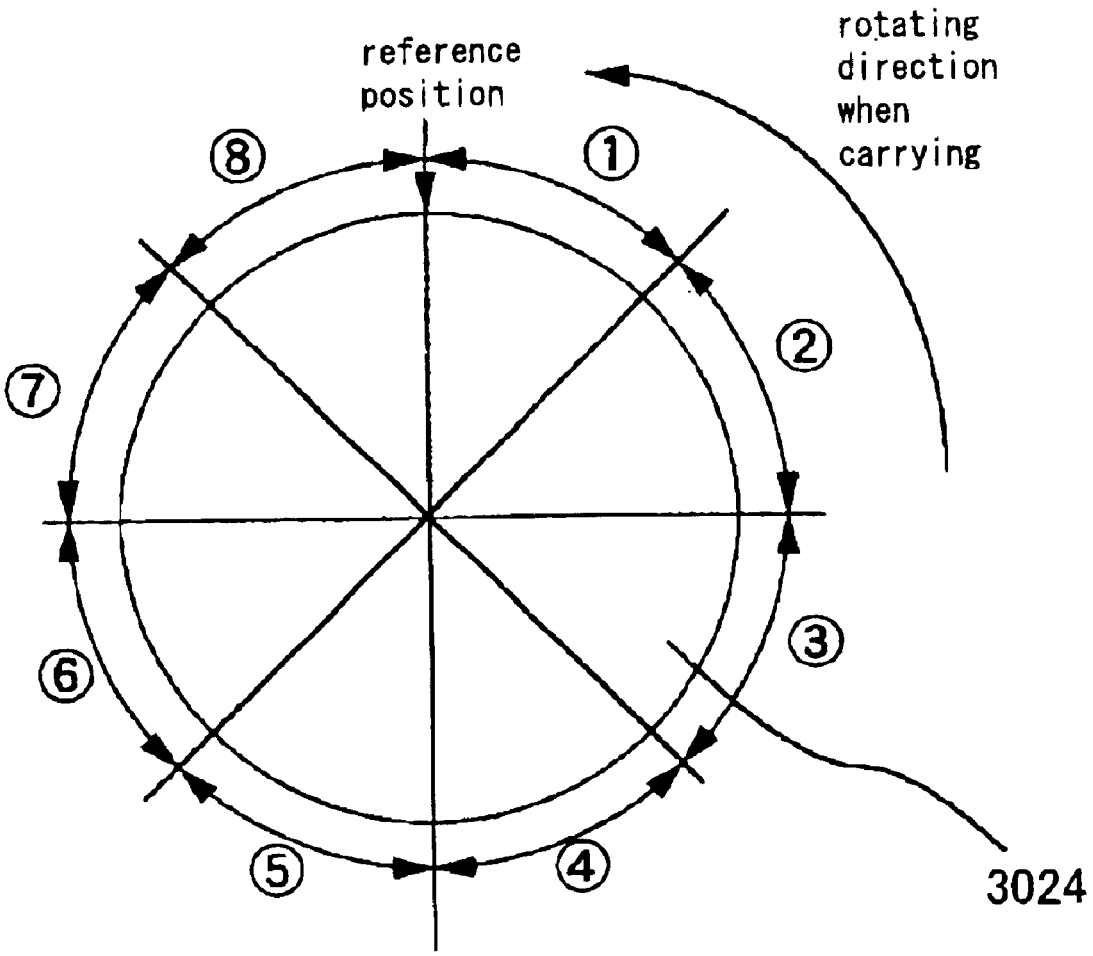
FIG. 34 is an explanatory diagram showing an example of the virtual segments of the paper carry roller 3024.

In this embodiment, as shown in FIG. 34, the circumference of the paper carry roller 3024 is virtually segmented into eight circumferences (1) to (8) in the direction in which it is rotated, in such a manner that the central angles thereof are equal. As mentioned above, the perimeter of the paper carry roller 3024 is set to one inch; therefore, by each virtual circumference segment, the print sheet is carried approximately ⅛ inch. Also, to each virtual circumference segment are set nine types of correction amounts, that is, correction amounts with which the carry amount can be increased or decreased to a correction amount that is as much as four times the smallest correction unit, taking a correction amount of zero as the standard. Here, the smallest correction unit is equal to the smallest paper-carry amount, and the smallest paper-carry amount is set, for example, to $1/1440$ inch or $1/2880$ inch, depending on the printing apparatus.

In the following, a carry amount correction pattern used for determining the correction amount for correcting the carry amount (approximately ⅛ inch) of each virtual circumference segment from the nine types of correction amounts is described.

The carry amount correction pattern is, for example, printed on A4 size white paper, and in the printer, the longitudinal direction is regarded as the paper-carry direction. Eight pattern rows, in which nine patterns are arranged forming a row in the longitudinal direction, are lined up in the lateral direction for each of the eight virtual circumference segments into which the carry roller 3024 is virtually segmented. The patterns are for determining a correction amount for each virtual circumference segment, with the pattern row arranged the furthest to the left among the eight rows corresponding to the virtual circumference segment (1) of the carry roller 3024, and the pattern row arranged the furthest to the right corresponding to the virtual circumference segment (8). Also, the pattern rows are lined up in such a manner that the pattern at the front end of the paper corresponds to (standard carry amount)+(−4×smallest paper carry amount), and the correction amounts added to the standard carry amount are (−3×smallest paper carry amount), (−2×smallest paper carry amount), . . . , (3×smallest paper carry amount), (4×smallest paper carry amount) in order from the front end.

Each pattern is formed by printing a structural pattern before and after the print sheet is carried by each virtual circumference segment. Here, a structural pattern is dot rows lined up in the main-scanning direction or lines formed by connected dots, and is formed by ink that is ejected from predetermined nozzles of the print head as scanning is performed with the print head. In this embodiment, dot rows of 180 dpi are printed in the sub-scanning direction. At this time, the size of the structural patterns in the sub-scanning direction is set sufficiently larger than the carry amount at which the print sheet is carried by the virtual circumference segments. Here, for example, the size of the structural patterns in the sub-scanning direction is set to ½ inch, which is four times the ⅛ inch carry amount of each virtual circumference segment, half of the nozzles of the nozzle rows that are provided in the print head 3036 are used for printing, and only the black nozzles are used.

Also, the nozzles that are used to print a structural pattern after the print sheet has been carried are located more toward the front end of the print sheet by the carry amount than the nozzles that are used when printing before carrying the print sheet. For example, the nozzles that are provided in the print head 3036 are divided into eight regions, a through h, as shown in FIG. 32B, and among them, the nozzles that are used for printing before the print sheet is carried are regarded as an α nozzle group arranged in regions c to f, and the nozzles that are used for printing after carrying are regarded as a β nozzle group arranged in regions b to e. Thus, if the carry amount at which the print sheet is carried by a predetermined virtual circumference segment is correct, then the dots of the structural pattern that is printed before carrying the print sheet and the dots of the structural pattern that is printed before carrying are printed so that they overlap one another. Also, if there is an error in the carry amount, then the dots of the structural patterns printed before and after carrying will be printed in positions shifted by that error amount. If the dots of the structural patterns that are printed before and after carrying are printed so that they overlap one another, then much of the underlying white color will remain and the density of the pattern will be low, whereas if the dots are printed at misaligned positions, then the amount of underlying white color will be reduced, thus increasing the density of the pattern.

In other words, a pattern row, which is made of nine patterns, corresponds to a specific virtual circumference segment, and by respectively adding nine types of correction amounts to the standard carry amount as the carry amount for that virtual circumference segment, many patterns obtained when the print sheet is carried at a slightly different carry amount will be formed. Consequently, if carrying is performed after adding the correction amount, among the nine types of correction amounts, that will cancel the carry error, then the dots of the structural patterns that are printed before and after carrying will overlap each other and a pattern with a low density will be printed; for the other patterns, the structural patterns will be shifted from each other and a pattern with a high density will be printed. Thus, by selecting the correction amount, with which a pattern having a low density is formed, from each pattern row of the carry amount correction pattern having been printed and by correcting the carry amount of the virtual circumference segment by that correction amount, the precision with which the print sheet is carried can be increased.

A pattern with a low density may be selected from the pattern rows by a user or the like who makes a decision after viewing the patterns. Another approach is to perform settings so that the carry amount correction pattern having been printed is carried by the printer, the pattern is scanned by the above-described reflection-type optical sensor 3029, and the pattern having the largest output from the reception sensor is selected.

<(3) Operation for Printing the Carry Amount Correction Pattern>

Figure 35:
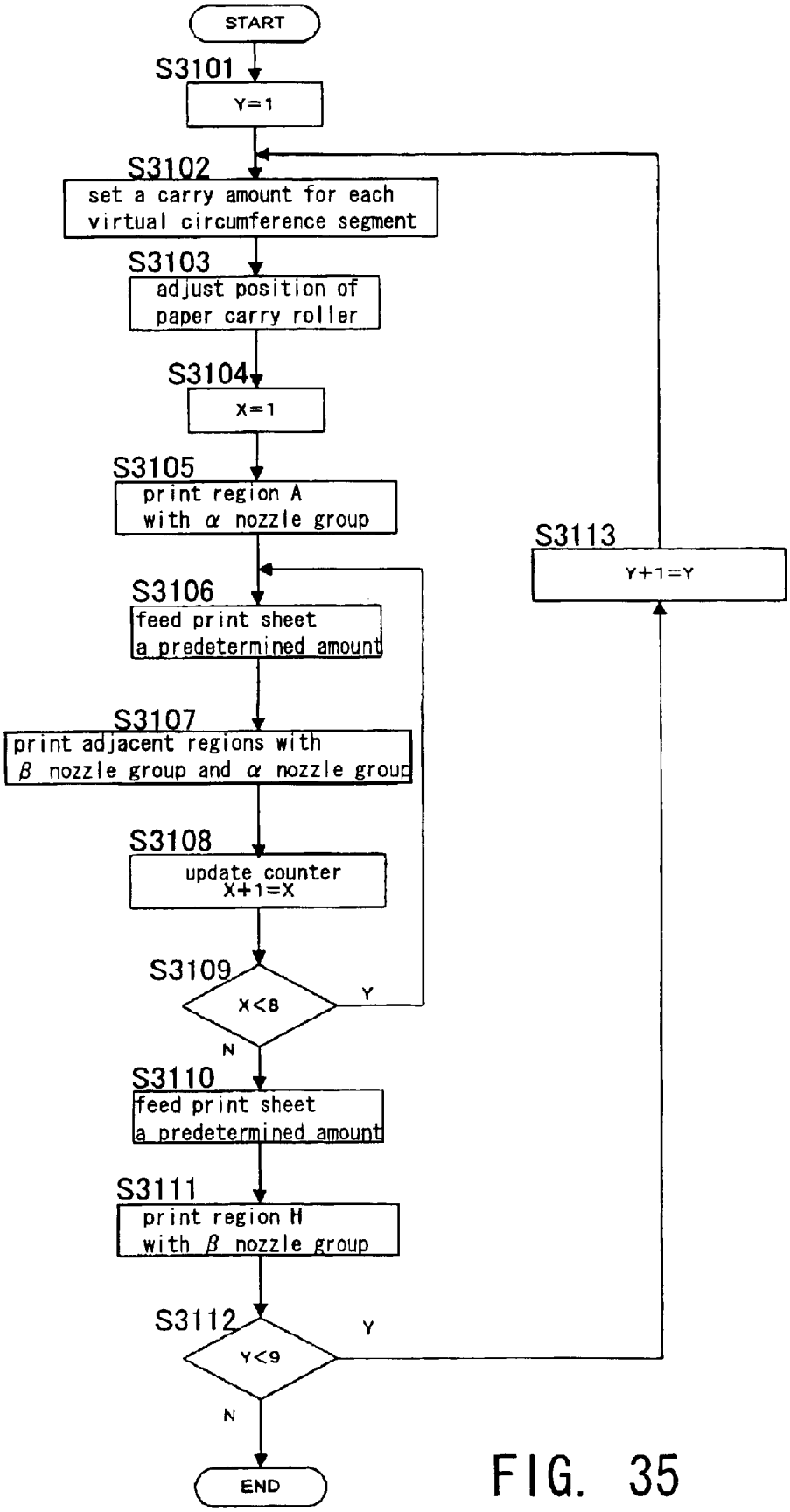
FIG. 35 is a flowchart for describing the printing operation of the carry amount correction pattern of this embodiment.
Figure 36A:
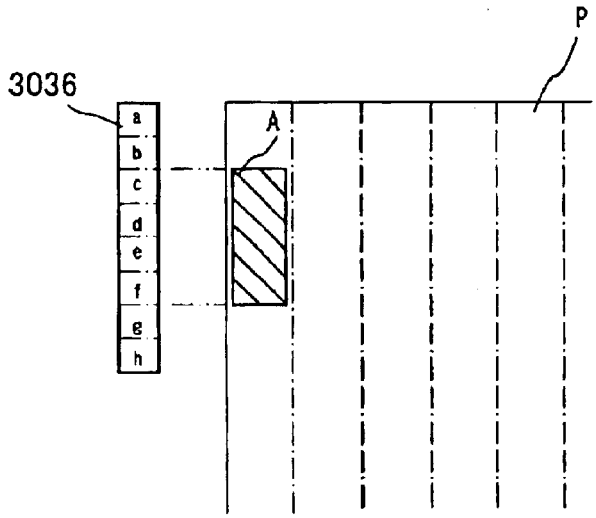
FIGS. 36A, 36B, and 36C are explanatory diagrams showing an overview of the method for printing the carry amount correction pattern.
Figure 36B:
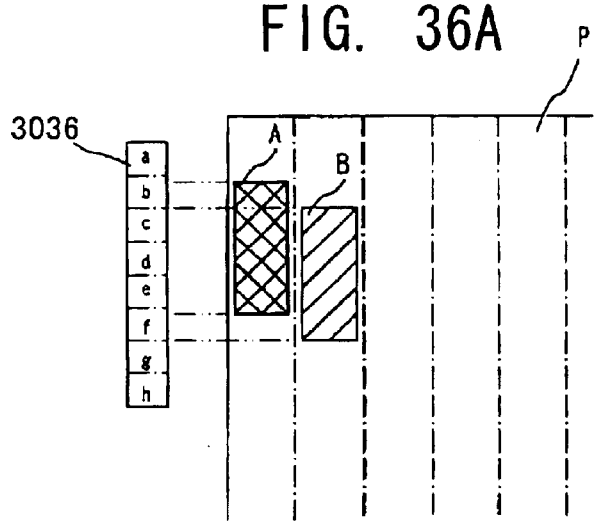
Figure 36C:
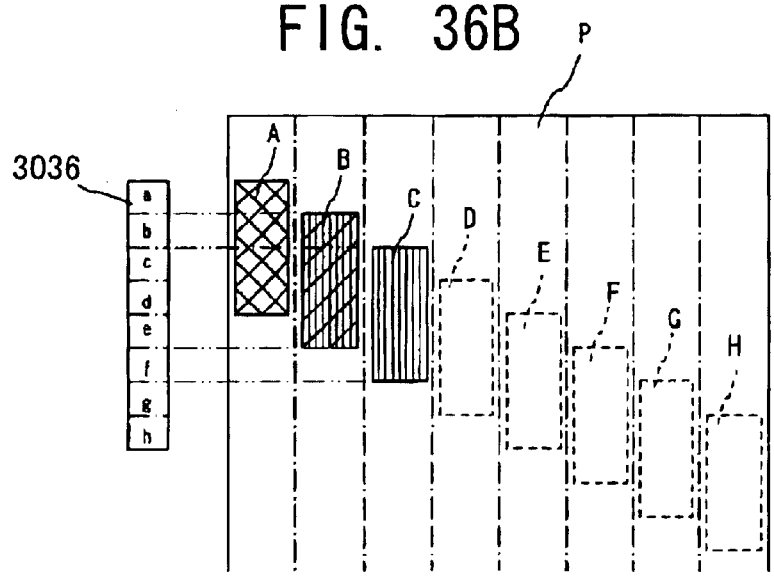

An embodiment of the operation for printing the carry amount correction pattern mentioned above is described using FIGS. 35, 36A, 36B, and 36C. FIG. 35 is a flowchart for describing an example of an embodiment in which the carry amount correction pattern is printed. FIGS. 36A to 36C are explanatory diagrams showing an outline of the method for printing the carry amount correction pattern.

In this embodiment, a case will be described in which the user changes the print sheet that is used, and the carry amount correction pattern is printed in order to set a correction amount that is suited for the print sheet that has been exchanged.

The user sets in the color inkjet printer 3020 a print sheet that he would like to use, and from the computer 3090 connected to the color inkjet printer 3020, he carries out an operation for transmitting a command signal for printing the carry amount correction pattern.

The color inkjet printer 3020 receives the command signal for printing and a carry amount correction pattern print signal TPS from the computer 3090, and starts printing.

When the color inkjet printer 3020 receives the carry amount correction pattern print signal TPS, a "1" is set in the correction amount update counter Y provided inside the system controller 3054 (S3101), and a signal to be input to the sub-scan drive circuit 3062, which drives the paper carry motor 3031, is set so that the carry amount for each of the virtual circumference segments (1) to (8) of the paper carry roller 3024 is $\{(1/8)+(-4\times 1/1440)\}$ inch (S3102). The correction amount update counter Y is a counter that is incremented each time the correction amount is changed.

Then, the reference position of the paper carry roller 3024 is detected by the position detection sensor, and based on the signal of the encoder 3035, the print sheet P is carried to a predetermined print position (S3103).

When the print sheet arrives at the print position, a print counter X that is provided inside the system controller 3054 is set to "1" (S3104). The print counter X is a counter that is incremented each time the carriage 3028 performs scanning once for printing.

When the print counter X is set to "1," the carriage 3028 performs scanning to the right in the drawing while a structural pattern is printed in region A, as shown in FIG. 36A, by the a nozzle group of the regions c to f of the print head 3036 (S3105). After the structural pattern is printed, the paper carry roller 3024 is driven by the paper carry motor 3031, and the print sheet is carried for $\{(1/8)+(-4\times 1/1440)\}$ inch by the circumference (1) of the paper carry roller 3024 (S3106).

After the print sheet is carried by the circumference (1) of the paper carry roller 3024, the carriage 3028 performs scanning to the left while a structural pattern is printed in region B, as shown in FIG. 36B, by the α nozzle group of the regions c to f of the print head 3036, and then a structural pattern is printed in the region A by the β nozzle group of the regions b to e of the print head 3036, forming the pattern of the region A (S3107).

After the pattern of the region A is formed, the print counter X is incremented to "2", (S3108). If the print counter X has a value smaller than "8," then the cycle of carrying the print sheet by the virtual circumference segment and printing structural patterns is repeated (S3109). Thus, after the pattern of the region A is formed, the paper carry roller 3024 is driven and the print sheet is carried for $\{(1/8)+(-4\times 1/1440)\}$ inch by the circumference (2) of the paper carry roller 3024 (S3106).

After the print sheet is carried by the circumference (2) of the paper carry roller 3024, the carriage 3028 performs scanning to the right as a structural pattern is printed in the region B, as shown in FIG. 36C, by the β nozzle group of the regions b to e of the print head 3036 thereby forming a pattern, and then, a structural pattern is printed in region C by the α nozzle group of the regions c to f of the print head 3036 (S3107). In this way, the print sheet is carried by the virtual circumference segments and printed repeatedly until the print counter X becomes "8," forming the patterns of the regions A to G and printing a structural pattern in region H.

When the print counter X becomes "8, " the paper carry roller 3024 is driven and the print sheet is carried for $\{(1/8)+(-4\times 1/1440)\}$ inch by the circumference (8) of the paper carry roller 3024 (S3110). After the print sheet is carried by the circumference (8) of the paper carry roller 3024, the carriage 3028 performs scanning as a structural pattern is printed in the region H by the β nozzle group of the regions b to e of the print head 3036, forming the pattern of the region H, at which point the paper carry roller 3024 has made a full rotation and the first pattern group (FIG. 33), which is made of the eight patterns and obtained when all virtual circumference segments (1) to (8) are each fed for $\{(1/8)+(-4\times 1/1440)\}$ inch, is formed.

When the paper carry roller 3024 has made a full rotation, the correction amount update counter Y is confirmed (S3112), and if the correction amount update counter Y is less than "9," then the correction amount update counter Y is incremented (S3113). Furthermore, a signal to be input to the sub-scan drive circuit 3062 for driving the paper carry motor 3031 is set so that the carry amount of each virtual circumference segment (1) to (8) of the carry roller 3024 becomes $\{(1/8)+(-3\times 1/1440)\}$ inch (S3102), and based on a signal from the encoder 3035, the print sheet is carried to a predetermined print position (S3103), and the carry error caused by paper carrying, including the correction amount, is removed. Then, in the same manner as the first pattern group, a second pattern group (FIG. 33), which is made of the eight patterns that are formed by printing structural patterns after performing carrying by each of the virtual circumference segments (1) to (8) to thereby form patterns and carrying the print sheet by $\{(1/8)+(-3\times 1/1440)$ inch, is formed.

Then, the correction amount settings are changed and pattern groups are formed repeatedly until it is confirmed that the correction amount update counter Y has reached "9," at which point nine pattern groups are formed, thereby printing the carry amount correction pattern.

In this embodiment, an example was shown in which printing was performed when performing scanning with the carriage 3028 in both the left and the right directions; however, it is also possible to print only when performing scanning in one direction. Also, in order to shorten the scan distance, by moving the carriage 3028 from its position after printing is over in each scan to the print start position for the next scan, the amount of time required for printing the carry amount correction pattern can be reduced.

In this embodiment, an example was shown in which patterns are formed by printing the structural patterns that are printed before and after the print sheet is carried so that they overlap one another; however, it is also possible to regard the position that would evenly divide the space between each dot row of the structural pattern having been printed before carrying as an ideal printing position at which each dot row of the structural pattern is to be printed after carrying. In this case, it is preferable to use a print head that has two black nozzle rows each arranged in the sub-scanning direction and in which nozzles are provided at an equal pitch, and where the position of the nozzles in one nozzle row is shifted, in the sub-scanning direction by half the nozzle pitch, with respect to the position of the nozzles in the other row.

Then, the structural pattern that is printed before carrying and the structural pattern that is printed after carrying can be made by printing using different nozzle rows. At this time, if the carry amount at which carrying is performed by a predetermined virtual circumference segment is accurate, then the density of the pattern will increase, and if there is an error in the carry amount, then the density of the pattern will decrease.

<(3) Other Considerations>

In the foregoing, a printing apparatus, for example, according to a third aspect of the invention was described based on the third-embodiment; however, the foregoing embodiment of the present invention is for the purpose of facilitating understanding of the present invention and is not for the purpose of limiting the present invention. The invention can of course be altered and improved without departing from the gist thereof and includes functional equivalents.

It is also possible to achieve a computer system comprising: a printer having the printer main unit according to the above-described third embodiment and a printing-medium unit that is removably mounted to the printer main unit; a computer main unit; a display device such as a CRT; an input device such as a mouse or a keyboard; a flexible drive device; and a CD-ROM drive device. A computer system achieved in this manner is superior to conventional systems as an overall system.

The printer having the printer main unit according to the above-described third embodiment and the printing-medium unit that is removably mounted to the printer main unit can also be given some of the functions or the mechanisms of a computer main unit, a display device, an input device, a flexible disk drive device, and a CD-ROM drive device. For example, the printer can be configured so as to have an image processing section for carrying out image processing, a display section for carrying out various types of displays, and a storage medium inserting/detaching section to/from which a storage medium storing image data captured by a digital camera or the like can be inserted and taken out.

According to the third embodiment, it is possible to achieve a printing apparatus with which a carry amount correction pattern, which is for determining the correction amount of the carry amount of the print sheet, can be printed for each predetermined area obtained by segmenting, a carry amount correction pattern printed by the printing apparatus, a computer program for realizing a function for making the printing apparatus print the carry amount correction pattern, a computer system having the printing apparatus, and a printing method for printing the carry amount correction pattern using the printing apparatus.

What is claimed is:

1. A printing apparatus comprising:

an ejection head for ejecting ink droplets to form dots on a printing medium;

wherein said printing apparatus prints a correction pattern on said printing medium with said ejection head, said correction pattern having a plurality of sub-patterns for correting a misalignment between a position at which dots are formed during a forward pass through which said head is moved and a position at which dots are formed during a return pass through which said head is moved; and corrects said misalignment by selecting two or more sub-patterns among said plurality of sub-patterns, each of said two or more sub-patterns respectively having a peak in density distribution of said correction pattern.

2. A printing apparatus according to claim 1, wherein each sub-pattern is made of dots arranged in a main-scanning direction and a sub-scanning direction.

3. A printing apparatus according to claim 1, wherein each of said sub-patterns has forward-pass dots that are formed with a predetermined spacing therebetween during the forward pass through which said head is moved and return-pass dots that are formed with a predetermined spacing therebetween during the return pass through which said head is moved, and an amount of misalignment between a position at which the forward-pass dots are formed and a position at which the return-pass dots are formed is different for each sub-pattern.

4. A printing apparatus according to claim 1, wherein a correction amount with respect to said misalignment is set to be an integer multiple of a distance that is obtained by evenly dividing an ideal dot pitch in a main-scanning direction, and a number of the sub-patterns included in the correction pattern is larger than a number by which the ideal dot pitch has been divided.

5. A printing apparatus according to claim 1, wherein said sub-patterns are arranged in order of correction amounts corresponding to each said sub-pattern, and said printing apparatus selects two of the sub-patterns based on a density distribution in the main-scanning direction of said correction pattern, and regards a median between the correction values of the two selected sub-patterns as a correction value for correcting said misalignment.

6. A printing apparatus according to claim 5, wherein said two sub-patterns are a sub-pattern that stands out the most in the density distribution in the main-scanning direction of said correction pattern and a sub-pattern that is located away from this sub-pattern by said number by which the ideal dot pitch has been divided.

7. A printing apparatus according to claim 5, wherein in said correction pattern, a predetermined sub-pattern and a sub-pattern located away therefrom by said number by which the ideal dot pitch has been divided are regarded as a sub-pattern pair, and among the sub-pattern pairs, the sub-pattern pair that stands out the most in average density is regarded as said two sub-patterns.

8. A printing apparatus according to claim 7, wherein, if there are a plurality of sub-pattern pairs that stand out the most in said average density, then each of the sub-patterns located in the middle of each of these sub-pattern pairs are regarded as said two sub-patterns.

9. A printing apparatus according to claim 7, wherein if there are a plurality of sub-pattern pairs that stand out the most in said average density, then the sub-pattern pair that includes a sub-pattern having a density that stands out the most among the sub-patterns making up each of the sub-pattern pairs is regarded as said two sub-patterns.

10. A printing apparatus according to claim 5, wherein the density distribution of said correction pattern is a curved line interpolated based on the density of each sub-pattern.

11. A printing apparatus according to claim 5, wherein if two sub-patterns, each of which has a peak in the density distribution in the main-scanning direction of said correction pattern, do not exist, then a correction amount of a sub-pattern that is located at an end in main-scanning direction is changed, and a new correction pattern in which the correction amounts have sequentially been changed in the main-scanning direction is printed.

12. A printing apparatus according to claim 11, wherein the correction amounts for printing the new correction pattern are changed according to a position of a sub-pattern that has a peak in density with respect to a sub-pattern serving as a reference of said correction amount.

13. A printing apparatus according to claim 1, further comprising:

a sensor for scanning said printed correction pattern in the main-scanning direction and reading a density of each sub-pattern;

wherein the density of said printed correction pattern is read by said sensor, and said misalignment is corrected based on density information that has been read out.

14. A printing apparatus according to claim 13, further comprising:

selection means for selecting a sub-pattern that has a peak in density based on said density information;

wherein if two or more sub-patterns that stand out in density cannot be selected by said selection means, then a correction amount of a sub-pattern that is located at an end in the main-scanning direction is changed, and a new correction pattern is printed.

15. A printing apparatus comprising:

an ejection head for ejecting ink droplets to form dots on a printing medium;

wherein said printing apparatus prints a correction pattern on said printing medium with said ejection head, said correction pattern having a plurality of sub-patterns of correcting a misalignment between a position at which dots are formed during a forward pass through which said head is moved and a position at which dots are formed during a return pass through which said head is moved, each of said sub-patterns is made of forward-pass dots and return-pass dots arranged in a main-scanning direction and a sub-scanning direction, said forward-pass dots being formed with a predetermined spacing therebetween during the forward pass through which said head is moved, and said return-pass dots being formed with a predetermined spacing therebetween during the return pass through which said head is moved, an amount of misalignment between a position at which the forward-pass dots are formed and a position at which the return-pass dots are formed is different for each sub-pattern, a correction amount with respect to said misalignment is set to be an integer multiple of a distance that is obtained by evenly dividing an ideal dot pitch in a main-scanning direction, a number of the sub-patterns included in the correction pattern is larger than a number by which the ideal dot pitch has been divided, said sub-patterns are arranged in order of correction amounts corresponding to each said sub-pattern, and said printing apparatus selecting two of the sub-patterns among said pluarality of sub-patterns, each of said two of the sub-patterns having a peak in density distribution in the main-scanning direction of said correction pattern, regards a median between the correction values of the two selected sub-patterns as a correction value for correcting said misalignment, and two sub-patterns, each of which has a peak in the density distribution in the main-scanning direction of said correction pattern, do no exit, changes a correction amount of a sub-pattern that is located at an end in the main-scanning direction, and prints a new correction pattern in which the correction amounts have sequentially been changed in the main-scanning direction.

16. A storage medium having a program recorded thereon, comprising:

a memory for storing the program;

wherein said program opearable to make a printing apparatus that has an ejection head for ejecting ink droplets to form dots on a printing medium: print a correction pattern on said printing medium with said ejection head, said correction pattern having a plurality of sub- patterns for correcting a misalignment between a position at which dots are formed during a forward pass through which said head is moved and a position at which dots are formed during a return pass through which said head is moved, and correct said misalignment by selecting two or more sub-patterns among said plurality of sub-patterns, each of said two or more sub-patterns having a peak in density distribution of said correction pattern.

17. A storage medium according to claim 16, wherein if two sub-patterns that stand out in the density distribution in the main-scanning direction of said correction pattern do not exist, said program makes said printing apparatus change a correction amount of a sub-pattern that is located at an end in the main-scanning direction and print a new correction pattern in which the correction amounts have sequentially been changed in the main-scanning direction.

18. A storage medium according to claim 17, wherein said program displays information for urging said change of the correction amount of said sub-pattern that is located at the end in the main-scanning direction on a user interface.

19. A computer system comprising:

a computer main unit; and a printing apparatus that has an ejection head for ejecting ink droplets to form dots on a printing medium, is connected to said computer main unit;

wherein said computer system prints a correction pattern on said printing medium with said ejection head, said correction pattern having a plurality of sub-patterns for correcting a misalignment between a position at which dots are formed during a foward pass through which said head is moved and a position at which dots are formed during a return pass through which said head is moved, and corrects said misalignment by selecting two or more sub-patterns among said pluarality of sub-patterns, each of said two or more sub-patterns having a peak in density distribution of said correction pattern.

20. A method for correcting a misalignment comprising the steps of:

printing a correction pattern on a printing medium with an ejection head for ejecting ink droplets to form dots on said printing medium, said correction pattern having a plurality of sub-patterns for correcting a misalignment between a position at which dots are formed during a forward pass through which said head is moved and a position at which dots are formed during a return pass through which said head is moved, and correcting said misalignment by selecting two or more sub-patterns among said plurality of sub-patterns, each of said two or more sub-patterns respectively having a peak in density distribution of said correction pattern.

* * * * *